US007063644B2

(12) United States Patent
Albert et al.

(10) Patent No.: US 7,063,644 B2
(45) Date of Patent: Jun. 20, 2006

(54) SYSTEM AND METHOD FOR PREPARING WORKOUTS FOR A PLURALITY OF INDIVIDUALS AND MONITORING INDIVIDUAL COMPLIANCE

(75) Inventors: Gary Albert, Gaithersburg, MD (US); Eric Westbrook, Washington, DC (US); Lewie Walton, Germantown, MD (US); Brian Razzaque, Baltimore, MD (US)

(73) Assignee: Activ Trax, Gaithersburg, MD (US)

( * ) Notice: Subject to any disclaimer, the term of this patent is extended or adjusted under 35 U.S.C. 154(b) by 402 days.

(21) Appl. No.: 10/173,575

(22) Filed: Jun. 18, 2002

(65) Prior Publication Data

US 2004/0229729 A1 Nov. 18, 2004

(51) Int. Cl.
*A63B 21/06* (2006.01)

(52) U.S. Cl. ..... 482/8; 482/9; 482/900

(58) Field of Classification Search ..... 482/1–9, 482/91, 900–902; 73/379.01–379.03
See application file for complete search history.

(56) References Cited

U.S. PATENT DOCUMENTS

| | | | | |
|---|---|---|---|---|
| 3,998,100 | A | 12/1976 | Pizatella | |
| 4,828,257 | A | 5/1989 | Dyer | |
| 4,867,442 | A | 9/1989 | Matthews | |
| 4,911,427 | A | 3/1990 | Matsumoto | |
| 5,331,851 | A * | 7/1994 | Parviainen et al. | 73/379.01 |
| 5,387,164 | A | 2/1995 | Brown | |
| 5,618,245 | A * | 4/1997 | Trulaske et al. | 482/7 |
| 5,759,043 | A | 6/1998 | Craig | |
| 5,890,997 | A | 4/1999 | Roth | |
| 5,904,639 | A * | 5/1999 | Smyser et al. | 482/91 |
| 5,916,063 | A | 6/1999 | Alessandri | |
| 5,921,891 | A | 7/1999 | Browne | |
| 5,944,633 | A | 8/1999 | Wittrock | |
| 6,050,924 | A | 4/2000 | Shea | |
| 6,077,193 | A | 6/2000 | Buhler | |
| 6,171,218 | B1 | 1/2001 | Shea | |
| 6,193,631 | B1 | 2/2001 | Hickman | |
| 2002/0033753 | A1 | 3/2002 | Imbo | |

* cited by examiner

*Primary Examiner*—Glenn E. Richman
(74) *Attorney, Agent, or Firm*—Berenato, White & Stavish

(57) ABSTRACT

A method of developing a workout comprising a series of exercises and communicating the workout to a user is disclosed that involves identifying a muscle group to use during a workout, selecting an intensity level for exercising the muscle group, selecting an exercise from a plurality of exercises for exercising the muscle group, selecting a routine from a plurality of routines for performing each of the plurality of exercises at the selected intensity level, each of the plurality of routines comprising a number of repetitions, selecting a resistance level related to the maximum resistance the user was able to manipulate on a first exercise machine, selecting a second exercise machine for performing the selected exercise, and displaying a workout comprising an identification of the second exercise machine, a name of an exercise to be performed on the second exercise machine, a resistance level to be used in performing the named exercise on the second exercise machine, and information relating to the number of repetitions and sets to be performed. A system for carrying out the method is also disclosed.

4 Claims, 77 Drawing Sheets

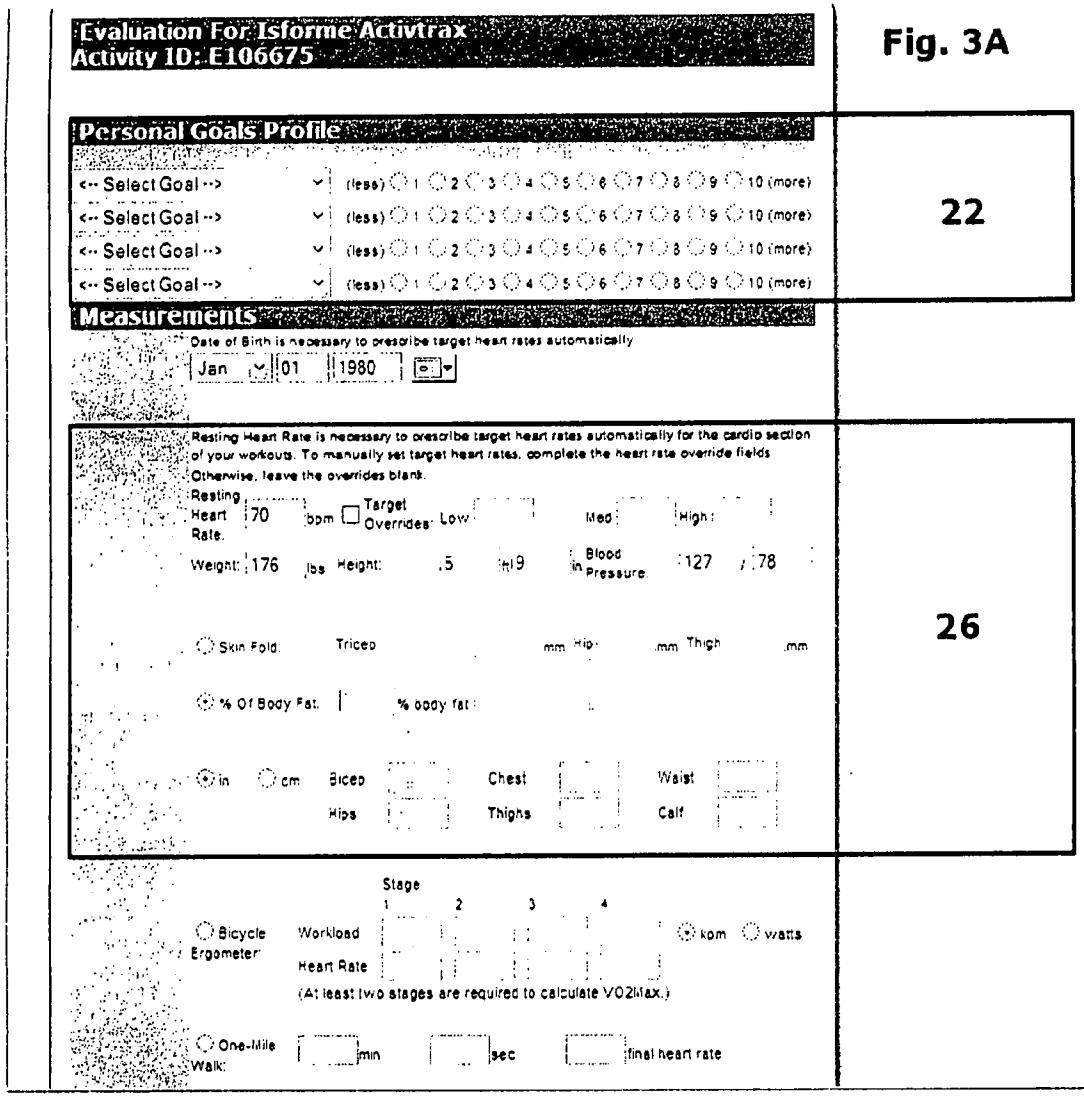
Fig. 3A
Evaluation For: Isforme Activitrax
Activity ID: E106675
Personal Goals Profile
22
<-- Select Goal -->
(less)
10 (more)
Measurements
Date of Birth is necessary to prescribe target heart rates automatically
Jan
01
1980
26
Resting Heart Rate is necessary to prescribe target heart rates automatically for the cardio section of your workouts. To manually set target heart rates, complete the heart rate override fields. Otherwise, leave the overrides blank.
Resting Heart Rate:
70
bpm
Target Overrides: Low:
Med:
High:
Weight:
176
lbs
Height:
5
9
Blood Pressure:
127
78
Skin Fold:
Triceps
mm
Hip:
mm
Thigh:
mm
% Of Body Fat:
% body fat:
in
cm
Biceps
Hips
Chest
Thighs
Waist
Calf
Bicycle Ergometer
Workload
Heart Rate
Stage
1
2
3
4
(At least two stages are required to calculate VO2Max.)
kpm
watts
One-Mile Walk:
min
sec
final heart rate

Fig. 4

Level One 2 day
Day #1

38

Day #1 Cardio Level M

| Order | Muscle Group | Number of Sets | Weight Rule | Gender | Delete |
|---|---|---|---|---|---|
| 1 | Pecs | 3 | M | Both | Delete |
| 2 | Outer Pecs | 2 | L | Both | Delete |
| 3 | Delts | 2 | L | Both | Delete |
| 4 | Outer Thighs | 2 | L | Both | Delete |
| 5 | Inner Thighs | 2 | L | Both | Delete |

Update Day | Add Day | Delete This Day

Add New Muscle Group

View Next Day | Go to day # 1 | Go!

Back to View Routines

Fig. 6

Three Set Rules (Medium Intensity Workout)

| Rule No. 1001 | Increase Threshold: 21 Decrease Threshold: 15 | | | |
|---|---|---|---|---|
| Set No. | Rule | Repetitions | Rest | Threshold |
| 1 | Medium | BEST | 1:00 | 20 |
| 2 | Medium | 15-20 | 1:30 | 20 |
| 3 | Medium | 15-20 | 1:00 | 20 |

| Rule No. 1002 | Increase Threshold: 15 Decrease Threshold: 10 | | | |
|---|---|---|---|---|
| Set No. | Rule | Repetitions | Rest | Threshold |
| 1 | Medium | 12-15 | 1:00 | 15 |
| 2 | Heavy | 10-12 | 1:30 | 15 |
| 3 | Medium | 12-15 | 1:00 | 15 |

| Rule No. 1003 | Increase Threshold: 20 Decrease Threshold: 15 | | | |
|---|---|---|---|---|
| Set No. | Rule | Repetitions | Rest | Threshold |
| 1 | Medium | BEST | 1:00 | 15 |
| 2 | Medium | BEST | 1:30 | 15 |
| 3 | Medium | BEST | 1:00 | 15 |

View Max Weights:

Fig. 7A

View By Base Exercise: All

View By Exercise: All

Minimum Weight Range: All

Maximum Weight Range: All

Resistance: All

Filter 40 42 44 48 50 52 54

| Baseline Exercise | Exercise Name | Gender | Weight Range | Resistance | Max % | HH % | High % | Med % | Low % | Edit | Delete |
|---|---|---|---|---|---|---|---|---|---|---|---|
| Seated Chest Press | 1-Arm Overhead Extension | Female | 0-9999 LBS | Dumbbell | 20 | 80 | 65 | 55 | 40 | Edit | Delete |
| Seated Chest Press | 1-Arm Overhead Extension | Male | 0-9999 LBS | Dumbbell | 20 | 85 | 75 | 65 | 50 | Edit | Delete |
| Seated Chest Press | 1-Arm Overhead Extension on Bench | Male | 0-9999 LBS | Machine | 19 | 85 | 75 | 65 | 50 | Edit | Delete |
| Seated Chest Press | 1-Arm Overhead Extension on Bench | Female | 0-9999 LBS | Machine | 19 | 80 | 70 | 60 | 50 | Edit | Delete |
| Seated Chest Press | 1-Arm Overhead Extension on Floor | Male | 0-9999 LBS | Machine | 19 | 85 | 75 | 65 | 50 | Edit | Delete |
| Seated Chest Press | 1-Arm Overhead Extension on Floor | Female | 0-9999 LBS | Machine | 19 | 80 | 70 | 60 | 50 | Edit | Delete |
| Seated Chest Press | Barbell Bench Press | Male | 0-9999 LBS | Barbell | 100 | 85 | 75 | 65 | 50 | Edit | Delete |
| Seated Chest Press | Barbell Bench Press | Female | 0-9999 LBS | Barbell | 100 | 80 | 70 | 60 | 50 | Edit | Delete |
| Seated Chest Press | Bench Dip | Male | 0-9999 LBS | Body Weight | 0 | 85 | 0 | 0 | 0 | Edit | Delete |
| Seated Chest Press | Bench Dip | Female | 0-9999 LBS | Body Weight | 0 | 80 | 0 | 0 | 0 | Edit | Delete |
| 46 Seated Chest Press | Bench Press | Female | 0-9999 LBS | Dumbbell | 40 | 80 | 70 | 60 | 50 | Edit | Delete |
| Seated Chest Press | Bench Press | Male | 0-9999 LBS | Dumbbell | 40 | 85 | 75 | 65 | 50 | Edit | Delete |
| 42 Seated Chest Press | Bench Press | Male | 0-9999 LBS | Machine | 100 | 85 | 75 | 65 | 50 | Edit | Delete |
| Seated Chest Press | Bench Press | Female | 0-9999 LBS | Machine | 100 | 80 | 70 | 60 | 50 | Edit | Delete |

Fig. 7B

| | | | | | | | | | | | |
|---|---|---|---|---|---|---|---|---|---|---|---|
| Seated Chest Press | Bent Over Kick Back | Male | 0-9999 LBS | Machine | 16 | 85 | 75 | 65 | 50 | Edit | Delete |
| Seated Chest Press | Bent Over Kick Back | Female | 0-9999 LBS | Machine | 16 | 80 | 70 | 60 | 50 | Edit | Delete |
| Seated Chest Press | Cable Crossover | female | 0-9999 LBS | Machine | 30 | 80 | 70 | 60 | 50 | Edit | Delete |
| Seated Chest Press | Cable Crossover | Male | 0-9999 LBS | Machine | 30 | 85 | 75 | 65 | 50 | Edit | Delete |
| Seated Chest Press | Chest Press on Bench | female | 0-999 LBS | Machine | 50 | 80 | 70 | 60 | 50 | Edit | Delete |
| Seated Chest Press | Chest Press on Bench | Male | 0-999 LBS | Machine | 50 | 85 | 75 | 65 | 50 | Edit | Delete |
| Seated Chest Press | Chest Press w/ Alternating Lunge | Male | 0-9999 LBS | Machine | 40 | 85 | 75 | 65 | 50 | Edit | Delete |
| Seated Chest Press | Chest Press w/ Alternating Lunge | Female | 0-9999 LBS | Machine | 40 | 80 | 70 | 60 | 50 | Edit | Delete |
| Seated Chest Press | Chest Press w/ Static Lunge | Male | 0-9999 LBS | Machine | 40 | 85 | 75 | 65 | 50 | Edit | Delete |
| Seated Chest Press | Chest Press w/ Static Lunge | Female | 0-9999 LBS | Machine | 40 | 80 | 70 | 60 | 50 | Edit | Delete |
| Seated Chest Press | Close Grip Bench Press | Female | 0-9999 LBS | Barbell | 85 | 80 | 70 | 60 | 50 | Edit | Delete |
| Seated Chest Press | Close Grip Bench Press | Male | 0-9999 LBS | Barbell | 85 | 85 | 75 | 65 | 50 | Edit | Delete |
| Seated Chest Press | Decline Barbell Bench Press | Male | 0-9999 LBS | Barbell | 110 | 85 | 75 | 65 | 50 | Edit | Delete |
| Seated Chest Press | Decline Barbell Bench Press | Female | 0-9999 LBS | Barbell | 110 | 80 | 70 | 60 | 50 | Edit | Delete |
| Seated Chest Press | Decline Bench Press | female | 0-9999 LBS | Machine | 100 | 80 | 70 | 60 | 50 | Edit | Delete |
| Seated Chest Press | Decline Bench Press | Male | 0-9999 LBS | Machine | 105 | 85 | 75 | 65 | 50 | Edit | Delete |
| Seated Chest Press | Decline Dumbbell Bench Press | Female | 0-9999 LBS | Dumbbell | 40 | 80 | 70 | 60 | 50 | Edit | Delete |
| Seated Chest Press | Decline Dumbbell Bench Press | Male | 0-9999 LBS | Dumbbell | 40 | 85 | 75 | 65 | 50 | Edit | Delete |
| Seated Chest Press | Decline Dumbbell Fly | female | 0-9999 LBS | Dumbbell | 25 | 80 | 70 | 60 | 45 | Edit | Delete |
| Seated Chest Press | Decline Dumbbell Fly | Male | 0-9999 LBS | Dumbbell | 25 | 85 | 75 | 65 | 50 | Edit | Delete |
| Seated Chest Press | Decline Fly on Bench | Male | 0-9999 LBS | Machine | 40 | 85 | 75 | 65 | 50 | Edit | Delete |
| Seated Chest Press | Decline Fly on Bench | Female | 0-9999 LBS | Machine | 40 | 80 | 70 | 60 | 50 | Edit | Delete |
| Seated Chest Press | Decline Fly on Heels | Male | 0-9999 LBS | Machine | 55 | 85 | 75 | 65 | 50 | Edit | Delete |
| Seated Chest Press | Decline Fly on Heels | Female | 0-9999 LBS | Machine | 55 | 80 | 70 | 60 | 50 | Edit | Delete |
| Seated Chest Press | Decline Fly w/ Alternating Lunge | Male | 0-9999 LBS | Machine | 35 | 85 | 75 | 65 | 50 | Edit | Delete |
| Seated Chest Press | Decline Fly w/ Alternating Lunge | Female | 0-9999 LBS | Machine | 35 | 80 | 70 | 60 | 50 | Edit | Delete |
| Seated Chest Press | Decline Fly w/ Static Lunge | Male | 0-9999 LBS | Machine | 35 | 85 | 75 | 65 | 50 | Edit | Delete |

Fig. 7B Cont.

| | | | | | | | | | | | |
|---|---|---|---|---|---|---|---|---|---|---|---|
| Seated Chest Press | Incline Bench Press | female | 0-10 LBS | Dumbbell | 60 | 80 | 70 | 60 | 50 | Edit | Delete |
| Seated Chest Press | Incline Bench Press | Male | 0-10 LBS | Dumbbell | 60 | 85 | 75 | 60 | 50 | Edit | Delete |
| Seated Chest Press | Incline Bench Press | Female | 11-50 LBS | Dumbbell | 40 | 80 | 70 | 60 | 50 | Edit | Delete |
| Seated Chest Press | Incline Bench Press | Male | 11-50 LBS | Dumbbell | 40 | 85 | 75 | 60 | 50 | Edit | Delete |
| Seated Chest Press | Incline Bench Press | Male | 51-9999 LBS | Dumbbell | 35 | 85 | 75 | 60 | 50 | Edit | Delete |
| Seated Chest Press | Incline Bench Press | Female | 51-9999 LBS | Dumbbell | 35 | 80 | 70 | 60 | 50 | Edit | Delete |
| Seated Chest Press | Incline Bench Press | Male | 0-9999 LBS | Machine | 90 | 85 | 75 | 65 | 50 | Edit | Delete |
| Seated Chest Press | Incline Bench Press | Female | 0-9999 LBS | Machine | 90 | 80 | 70 | 60 | 50 | Edit | Delete |
| Seated Chest Press | Incline Chest Press | Female | 0-9999 LBS | Machine | 90 | 80 | 70 | 60 | 50 | Edit | Delete |
| Seated Chest Press | Incline Chest Press | Male | 0-9999 LBS | Machine | 90 | 85 | 75 | 65 | 50 | Edit | Delete |
| Seated Chest Press | Incline Fly | female | 0-100 LBS | Dumbbell | 26 | 80 | 70 | 60 | 45 | Edit | Delete |
| Seated Chest Press | Incline Fly | Male | 0-100 LBS | Dumbbell | 26 | 85 | 75 | 65 | 50 | Edit | Delete |
| Seated Chest Press | Incline Fly | male | 101-9999 LBS | Dumbbell | 24 | 85 | 75 | 60 | 50 | Edit | Delete |
| Seated Chest Press | Incline Fly | Female | 101-9999 LBS | Dumbbell | 24 | 80 | 70 | 60 | 45 | Edit | Delete |
| Seated Chest Press | Incline Fly on Bench | Male | 0-9999 LBS | Machine | 33 | 85 | 75 | 65 | 50 | Edit | Delete |
| Seated Chest Press | Incline Fly on Bench | Female | 0-9999 LBS | Machine | 33 | 80 | 70 | 60 | 50 | Edit | Delete |
| Seated Chest Press | Incline Fly on Heels | Male | 0-9999 LBS | Machine | 27 | 85 | 75 | 65 | 50 | Edit | Delete |
| Seated Chest Press | Incline Fly on Heels | Female | 0-9999 LBS | Machine | 27 | 80 | 70 | 60 | 50 | Edit | Delete |
| Seated Chest Press | Incline Fly w/ Alternating Lunge | Male | 0-9999 LBS | Machine | 33 | 85 | 75 | 65 | 50 | Edit | Delete |
| Seated Chest Press | Incline Fly w/ Alternating Lunge | Female | 0-9999 LBS | Machine | 33 | 80 | 70 | 60 | 50 | Edit | Delete |
| Seated Chest Press | Incline Fly w/ Static Lunge | Male | 0-9999 LBS | Machine | 33 | 85 | 75 | 65 | 50 | Edit | Delete |
| Seated Chest Press | Incline Fly w/ Static Lunge | Female | 0-9999 LBS | Machine | 33 | 80 | 70 | 60 | 50 | Edit | Delete |
| Seated Chest Press | Incline Press on Bench | Male | 0-9999 LBS | Machine | 42 | 85 | 75 | 65 | 50 | Edit | Delete |
| Seated Chest Press | Incline Press on Bench | Female | 0-9999 LBS | Machine | 42 | 80 | 70 | 60 | 50 | Edit | Delete |
| Seated Chest Press | Incline Press on Heels | female | 0-9999 LBS | Machine | 30 | 80 | 70 | 60 | 50 | Edit | Delete |
| Seated Chest Press | Incline Press on Heels | Male | 0-9999 LBS | Machine | 30 | 85 | 75 | 65 | 50 | Edit | Delete |
| Seated Chest Press | Incline Press w/ Alternating Lunge | Male | 0-9999 LBS | Machine | 35 | 85 | 75 | 65 | 50 | Edit | Delete |

Fig. 7C

| | | | | | | | | | | | |
|---|---|---|---|---|---|---|---|---|---|---|---|
| Seated Chest Press | Kick Back w/ Static Backward Lunge | Male | 0-9999 LBS | Machine | 16 | 85 | 75 | 65 | 50 | Edit | Delete |
| Seated Chest Press | Kick Back w/ Static Backward Lunge | Female | 0-9999 LBS | Machine | 16 | 80 | 70 | 60 | 50 | Edit | Delete |
| Seated Chest Press | Low-Pulley Kick Back | Female | 0-9999 LBS | Machine | 10 | 80 | 70 | 60 | 50 | Edit | Delete |
| Seated Chest Press | Low-Pulley Kick Back | Male | 0-9999 LBS | Machine | 10 | 85 | 75 | 65 | 50 | Edit | Delete |
| Seated Chest Press | Lying Chest Press | Male | 0-9999 LBS | Machine | 100 | 85 | 75 | 65 | 50 | Edit | Delete |
| Seated Chest Press | Lying Chest Press | Female | 0-9999 LBS | Machine | 100 | 80 | 70 | 60 | 50 | Edit | Delete |
| Seated Chest Press | Lying Extension | Female | 0-9999 LBS | Barbell | 50 | 80 | 70 | 60 | 50 | Edit | Delete |
| Seated Chest Press | Lying Extension | Male | 0-9999 LBS | Barbell | 50 | 85 | 75 | 65 | 50 | Edit | Delete |
| Seated Chest Press | Lying Extension | Male | 0-9999 LBS | Dumbbell | 40 | 85 | 75 | 60 | 50 | Edit | Delete |
| Seated Chest Press | Lying Extension | Female | 0-9999 LBS | Dumbbell | 40 | 80 | 70 | 60 | 50 | Edit | Delete |
| Seated Chest Press | Overhead Extension | Male | 0-9999 LBS | Machine | 45 | 85 | 75 | 60 | 50 | Edit | Delete |
| Seated Chest Press | Overhead Extension | Female | 0-9999 LBS | Machine | 45 | 80 | 70 | 60 | 50 | Edit | Delete |
| Seated Chest Press | Overhead Extension on Heels | Male | 0-9999 LBS | Machine | 35 | 85 | 75 | 65 | 50 | Edit | Delete |
| Seated Chest Press | Overhead Extension on Heels | Female | 0-9999 LBS | Machine | 35 | 80 | 70 | 60 | 50 | Edit | Delete |
| Seated Chest Press | Overhead Extension w/ Alternating Lunge | Male | 0-9999 LBS | Machine | 30 | 85 | 75 | 65 | 50 | Edit | Delete |
| Seated Chest Press | Overhead Extension w/ Alternating Lunge | Female | 0-9999 LBS | Machine | 30 | 80 | 70 | 60 | 50 | Edit | Delete |
| Seated Chest Press | Overhead Extension w/ Static Lunge | Male | 0-9999 LBS | Machine | 30 | 85 | 75 | 65 | 50 | Edit | Delete |
| Seated Chest Press | Overhead Extension w/ Static Lunge | Female | 0-9999 LBS | Machine | 30 | 80 | 70 | 60 | 50 | Edit | Delete |
| Seated Chest Press | Pec Fly | female | 0-25 LBS | Machine | 80 | 80 | 70 | 60 | 50 | Edit | Delete |
| Seated Chest Press | Pec Fly | Male | 0-25 LBS | Machine | 80 | 85 | 75 | 60 | 50 | Edit | Delete |
| Seated Chest Press | Pec Fly | Female | 26-30 LBS | Machine | 75 | 80 | 70 | 60 | 50 | Edit | Delete |
| Seated Chest Press | Pec Fly | Male | 26-30 LBS | Machine | 75 | 85 | 75 | 60 | 50 | Edit | Delete |
| Seated Chest Press | Pec Fly | Male | 31-40 LBS | Machine | 70 | 85 | 75 | 60 | 50 | Edit | Delete |
| Seated Chest Press | Pec Fly | Female | 31-40 LBS | Machine | 70 | 80 | 70 | 60 | 50 | Edit | Delete |

Fig. 7C Cont.

| | | | | | | | | | | | |
|---|---|---|---|---|---|---|---|---|---|---|---|
| Seated Chest Press | Reverse Grip Pushdown | Female | 61-80 LBS | Machine | 70 | 80 | 70 | 60 | 50 | Edit | Delete |
| Seated Chest Press | Reverse Grip Pushdown | Male | 81-131 LBS | Machine | 60 | 85 | 75 | 65 | 50 | Edit | Delete |
| Seated Chest Press | Reverse Grip Pushdown | Female | 81-131 LBS | Machine | 60 | 80 | 70 | 60 | 50 | Edit | Delete |
| Seated Chest Press | Reverse Grip Pushdown | Female | 131-9999 LBS | Machine | 55 | 80 | 70 | 60 | 50 | Edit | Delete |
| Seated Chest Press | Reverse Grip Pushdown | Male | 131-9999 LBS | Machine | 55 | 85 | 75 | 65 | 50 | Edit | Delete |
| Seated Chest Press | Rope Pushdown | Male | 0-40 LBS | Machine | 85 | 85 | 75 | 65 | 50 | Edit | Delete |
| Seated Chest Press | Rope Pushdown | Female | 0-40 LBS | Machine | 85 | 80 | 70 | 60 | 50 | Edit | Delete |
| Seated Chest Press | Rope Pushdown | Male | 41-50 LBS | Machine | 75 | 85 | 75 | 65 | 50 | Edit | Delete |
| Seated Chest Press | Rope Pushdown | Female | 41-50 LBS | Machine | 75 | 80 | 70 | 60 | 50 | Edit | Delete |
| Seated Chest Press | Rope Pushdown | Male | 51-60 LBS | Machine | 65 | 85 | 75 | 65 | 50 | Edit | Delete |
| Seated Chest Press | Rope Pushdown | Female | 51-60 LBS | Machine | 65 | 80 | 70 | 60 | 50 | Edit | Delete |
| Seated Chest Press | Rope Pushdown | Male | 61-80 LBS | Machine | 60 | 85 | 75 | 65 | 50 | Edit | Delete |
| Seated Chest Press | Rope Pushdown | Female | 61-80 LBS | Machine | 60 | 80 | 70 | 60 | 50 | Edit | Delete |
| Seated Chest Press | Rope Pushdown | Female | 81-130 LBS | Machine | 50 | 80 | 70 | 60 | 50 | Edit | Delete |
| Seated Chest Press | Rope Pushdown | Male | 81-130 LBS | Machine | 50 | 85 | 75 | 65 | 50 | Edit | Delete |
| Seated Chest Press | Rope Pushdown | Male | 131-9999 LBS | Machine | 45 | 85 | 75 | 65 | 50 | Edit | Delete |
| Seated Chest Press | Rope Pushdown | Female | 131-9999 LBS | Machine | 45 | 80 | 70 | 60 | 50 | Edit | Delete |
| Seated Chest Press | Seated Chest Press | Female | 0-9999 LBS | Machine | 100 | 80 | 70 | 60 | 50 | Edit | Delete |
| Seated Chest Press | Seated Chest Press | Male | 0-9999 LBS | Machine | 100 | 85 | 75 | 65 | 50 | Edit | Delete |
| Seated Chest Press | Seated Dip | Female | 0-9999 LBS | Machine | 100 | 80 | 70 | 60 | 50 | Edit | Delete |
| Seated Chest Press | Seated Dip | Male | 0-9999 LBS | Machine | 100 | 85 | 75 | 65 | 50 | Edit | Delete |
| Seated Chest Press | Seated Overhead Extension (1-DB) | Male | 0-13 LBS | Dumbbell | 60 | 85 | 75 | 60 | 50 | Edit | Delete |
| Seated Chest Press | Seated Overhead Extension (1-DB) | Female | 0-13 LBS | Dumbbell | 60 | 80 | 70 | 60 | 50 | Edit | Delete |
| Seated Chest Press | Seated Overhead Extension (1-DB) | female | 14-9999 LBS | Dumbbell | 30 | 80 | 70 | 60 | 50 | Edit | Delete |
| Seated Chest Press | Seated Overhead Extension (1-DB) | Male | 14-9999 LBS | Dumbbell | 35 | 85 | 75 | 60 | 50 | Edit | Delete |
| Seated Chest Press | Seated Tricep Extension | Male | 0-35 LBS | Machine | 95 | 85 | 75 | 60 | 50 | Edit | Delete |
| Seated Chest Press | Seated Tricep Extension | Female | 0-35 LBS | Machine | 95 | 80 | 70 | 60 | 50 | Edit | Delete |

Fig. 7D

| | | | | | | | | | | | |
|---|---|---|---|---|---|---|---|---|---|---|---|
| Seated Chest Press | Pec Fly | Male | 41-50 LBS | Machine | 65 | 85 | 75 | 60 | 50 | Edit | Delete |
| Seated Chest Press | Pec Fly | Female | 41-50 LBS | Machine | 65 | 80 | 70 | 60 | 50 | Edit | Delete |
| Seated Chest Press | Pec Fly | Male | 51-60 LBS | Machine | 60 | 85 | 75 | 60 | 50 | Edit | Delete |
| Seated Chest Press | Pec Fly | Female | 51-60 LBS | Machine | 60 | 80 | 70 | 60 | 50 | Edit | Delete |
| Seated Chest Press | Pec Fly | Male | 61-9999 LBS | Machine | 55 | 85 | 75 | 60 | 50 | Edit | Delete |
| Seated Chest Press | Pec Fly | Female | 61-9999 LBS | Machine | 55 | 80 | 70 | 60 | 50 | Edit | Delete |
| Seated Chest Press | Pec Fly on Bench | Male | 0-9999 LBS | Machine | 40 | 85 | 75 | 65 | 50 | Edit | Delete |
| Seated Chest Press | Pec Fly on Bench | Female | 0-9999 LBS | Machine | 40 | 80 | 70 | 60 | 50 | Edit | Delete |
| Seated Chest Press | Pec Fly on Heels | Male | 0-9999 LBS | Machine | 30 | 85 | 75 | 65 | 50 | Edit | Delete |
| Seated Chest Press | Pec Fly on Heels | Female | 0-9999 LBS | Machine | 30 | 80 | 70 | 60 | 50 | Edit | Delete |
| Seated Chest Press | Pec Fly w/ Alternating Lunge | Male | 0-9999 LBS | Machine | 35 | 85 | 75 | 65 | 50 | Edit | Delete |
| Seated Chest Press | Pec Fly w/ Alternating Lunge | Female | 0-9999 LBS | Machine | 35 | 80 | 70 | 60 | 50 | Edit | Delete |
| Seated Chest Press | Pec Fly w/Static Lunge | Male | 0-9999 LBS | Machine | 35 | 85 | 75 | 65 | 50 | Edit | Delete |
| Seated Chest Press | Pec Fly w/Static Lunge | Female | 0-9999 LBS | Machine | 35 | 80 | 70 | 60 | 50 | Edit | Delete |
| Seated Chest Press | Push Up | Male | 0-9999 LBS | Body Weight | 0 | 85 | 0 | 0 | 0 | Edit | Delete |
| Seated Chest Press | Push Up | Female | 0-9999 LBS | Body Weight | 0 | 80 | 0 | 0 | 0 | Edit | Delete |
| Seated Chest Press | Push Up (Close Hand) | Male | 0-9999 LBS | Body Weight | 0 | 85 | 0 | 0 | 0 | Edit | Delete |
| Seated Chest Press | Push Up (Close Hand) | Female | 0-9999 LBS | Body Weight | 0 | 80 | 0 | 0 | 0 | Edit | Delete |
| Seated Chest Press | Push Up (Wide Hand) | Male | 0-9999 LBS | Body Weight | 0 | 85 | 0 | 0 | 0 | Edit | Delete |
| Seated Chest Press | Push Up (Wide Hand) | Female | 0-9999 LBS | Body Weight | 0 | 80 | 0 | 0 | 0 | Edit | Delete |
| Seated Chest Press | Reverse Grip Pushdown | Male | 0-40 LBS | Machine | 90 | 85 | 75 | 65 | 50 | Edit | Delete |
| Seated Chest Press | Reverse Grip Pushdown | Female | 0-40 LBS | Machine | 90 | 80 | 70 | 60 | 50 | Edit | Delete |
| Seated Chest Press | Reverse Grip Pushdown | Male | 41-50 LBS | Machine | 85 | 85 | 75 | 65 | 50 | Edit | Delete |
| Seated Chest Press | Reverse Grip Pushdown | Female | 41-50 LBS | Machine | 85 | 80 | 70 | 60 | 50 | Edit | Delete |
| Seated Chest Press | Reverse Grip Pushdown | Male | 51-60 LBS | Machine | 75 | 85 | 75 | 65 | 50 | Edit | Delete |
| Seated Chest Press | Reverse Grip Pushdown | Female | 51-60 LBS | Machine | 75 | 80 | 70 | 60 | 50 | Edit | Delete |
| Seated Chest Press | Reverse Grip Pushdown | Male | 61-80 LBS | Machine | 70 | 85 | 75 | 65 | 50 | Edit | Delete |

Fig. 7D Cont.

| | | | | | | | | | | | |
|---|---|---|---|---|---|---|---|---|---|---|---|
| Seated Chest Press | Kick Back w/ Static Backward Lunge | Male | 0-9999 LBS | Machine | 16 | 85 | 75 | 65 | 50 | Edit | Delete |
| Seated Chest Press | Kick Back w/ Static Backward Lunge | Female | 0-9999 LBS | Machine | 16 | 80 | 70 | 60 | 50 | Edit | Delete |
| Seated Chest Press | Low-Pulley Kick Back | Female | 0-9999 LBS | Machine | 10 | 80 | 70 | 60 | 50 | Edit | Delete |
| Seated Chest Press | Low-Pulley Kick Back | Male | 0-9999 LBS | Machine | 10 | 85 | 75 | 65 | 50 | Edit | Delete |
| Seated Chest Press | Lying Chest Press | Male | 0-9999 LBS | Machine | 100 | 85 | 75 | 65 | 50 | Edit | Delete |
| Seated Chest Press | Lying Chest Press | Female | 0-9999 LBS | Machine | 100 | 80 | 70 | 60 | 50 | Edit | Delete |
| Seated Chest Press | Lying Extension | Female | 0-9999 LBS | Barbell | 50 | 80 | 70 | 60 | 50 | Edit | Delete |
| Seated Chest Press | Lying Extension | Male | 0-9999 LBS | Barbell | 50 | 85 | 75 | 65 | 50 | Edit | Delete |
| Seated Chest Press | Lying Extension | Male | 0-9999 LBS | Dumbbell | 40 | 85 | 75 | 60 | 50 | Edit | Delete |
| Seated Chest Press | Lying Extension | Female | 0-9999 LBS | Dumbbell | 40 | 80 | 70 | 60 | 50 | Edit | Delete |
| Seated Chest Press | Overhead Extension | Male | 0-9999 LBS | Machine | 45 | 85 | 75 | 60 | 50 | Edit | Delete |
| Seated Chest Press | Overhead Extension | Female | 0-9999 LBS | Machine | 45 | 80 | 70 | 60 | 50 | Edit | Delete |
| Seated Chest Press | Overhead Extension on Heels | Male | 0-9999 LBS | Machine | 35 | 85 | 75 | 65 | 50 | Edit | Delete |
| Seated Chest Press | Overhead Extension on Heels | Female | 0-9999 LBS | Machine | 35 | 80 | 70 | 60 | 50 | Edit | Delete |
| Seated Chest Press | Overhead Extension w/ Alternating Lunge | Male | 0-9999 LBS | Machine | 30 | 85 | 75 | 65 | 50 | Edit | Delete |
| Seated Chest Press | Overhead Extension w/ Alternating Lunge | Female | 0-9999 LBS | Machine | 30 | 80 | 70 | 60 | 50 | Edit | Delete |
| Seated Chest Press | Overhead Extension w/ Static Lunge | Male | 0-9999 LBS | Machine | 30 | 85 | 75 | 65 | 50 | Edit | Delete |
| Seated Chest Press | Overhead Extension w/ Static Lunge | Female | 0-9999 LBS | Machine | 30 | 80 | 70 | 60 | 50 | Edit | Delete |
| Seated Chest Press | Pec Fly | female | 0-25 LBS | Machine | 80 | 80 | 70 | 60 | 50 | Edit | Delete |
| Seated Chest Press | Pec Fly | Male | 0-25 LBS | Machine | 80 | 85 | 75 | 60 | 50 | Edit | Delete |
| Seated Chest Press | Pec Fly | Female | 26-30 LBS | Machine | 75 | 80 | 70 | 60 | 50 | Edit | Delete |
| Seated Chest Press | Pec Fly | Male | 26-30 LBS | Machine | 75 | 85 | 75 | 60 | 50 | Edit | Delete |
| Seated Chest Press | Pec Fly | Male | 31-40 LBS | Machine | 70 | 85 | 75 | 60 | 50 | Edit | Delete |
| Seated Chest Press | Pec Fly | Female | 31-40 LBS | Machine | 70 | 80 | 70 | 60 | 50 | Edit | Delete |

Fig. 7E

| | | | | | | | | | | | |
|---|---|---|---|---|---|---|---|---|---|---|---|
| Seated Chest Press | Supine Chest Press on Bench | Male | 0-9999 LBS | Machine | 40 | 85 | 75 | 65 | 50 | Edit | Delete |
| Seated Chest Press | Supine Pec Fly on Bench | Male | 0-9999 LBS | Machine | 33 | 85 | 75 | 65 | 50 | Edit | Delete |
| Seated Chest Press | Supine Pec Fly on Bench | Female | 0-9999 LBS | Machine | 33 | 80 | 70 | 60 | 50 | Edit | Delete |
| Seated Chest Press | Tricep Pushdown on Bench | Male | 0-9999 LBS | Machine | 27 | 85 | 75 | 65 | 50 | Edit | Delete |
| Seated Chest Press | Tricep Pushdown on Bench | Female | 0-9999 LBS | Machine | 27 | 80 | 70 | 60 | 50 | Edit | Delete |
| Seated Chest Press | Tricep Pushdown on Heels | Male | 0-9999 LBS | Machine | 27 | 85 | 75 | 65 | 50 | Edit | Delete |
| Seated Chest Press | Tricep Pushdown on Heels | Female | 0-9999 LBS | Machine | 27 | 80 | 70 | 60 | 50 | Edit | Delete |
| Seated Chest Press | Tricep Pushdown w/Backward Alternating Lunge | Male | 0-9999 LBS | Machine | 31 | 85 | 75 | 65 | 50 | Edit | Delete |
| Seated Chest Press | Tricep Pushdown w/Backward Alternating Lunge | Female | 0-9999 LBS | Machine | 31 | 80 | 70 | 60 | 50 | Edit | Delete |
| Seated Chest Press | Tricep Pushdown w/Static Backward Lunge | Male | 0-9999 LBS | Machine | 30 | 85 | 75 | 65 | 50 | Edit | Delete |
| Seated Chest Press | Tricep Pushdown w/Static Backward Lunge | Female | 0-9999 LBS | Machine | 30 | 80 | 70 | 60 | 50 | Edit | Delete |
| Seated Chest Press | V-Bar Pushdown | Male | 0-40 LBS | Machine | 95 | 85 | 75 | 65 | 50 | Edit | Delete |
| Seated Chest Press | V-Bar Pushdown | Female | 0-40 LBS | Machine | 95 | 80 | 70 | 60 | 50 | Edit | Delete |
| Seated Chest Press | V-Bar Pushdown | Male | 41-50 LBS | Machine | 85 | 85 | 75 | 65 | 50 | Edit | Delete |
| Seated Chest Press | V-Bar Pushdown | Female | 41-50 LBS | Machine | 85 | 80 | 70 | 60 | 50 | Edit | Delete |
| Seated Chest Press | V-Bar Pushdown | Male | 51-60 LBS | Machine | 80 | 85 | 75 | 65 | 50 | Edit | Delete |
| Seated Chest Press | V-Bar Pushdown | Female | 51-60 LBS | Machine | 80 | 80 | 70 | 60 | 50 | Edit | Delete |
| Seated Chest Press | V-Bar Pushdown | Male | 61-80 LBS | Machine | 75 | 85 | 75 | 65 | 50 | Edit | Delete |
| Seated Chest Press | V-Bar Pushdown | Female | 61-80 LBS | Machine | 75 | 80 | 70 | 60 | 50 | Edit | Delete |
| Seated Chest Press | V-Bar Pushdown | Female | 81-9999 LBS | Machine | 70 | 80 | 75 | 60 | 50 | Edit | Delete |
| Seated Chest Press | V-Bar Pushdown | Male | 81-9999 LBS | Machine | 70 | 85 | 75 | 65 | 50 | Edit | Delete |
| Seated Chest Press | Wall Push | Male | 0-9999 LBS | Body Weight | 0 | 85 | 0 | 0 | 0 | Edit | Delete |
| Seated Chest Press | Wall Push | Female | 0-9999 LBS | Body Weight | 0 | 80 | 0 | 0 | 0 | Edit | Delete |
| Seated Chest Press | Wall Push (Close Hand) | Male | 0-9999 LBS | Body Weight | 0 | 85 | 0 | 0 | 0 | Edit | Delete |
| Seated Chest Press | Wall Push (Close Hand) | Female | 0-9999 LBS | Body Weight | 0 | 80 | 0 | 0 | 0 | Edit | Delete |
| Seated Chest Press | Wall Push (Wide Hand) | Male | 0-9999 LBS | Body Weight | 0 | 85 | 0 | 0 | 0 | Edit | Delete |

Fig. 7F

| | | | | | | | | | | | |
|---|---|---|---|---|---|---|---|---|---|---|---|
| Seated Chest Press | Wall Push (Wide Hand) | Female | 0-9999 LBS | Body Weight | 0 | 80 | 0 | 0 | 0 | Edit | Delete |
| Seated Chest Press | Wide Chest Press | female | 0-9999 LBS | Machine | 120 | 80 | 70 | 60 | 50 | Edit | Delete |
| Seated Chest Press | Wide Chest Press | Male | 0-9999 LBS | Machine | 120 | 85 | 75 | 65 | 50 | Edit | Delete |
| Wide Grip Pulldown (front) | 1-Arm Curl with Twist | Female | 0-9999 LBS | Machine | 20 | 80 | 70 | 60 | 50 | Edit | Delete |
| Wide Grip Pulldown (front) | 1-Arm Curl with Twist | Male | 0-9999 LBS | Machine | 20 | 85 | 75 | 60 | 50 | Edit | Delete |
| Wide Grip Pulldown (front) | 1-Arm Preacher Curl | Female | 0-9999 LBS | Dumbbell | 20 | 80 | 70 | 60 | 50 | Edit | Delete |
| Wide Grip Pulldown (front) | 1-Arm Preacher Curl | Male | 0-9999 LBS | Dumbbell | 20 | 85 | 75 | 60 | 50 | Edit | Delete |
| Wide Grip Pulldown (front) | 1-Arm Preacher Curl with Twist | Female | 0-9999 LBS | Dumbbell | 20 | 80 | 70 | 60 | 50 | Edit | Delete |
| Wide Grip Pulldown (front) | 1-Arm Preacher Curl with Twist | Male | 0-9999 LBS | Dumbbell | 20 | 85 | 75 | 60 | 50 | Edit | Delete |
| Wide Grip Pulldown (front) | 1-Arm Row | female | 0-9999 LBS | Dumbbell | 35 | 80 | 70 | 60 | 50 | Edit | Delete |
| Wide Grip Pulldown (front) | 1-Arm Row | Male | 0-9999 LBS | Dumbbell | 42 | 85 | 75 | 60 | 50 | Edit | Delete |
| Wide Grip Pulldown (front) | Bent Over Elastic Row | Male | 0-9999 LBS | Body Weight | 0 | 85 | 0 | 0 | 0 | Edit | Delete |
| Wide Grip Pulldown (front) | Bent Over Elastic Row | Female | 0-9999 LBS | Body Weight | 0 | 80 | 0 | 0 | 0 | Edit | Delete |
| Wide Grip Pulldown (front) | Body Bar Curl | Male | 0-9999 LBS | Body Weight | 0 | 0 | 0 | 0 | 0 | Edit | Delete |
| Wide Grip Pulldown (front) | Body Bar Curl | Female | 0-9999 LBS | Body Weight | 0 | 0 | 0 | 0 | 0 | Edit | Delete |
| Wide Grip Pulldown (front) | Close Grip Pulldown (front) | Female | 0-9999 LBS | Machine | 100 | 80 | 70 | 60 | 50 | Edit | Delete |
| Wide Grip Pulldown (front) | Close Grip Pulldown (front) | Male | 0-9999 LBS | Machine | 100 | 85 | 75 | 60 | 50 | Edit | Delete |
| Wide Grip Pulldown (front) | Concentration Curl with Twist | Male | 0-25 LBS | Dumbbell | 30 | 85 | 75 | 60 | 50 | Edit | Delete |
| Wide Grip Pulldown (front) | Concentration Curl with Twist | Female | 0-25 LBS | Dumbbell | 30 | 80 | 70 | 60 | 50 | Edit | Delete |
| Wide Grip Pulldown (front) | Concentration Curl with Twist | female | 26-9999 LBS | Dumbbell | 20 | 80 | 70 | 60 | 50 | Edit | Delete |

Fig. 7F Cont.

| | | | | | | | | | | | |
|---|---|---|---|---|---|---|---|---|---|---|---|
| Wide Grip Pulldown (front) | Elastic Curl with Twist | Male | 0-9999 LBS | Body Weight | 0 | 85 | 0 | 0 | 0 | Edit | Delete |
| Wide Grip Pulldown (front) | Elastic Curl with Twist | Female | 0-9999 LBS | Body Weight | 0 | 80 | 0 | 0 | 0 | Edit | Delete |
| Wide Grip Pulldown (front) | Herculean Cable Curl | Female | 0-9999 LBS | Machine | 25 | 80 | 70 | 60 | 50 | Edit | Delete |
| Wide Grip Pulldown (front) | Herculean Cable Curl | Male | 0-9999 LBS | Machine | 30 | 85 | 75 | 60 | 50 | Edit | Delete |
| Wide Grip Pulldown (front) | High Row | female | 0-9999 LBS | Machine | 125 | 80 | 70 | 60 | 50 | Edit | Delete |
| Wide Grip Pulldown (front) | High Row | Male | 0-9999 LBS | Machine | 125 | 85 | 75 | 60 | 50 | Edit | Delete |
| Wide Grip Pulldown (front) | High Row on Bench | Male | 0-9999 LBS | Machine | 52 | 85 | 75 | 65 | 50 | Edit | Delete |
| Wide Grip Pulldown (front) | High Row on Bench | Female | 0-9999 LBS | Machine | 52 | 80 | 70 | 60 | 50 | Edit | Delete |
| Wide Grip Pulldown (front) | High Row on Heels | Male | 0-9999 LBS | Machine | 43 | 85 | 75 | 65 | 50 | Edit | Delete |
| Wide Grip Pulldown (front) | High Row on Heels | Female | 0-9999 LBS | Machine | 43 | 80 | 70 | 60 | 50 | Edit | Delete |
| Wide Grip Pulldown (front) | High Row w/ Backward Alternating Lunge | Male | 0-9999 LBS | Machine | 52 | 85 | 75 | 65 | 50 | Edit | Delete |
| Wide Grip Pulldown (front) | High Row w/ Backward Alternating Lunge | Female | 0-9999 LBS | Machine | 52 | 80 | 70 | 60 | 50 | Edit | Delete |
| Wide Grip Pulldown (front) | High Row w/ Static Backward Lunge | Male | 0-9999 LBS | Machine | 50 | 85 | 75 | 65 | 50 | Edit | Delete |
| Wide Grip Pulldown (front) | High Row w/ Static Backward Lunge | Female | 0-9999 LBS | Machine | 50 | 80 | 70 | 60 | 50 | Edit | Delete |
| Wide Grip Pulldown (front) | Incline Curl on Bench | Male | 0-9999 LBS | Machine | 23 | 85 | 75 | 65 | 50 | Edit | Delete |
| Wide Grip Pulldown (front) | Incline Curl on Bench | Female | 0-9999 LBS | Machine | 23 | 80 | 70 | 60 | 50 | Edit | Delete |
| Wide Grip Pulldown (front) | Incline Curl with Twist | Female | 0-9999 LBS | Dumbbell | 20 | 80 | 70 | 60 | 50 | Edit | Delete |
| Wide Grip Pulldown (front) | Incline Curl with Twist | Male | 0-9999 LBS | Dumbbell | 20 | 85 | 75 | 60 | 50 | Edit | Delete |
| Wide Grip Pulldown (front) | Lat Pulldown (Behind the Neck) | Male | 0-9999 LBS | Machine | 100 | 85 | 75 | 60 | 50 | Edit | Delete |

Fig. 7G

| | | | | | | | | | | | |
|---|---|---|---|---|---|---|---|---|---|---|---|
| Wide Grip Pulldown (front) | Pullover | female | 0-60 LBS | Dumbbell | 25 | 80 | 70 | 60 | 50 | Edit | Delete |
| Wide Grip Pulldown (front) | Pullover | Male | 0-60 LBS | Dumbbell | 35 | 85 | 75 | 60 | 50 | Edit | Delete |
| Wide Grip Pulldown (front) | Pullover | female | 61-95 LBS | Dumbbell | 27 | 80 | 70 | 60 | 50 | Edit | Delete |
| Wide Grip Pulldown (front) | Pullover | Male | 61-95 LBS | Dumbbell | 38 | 85 | 75 | 60 | 50 | Edit | Delete |
| Wide Grip Pulldown (front) | Pullover | female | 96-9999 LBS | Dumbbell | 35 | 80 | 70 | 60 | 50 | Edit | Delete |
| Wide Grip Pulldown (front) | Pullover | Male | 96-9999 LBS | Dumbbell | 40 | 85 | 75 | 60 | 50 | Edit | Delete |
| Wide Grip Pulldown (front) | Pullover on Bench | Male | 0-9999 LBS | Machine | 60 | 85 | 75 | 65 | 50 | Edit | Delete |
| Wide Grip Pulldown (front) | Pullover on Bench | Female | 0-9999 LBS | Machine | 60 | 80 | 70 | 60 | 50 | Edit | Delete |
| Wide Grip Pulldown (front) | Pull-Up | Male | 0-9999 LBS | Body Weight | 0 | 0 | 0 | 0 | 0 | Edit | Delete |
| Wide Grip Pulldown (front) | Pull-Up | Female | 0-9999 LBS | Body Weight | 0 | 0 | 0 | 0 | 0 | Edit | Delete |
| Wide Grip Pulldown (front) | Reverse Grip High Row | Male | 0-9999 LBS | Machine | 125 | 85 | 75 | 65 | 50 | Edit | Delete |
| Wide Grip Pulldown (front) | Reverse Grip High Row | Female | 0-9999 LBS | Machine | 125 | 80 | 70 | 60 | 50 | Edit | Delete |
| Wide Grip Pulldown (front) | Row on Bench (facing) | Male | 0-9999 LBS | Machine | 70 | 85 | 75 | 65 | 50 | Edit | Delete |
| Wide Grip Pulldown (front) | Row on Bench (facing) | Female | 0-9999 LBS | Machine | 70 | 80 | 70 | 60 | 50 | Edit | Delete |
| Wide Grip Pulldown (front) | Row on Heels | Male | 0-9999 LBS | Machine | 50 | 85 | 75 | 65 | 50 | Edit | Delete |
| Wide Grip Pulldown (front) | Row on Heels | Female | 0-9999 LBS | Machine | 50 | 80 | 70 | 60 | 50 | Edit | Delete |
| Wide Grip Pulldown (front) | Row w/Backward Alternating Lunge | Male | 0-9999 LBS | Machine | 60 | 85 | 75 | 65 | 50 | Edit | Delete |
| Wide Grip Pulldown (front) | Row w/Backward Alternating Lunge | Female | 0-9999 LBS | Machine | 60 | 80 | 70 | 60 | 50 | Edit | Delete |
| Wide Grip Pulldown (front) | Row w/Static Backward Lunge | Male | 0-9999 LBS | Machine | 60 | 85 | 75 | 65 | 50 | Edit | Delete |

Fig. 7G Cont.

| | | | | | | | | | | | |
|---|---|---|---|---|---|---|---|---|---|---|---|
| Wide Grip Pulldown (front) | Row w/Static Backward Lunge | Female | 0-9999 LBS | Machine | 60 | 80 | 70 | 60 | 50 | Edit | Delete |
| Wide Grip Pulldown (front) | Seated Arm Curl | Male | 0-40 LBS | Machine | 67 | 85 | 75 | 60 | 50 | Edit | Delete |
| Wide Grip Pulldown (front) | Seated Arm Curl | Female | 0-40 LBS | Machine | 67 | 80 | 70 | 60 | 50 | Edit | Delete |
| Wide Grip Pulldown (front) | Seated Arm Curl | Male | 41-60 LBS | Machine | 61 | 85 | 75 | 60 | 50 | Edit | Delete |
| Wide Grip Pulldown (front) | Seated Arm Curl | Female | 41-60 LBS | Machine | 61 | 80 | 70 | 60 | 50 | Edit | Delete |
| Wide Grip Pulldown (front) | Seated Arm Curl | Male | 61-9999 LBS | Machine | 50 | 85 | 75 | 60 | 50 | Edit | Delete |
| Wide Grip Pulldown (front) | Seated Arm Curl | Female | 61-9999 LBS | Machine | 50 | 80 | 70 | 60 | 50 | Edit | Delete |
| Wide Grip Pulldown (front) | Seated Curl on Bench | Male | 0-9999 LBS | Machine | 25 | 85 | 75 | 65 | 50 | Edit | Delete |
| Wide Grip Pulldown (front) | Seated Curl on Bench | Female | 0-9999 LBS | Machine | 25 | 80 | 70 | 60 | 50 | Edit | Delete |
| Wide Grip Pulldown (front) | Seated Pullover | female | 0-9999 LBS | Machine | 115 | 80 | 70 | 60 | 50 | Edit | Delete |
| Wide Grip Pulldown (front) | Seated Pullover | Male | 0-9999 LBS | Machine | 115 | 85 | 75 | 60 | 50 | Edit | Delete |
| Wide Grip Pulldown (front) | Seated Row | Female | 0-9999 LBS | Machine | 100 | 80 | 70 | 60 | 50 | Edit | Delete |
| Wide Grip Pulldown (front) | Seated Row | Male | 0-9999 LBS | Machine | 100 | 85 | 75 | 60 | 50 | Edit | Delete |
| Wide Grip Pulldown (front) | Seated Row on Bench | Male | 0-9999 LBS | Machine | 68 | 85 | 75 | 65 | 50 | Edit | Delete |
| Wide Grip Pulldown (front) | Seated Row on Bench | Female | 0-9999 LBS | Machine | 68 | 80 | 70 | 60 | 50 | Edit | Delete |
| Wide Grip Pulldown (front) | Sit Down Row | female | 0-9999 LBS | Machine | 90 | 80 | 70 | 60 | 50 | Edit | Delete |
| Wide Grip Pulldown (front) | Sit Down Row | Male | 0-9999 LBS | Machine | 100 | 85 | 75 | 60 | 50 | Edit | Delete |
| Wide Grip Pulldown (front) | Standing Curl | Male | 0-25 LBS | Dumbbell | 30 | 85 | 75 | 60 | 50 | Edit | Delete |
| Wide Grip Pulldown (front) | Standing Curl | Female | 0-25 LBS | Dumbbell | 30 | 80 | 70 | 60 | 50 | Edit | Delete |

Fig. 7I

| | | | | | | | | | | | |
|---|---|---|---|---|---|---|---|---|---|---|---|
| Reference Leg Press | Adductor | female | 281-340 LBS | Machine | 43 | 80 | 80 | 70 | 60 | Edit | Delete |
| Reference Leg Press | Adductor | Male | 281-340 LBS | Machine | 43 | 85 | 80 | 70 | 60 | Edit | Delete |
| Reference Leg Press | Adductor | female | 341-450 LBS | Machine | 38 | 80 | 80 | 70 | 60 | Edit | Delete |
| Reference Leg Press | Adductor | Male | 341-450 LBS | Machine | 38 | 85 | 80 | 70 | 60 | Edit | Delete |
| Reference Leg Press | Adductor | male | 451-550 LBS | Machine | 36 | 85 | 80 | 70 | 60 | Edit | Delete |
| Reference Leg Press | Adductor | Female | 451-550 LBS | Machine | 36 | 80 | 80 | 70 | 60 | Edit | Delete |
| Reference Leg Press | Adductor | Male | 551-600 LBS | Machine | 30 | 85 | 80 | 70 | 60 | Edit | Delete |
| Reference Leg Press | Adductor | Female | 551-600 LBS | Machine | 30 | 80 | 80 | 70 | 60 | Edit | Delete |
| Reference Leg Press | Adductor | female | 601-800 LBS | Machine | 25 | 80 | 80 | 70 | 60 | Edit | Delete |
| Reference Leg Press | Adductor | Male | 601-800 LBS | Machine | 25 | 85 | 80 | 70 | 60 | Edit | Delete |
| Reference Leg Press | Adductor | Male | 801-9999 LBS | Machine | 22 | 85 | 80 | 70 | 60 | Edit | Delete |
| Reference Leg Press | Adductor | Female | 801-9999 LBS | Machine | 22 | 80 | 80 | 70 | 60 | Edit | Delete |
| Reference Leg Press | Alternating Lunge | Male | 0-9999 LBS | Machine | 20 | 85 | 75 | 65 | 50 | Edit | Delete |
| Reference Leg Press | Alternating Lunge | Female | 0-9999 LBS | Machine | 20 | 80 | 70 | 60 | 50 | Edit | Delete |
| Reference Leg Press | Angled Calf Raise | male | 0-120 LBS | Machine | 63 | 85 | 75 | 60 | 50 | Edit | Delete |
| Reference Leg Press | Angled Calf Raise | Female | 0-120 LBS | Machine | 63 | 80 | 70 | 60 | 50 | Edit | Delete |
| Reference Leg Press | Angled Calf Raise | female | 121-180 LBS | Machine | 56 | 80 | 70 | 60 | 50 | Edit | Delete |
| Reference Leg Press | Angled Calf Raise | Male | 121-180 LBS | Machine | 56 | 85 | 75 | 60 | 50 | Edit | Delete |
| Reference Leg Press | Angled Calf Raise | Female | 181-500 LBS | Machine | 53 | 80 | 70 | 60 | 50 | Edit | Delete |
| Reference Leg Press | Angled Calf Raise | Male | 181-500 LBS | Machine | 53 | 85 | 75 | 60 | 50 | Edit | Delete |
| Reference Leg Press | Angled Calf Raise | Male | 501-800 LBS | Machine | 47 | 85 | 75 | 60 | 50 | Edit | Delete |
| Reference Leg Press | Angled Calf Raise | Female | 501-800 LBS | Machine | 47 | 80 | 70 | 60 | 50 | Edit | Delete |
| Reference Leg Press | Angled Calf Raise | Female | 801-9999 LBS | Machine | 41 | 80 | 70 | 60 | 50 | Edit | Delete |
| Reference Leg Press | Angled Calf Raise | Male | 801-9999 LBS | Machine | 41 | 85 | 75 | 60 | 50 | Edit | Delete |
| Reference Leg Press | Backward Lunge | Male | 0-9999 LBS | Body Weight | 0 | 85 | 0 | 0 | 0 | Edit | Delete |
| Reference Leg Press | Backward Lunge | Female | 0-9999 LBS | Body Weight | 0 | 80 | 0 | 0 | 0 | Edit | Delete |
| Reference Leg Press | Barbell Squat | Female | 0-500 LBS | Barbell | 45 | 80 | 70 | 60 | 50 | Edit | Delete |

Fig. 7J

| | | | | | | | | | | | |
|---|---|---|---|---|---|---|---|---|---|---|---|
| Reference Leg Press | Barbell Squat | Male | 0-500 LBS | Barbell | 45 | 85 | 75 | 60 | 50 | Edit | Delete |
| Reference Leg Press | Barbell Squat | Male | 501-600 LBS | Barbell | 42 | 85 | 75 | 60 | 50 | Edit | Delete |
| Reference Leg Press | Barbell Squat | Female | 501-600 LBS | Barbell | 42 | 80 | 70 | 60 | 50 | Edit | Delete |
| Reference Leg Press | Barbell Squat | Male | 601-800 LBS | Barbell | 37 | 85 | 75 | 60 | 50 | Edit | Delete |
| Reference Leg Press | Barbell Squat | Female | 601-800 LBS | Barbell | 37 | 80 | 70 | 60 | 50 | Edit | Delete |
| Reference Leg Press | Barbell Squat | Male | 801-9999 LBS | Barbell | 33 | 85 | 75 | 60 | 50 | Edit | Delete |
| Reference Leg Press | Barbell Squat | Female | 801-9999 LBS | Barbell | 33 | 80 | 70 | 60 | 50 | Edit | Delete |
| Reference Leg Press | Bench Leg Up | Male | 0-0 LBS | Body Weight | 0 | 0 | 0 | 0 | 0 | Edit | Delete |
| Reference Leg Press | Bench Leg Up | Female | 0-0 LBS | Body Weight | 0 | 0 | 0 | 0 | 0 | Edit | Delete |
| Reference Leg Press | Beta Lunge | Male | 0-9999 LBS | Machine | 20 | 85 | 75 | 65 | 50 | Edit | Delete |
| Reference Leg Press | Beta Lunge | Female | 0-9999 LBS | Machine | 20 | 80 | 70 | 60 | 50 | Edit | Delete |
| Reference Leg Press | Beta Squat | Male | 0-9999 LBS | Machine | 28 | 85 | 75 | 65 | 50 | Edit | Delete |
| Reference Leg Press | Beta Squat | Female | 0-9999 LBS | Machine | 28 | 80 | 70 | 60 | 50 | Edit | Delete |
| Reference Leg Press | Body Squat | Male | 0-9999 LBS | Body Weight | 0 | 85 | 0 | 0 | 0 | Edit | Delete |
| Reference Leg Press | Body Squat | Female | 0-9999 LBS | Body Weight | 0 | 80 | 0 | 0 | 0 | Edit | Delete |
| Reference Leg Press | Butt Blaster | Female | 0-55 LBS | Machine | 41 | 80 | 70 | 60 | 50 | Edit | Delete |
| Reference Leg Press | Butt Blaster | Male | 0-55 LBS | Machine | 50 | 85 | 75 | 60 | 50 | Edit | Delete |
| Reference Leg Press | Butt Blaster | Female | 56-135 LBS | Machine | 25 | 80 | 70 | 60 | 50 | Edit | Delete |
| Reference Leg Press | Butt Blaster | Male | 56-135 LBS | Machine | 35 | 85 | 75 | 60 | 50 | Edit | Delete |
| Reference Leg Press | Butt Blaster | female | 136-250 LBS | Machine | 18 | 80 | 70 | 60 | 50 | Edit | Delete |
| Reference Leg Press | Butt Blaster | Male | 136-250 LBS | Machine | 27 | 85 | 75 | 60 | 50 | Edit | Delete |
| Reference Leg Press | Butt Blaster | male | 251-308 LBS | Machine | 22 | 85 | 75 | 60 | 50 | Edit | Delete |
| Reference Leg Press | Butt Blaster | Female | 251-308 LBS | Machine | 16 | 80 | 70 | 60 | 50 | Edit | Delete |
| Reference Leg Press | Butt Blaster | Female | 309-372 LBS | Machine | 15 | 80 | 70 | 60 | 50 | Edit | Delete |
| Reference Leg Press | Butt Blaster | Male | 309-372 LBS | Machine | 18 | 85 | 75 | 60 | 50 | Edit | Delete |
| Reference Leg Press | Butt Blaster | Female | 373-468 LBS | Machine | 13 | 80 | 70 | 60 | 50 | Edit | Delete |
| Reference Leg Press | Butt Blaster | Male | 373-468 LBS | Machine | 15 | 85 | 75 | 60 | 50 | Edit | Delete |

Fig. 7K

| | | | | | | | | | | | |
|---|---|---|---|---|---|---|---|---|---|---|---|
| Reference Leg Press | Butt Blaster | Female | 469-570 LBS | Machine | 12 | 80 | 70 | 60 | 50 | Edit | Delete |
| Reference Leg Press | Butt Blaster | Male | 469-570 LBS | Machine | 13 | 85 | 75 | 60 | 50 | Edit | Delete |
| Reference Leg Press | Butt Blaster | female | 571-800 LBS | Machine | 11 | 80 | 70 | 60 | 50 | Edit | Delete |
| Reference Leg Press | Butt Blaster | Male | 571-800 LBS | Machine | 12 | 85 | 75 | 60 | 50 | Edit | Delete |
| Reference Leg Press | Butt Blaster | Female | 801-9999 LBS | Machine | 8 | 80 | 70 | 60 | 50 | Edit | Delete |
| Reference Leg Press | Butt Blaster | Male | 801-9999 LBS | Machine | 10 | 85 | 75 | 60 | 50 | Edit | Delete |
| Reference Leg Press | Calf Raise | male | 0-120 LBS | Machine | 63 | 85 | 75 | 60 | 50 | Edit | Delete |
| Reference Leg Press | Calf Raise | Female | 0-120 LBS | Machine | 63 | 80 | 70 | 60 | 50 | Edit | Delete |
| Reference Leg Press | Calf Raise | Female | 121-180 LBS | Machine | 56 | 80 | 70 | 60 | 50 | Edit | Delete |
| Reference Leg Press | Calf Raise | Male | 121-180 LBS | Machine | 56 | 85 | 75 | 60 | 50 | Edit | Delete |
| Reference Leg Press | Calf Raise | Female | 181-500 LBS | Machine | 53 | 80 | 70 | 60 | 50 | Edit | Delete |
| Reference Leg Press | Calf Raise | Male | 181-500 LBS | Machine | 53 | 85 | 75 | 60 | 50 | Edit | Delete |
| Reference Leg Press | Calf Raise | Male | 501-800 LBS | Machine | 47 | 85 | 75 | 60 | 50 | Edit | Delete |
| Reference Leg Press | Calf Raise | Female | 501-800 LBS | Machine | 47 | 80 | 70 | 60 | 50 | Edit | Delete |
| Reference Leg Press | Calf Raise | Male | 801-9999 LBS | Machine | 41 | 85 | 75 | 60 | 50 | Edit | Delete |
| Reference Leg Press | Calf Raise | Female | 801-9999 LBS | Machine | 41 | 80 | 70 | 60 | 50 | Edit | Delete |
| Reference Leg Press | Close Stance Sissy Squat (on Toes) | Male | 0-9999 LBS | Body Weight | 0 | 85 | 0 | 0 | 0 | Edit | Delete |
| Reference Leg Press | Close Stance Sissy Squat (on Toes) | Female | 0-9999 LBS | Body Weight | 0 | 80 | 0 | 0 | 0 | Edit | Delete |
| Reference Leg Press | Donkey Calf Raise | Male | 0-120 LBS | Machine | 63 | 85 | 75 | 60 | 50 | Edit | Delete |
| Reference Leg Press | Donkey Calf Raise | Female | 0-120 LBS | Machine | 63 | 80 | 70 | 60 | 50 | Edit | Delete |
| Reference Leg Press | Donkey Calf Raise | Male | 121-180 LBS | Machine | 56 | 85 | 75 | 60 | 50 | Edit | Delete |
| Reference Leg Press | Donkey Calf Raise | Female | 121-180 LBS | Machine | 56 | 80 | 70 | 60 | 50 | Edit | Delete |
| Reference Leg Press | Donkey Calf Raise | female | 181-500 LBS | Machine | 53 | 80 | 70 | 60 | 50 | Edit | Delete |
| Reference Leg Press | Donkey Calf Raise | Male | 181-500 LBS | Machine | 53 | 85 | 75 | 60 | 50 | Edit | Delete |
| Reference Leg Press | Donkey Calf Raise | Male | 501-800 LBS | Machine | 47 | 85 | 75 | 60 | 50 | Edit | Delete |
| Reference Leg Press | Donkey Calf Raise | Female | 501-800 LBS | Machine | 47 | 80 | 70 | 60 | 50 | Edit | Delete |
| Reference Leg Press | Donkey Calf Raise | Male | 801-9999 LBS | Machine | 41 | 85 | 75 | 60 | 50 | Edit | Delete |

Fig. 7K Cont.

| | | | | | | | | | | | |
|---|---|---|---|---|---|---|---|---|---|---|---|
| Reference Leg Press | Donkey Calf Raise | Female | 801-9999 LBS | Machine | 41 | 80 | 70 | 60 | 50 | Edit | Delete |
| Reference Leg Press | Dumbbell Bench Lunge | Male | 0-60 LBS | Dumbbell | 20 | 85 | 75 | 60 | 50 | Edit | Delete |
| Reference Leg Press | Dumbbell Bench Lunge | Female | 0-60 LBS | Dumbbell | 20 | 80 | 70 | 60 | 50 | Edit | Delete |
| Reference Leg Press | Dumbbell Bench Lunge | Male | 61-80 LBS | Dumbbell | 15 | 85 | 75 | 60 | 50 | Edit | Delete |
| Reference Leg Press | Dumbbell Bench Lunge | Female | 61-80 LBS | Dumbbell | 15 | 80 | 70 | 60 | 50 | Edit | Delete |
| Reference Leg Press | Dumbbell Bench Lunge | female | 81-500 LBS | Dumbbell | 10 | 80 | 70 | 60 | 50 | Edit | Delete |
| Reference Leg Press | Dumbbell Bench Lunge | Male | 81-500 LBS | Dumbbell | 10 | 85 | 75 | 60 | 50 | Edit | Delete |
| Reference Leg Press | Dumbbell Bench Lunge | Male | 501-9999 LBS | Dumbbell | 8 | 85 | 75 | 60 | 50 | Edit | Delete |
| Reference Leg Press | Dumbbell Bench Lunge | Female | 501-9999 LBS | Dumbbell | 8 | 80 | 70 | 60 | 50 | Edit | Delete |
| Reference Leg Press | Dumbbell Sissy Squat | female | 0-400 LBS | Dumbbell | 8 | 80 | 70 | 60 | 50 | Edit | Delete |
| Reference Leg Press | Dumbbell Sissy Squat | Male | 0-400 LBS | Dumbbell | 8 | 85 | 75 | 60 | 50 | Edit | Delete |
| Reference Leg Press | Dumbbell Sissy Squat | male | 401-600 LBS | Dumbbell | 6 | 85 | 75 | 60 | 50 | Edit | Delete |
| Reference Leg Press | Dumbbell Sissy Squat | Female | 401-600 LBS | Dumbbell | 6 | 80 | 70 | 60 | 50 | Edit | Delete |
| Reference Leg Press | Dumbbell Sissy Squat | female | 601-9999 LBS | Dumbbell | 4 | 80 | 70 | 60 | 50 | Edit | Delete |
| Reference Leg Press | Dumbbell Sissy Squat | Male | 601-9999 LBS | Dumbbell | 4 | 85 | 75 | 60 | 50 | Edit | Delete |
| Reference Leg Press | Dumbbell Squat (2 Dumbbells) | female | 0-400 LBS | Dumbbell | 15 | 80 | 70 | 60 | 50 | Edit | Delete |
| Reference Leg Press | Dumbbell Squat (2 Dumbbells) | Male | 0-400 LBS | Dumbbell | 15 | 85 | 75 | 60 | 50 | Edit | Delete |
| Reference Leg Press | Dumbbell Squat (2 Dumbbells) | Male | 451-600 LBS | Dumbbell | 12 | 85 | 75 | 60 | 50 | Edit | Delete |
| Reference Leg Press | Dumbbell Squat (2 Dumbbells) | Female | 451-600 LBS | Dumbbell | 12 | 80 | 70 | 60 | 50 | Edit | Delete |
| Reference Leg Press | Dumbbell Squat (2 Dumbbells) | Male | 601-800 LBS | Dumbbell | 10 | 85 | 75 | 60 | 50 | Edit | Delete |
| Reference Leg Press | Dumbbell Squat (2 Dumbbells) | Female | 601-800 LBS | Dumbbell | 10 | 80 | 70 | 60 | 50 | Edit | Delete |
| Reference Leg Press | Dumbbell Squat (2 Dumbbells) | Male | 801-9999 LBS | Dumbbell | 8 | 85 | 75 | 60 | 50 | Edit | Delete |
| Reference Leg Press | Dumbbell Squat (2 Dumbbells) | Female | 801-9999 LBS | Dumbbell | 8 | 80 | 70 | 60 | 50 | Edit | Delete |
| Reference Leg Press | Elastic Squat | Male | 0-9999 LBS | Body Weight | 0 | 0 | 0 | 0 | 0 | Edit | Delete |
| Reference Leg Press | Elastic Squat | Female | 0-9999 LBS | Body Weight | 0 | 0 | 0 | 0 | 0 | Edit | Delete |
| Reference Leg Press | Fast Walk | Male | 0-999 LBS | Body Weight | 0 | 0 | 0 | 0 | 0 | Edit | Delete |
| Reference Leg Press | Fast Walk | Female | 0-999 LBS | Body Weight | 0 | 0 | 0 | 0 | 0 | Edit | Delete |

Fig. 7K Cont.

| | | | | | | | | | | | |
|---|---|---|---|---|---|---|---|---|---|---|---|
| Reference Leg Press | Forward Step Up | Male | 0-9999 LBS | Machine | 20 | 85 | 75 | 60 | 50 | Edit | Delete |
| Reference Leg Press | Forward Step Up | Female | 0-9999 LBS | Machine | 20 | 80 | 70 | 60 | 50 | Edit | Delete |
| Reference Leg Press | Free Motion Squat | Male | 0-9999 LBS | Machine | 45 | 85 | 75 | 60 | 50 | Edit | Delete |
| Reference Leg Press | Free Motion Squat | Female | 0-9999 LBS | Machine | 45 | 80 | 70 | 60 | 50 | Edit | Delete |
| Reference Leg Press | Front Barbell Squat | female | 0-450 LBS | Barbell | 15 | 80 | 70 | 60 | 50 | Edit | Delete |
| Reference Leg Press | Front Barbell Squat | Male | 0-450 LBS | Barbell | 20 | 85 | 75 | 60 | 50 | Edit | Delete |
| Reference Leg Press | Front Barbell Squat | Male | 451-600 LBS | Barbell | 18 | 85 | 75 | 60 | 50 | Edit | Delete |
| Reference Leg Press | Front Barbell Squat | Female | 451-600 LBS | Barbell | 13 | 80 | 70 | 60 | 50 | Edit | Delete |
| Reference Leg Press | Front Barbell Squat | Male | 601-800 LBS | Barbell | 15 | 85 | 75 | 60 | 50 | Edit | Delete |
| Reference Leg Press | Front Barbell Squat | Female | 601-800 LBS | Barbell | 10 | 80 | 70 | 60 | 50 | Edit | Delete |
| Reference Leg Press | Front Barbell Squat | Male | 801-9999 LBS | Barbell | 13 | 85 | 75 | 60 | 50 | Edit | Delete |
| Reference Leg Press | Front Barbell Squat | Female | 801-9999 LBS | Barbell | 7 | 80 | 70 | 60 | 50 | Edit | Delete |
| Reference Leg Press | Front Squat | female | 0-450 LBS | Machine | 20 | 80 | 70 | 60 | 50 | Edit | Delete |
| Reference Leg Press | Front Squat | Male | 0-450 LBS | Machine | 25 | 85 | 75 | 60 | 50 | Edit | Delete |
| Reference Leg Press | Front Squat | Female | 451-600 LBS | Machine | 17 | 80 | 70 | 60 | 50 | Edit | Delete |
| Reference Leg Press | Front Squat | Male | 451-600 LBS | Machine | 22 | 85 | 75 | 60 | 50 | Edit | Delete |
| Reference Leg Press | Front Squat | female | 601-800 LBS | Machine | 13 | 80 | 70 | 60 | 50 | Edit | Delete |
| Reference Leg Press | Front Squat | Male | 601-800 LBS | Machine | 19 | 85 | 75 | 60 | 50 | Edit | Delete |
| Reference Leg Press | Front Squat | Male | 801-9999 LBS | Machine | 17 | 85 | 75 | 60 | 50 | Edit | Delete |
| Reference Leg Press | Front Squat | Female | 801-9999 LBS | Machine | 10 | 80 | 70 | 60 | 50 | Edit | Delete |
| Reference Leg Press | Glute Machine | female | 0-55 LBS | Machine | 41 | 80 | 70 | 60 | 50 | Edit | Delete |
| Reference Leg Press | Glute Machine | Male | 0-55 LBS | Machine | 50 | 85 | 75 | 60 | 50 | Edit | Delete |
| Reference Leg Press | Glute Machine | female | 56-135 LBS | Machine | 25 | 80 | 70 | 60 | 50 | Edit | Delete |
| Reference Leg Press | Glute Machine | Male | 56-135 LBS | Machine | 35 | 85 | 75 | 60 | 50 | Edit | Delete |
| Reference Leg Press | Glute Machine | female | 136-250 LBS | Machine | 18 | 80 | 70 | 60 | 50 | Edit | Delete |
| Reference Leg Press | Glute Machine | Male | 136-250 LBS | Machine | 27 | 85 | 75 | 60 | 50 | Edit | Delete |
| Reference Leg Press | Glute Machine | female | 251-308 LBS | Machine | 16 | 80 | 70 | 60 | 50 | Edit | Delete |

Fig. 7L

| | | | | | | | | | | | |
|---|---|---|---|---|---|---|---|---|---|---|---|
| Reference Leg Press | Glute Machine | Male | 251-308 LBS | Machine | 23 | 85 | 75 | 60 | 50 | Edit | Delete |
| Reference Leg Press | Glute Machine | female | 309-372 LBS | Machine | 15 | 80 | 70 | 60 | 50 | Edit | Delete |
| Reference Leg Press | Glute Machine | Male | 309-372 LBS | Machine | 18 | 85 | 75 | 60 | 50 | Edit | Delete |
| Reference Leg Press | Glute Machine | female | 373-468 LBS | Machine | 13 | 80 | 70 | 60 | 50 | Edit | Delete |
| Reference Leg Press | Glute Machine | Male | 373-468 LBS | Machine | 15 | 85 | 75 | 60 | 50 | Edit | Delete |
| Reference Leg Press | Glute Machine | female | 469-570 LBS | Machine | 12 | 80 | 70 | 60 | 50 | Edit | Delete |
| Reference Leg Press | Glute Machine | Male | 469-570 LBS | Machine | 13 | 85 | 75 | 60 | 50 | Edit | Delete |
| Reference Leg Press | Glute Machine | Female | 571-9999 LBS | Machine | 11 | 80 | 70 | 60 | 50 | Edit | Delete |
| Reference Leg Press | Glute Machine | Male | 571-9999 LBS | Machine | 12 | 85 | 75 | 60 | 50 | Edit | Delete |
| Reference Leg Press | Hack Squat | Male | 0-100 LBS | Machine | 25 | 85 | 75 | 60 | 50 | Edit | Delete |
| Reference Leg Press | Hack Squat | Female | 0-100 LBS | Machine | 20 | 80 | 70 | 60 | 50 | Edit | Delete |
| Reference Leg Press | Hack Squat | Female | 101-200 LBS | Machine | 25 | 80 | 70 | 60 | 50 | Edit | Delete |
| Reference Leg Press | Hack Squat | Male | 101-200 LBS | Machine | 30 | 85 | 75 | 60 | 50 | Edit | Delete |
| Reference Leg Press | Hack Squat | Male | 201-300 LBS | Machine | 33 | 85 | 75 | 60 | 50 | Edit | Delete |
| Reference Leg Press | Hack Squat | Female | 201-300 LBS | Machine | 28 | 80 | 70 | 60 | 50 | Edit | Delete |
| Reference Leg Press | Hack Squat | female | 301-500 LBS | Machine | 30 | 80 | 70 | 60 | 50 | Edit | Delete |
| Reference Leg Press | Hack Squat | Male | 301-500 LBS | Machine | 35 | 85 | 75 | 60 | 50 | Edit | Delete |
| Reference Leg Press | Hack Squat | Male | 501-600 LBS | Machine | 33 | 85 | 75 | 60 | 50 | Edit | Delete |
| Reference Leg Press | Hack Squat | Female | 501-600 LBS | Machine | 27 | 80 | 70 | 60 | 50 | Edit | Delete |
| Reference Leg Press | Hack Squat | Male | 601-800 LBS | Machine | 30 | 85 | 75 | 60 | 50 | Edit | Delete |
| Reference Leg Press | Hack Squat | Female | 601-800 LBS | Machine | 25 | 80 | 70 | 60 | 50 | Edit | Delete |
| Reference Leg Press | Hack Squat | Male | 801-9999 LBS | Machine | 28 | 85 | 75 | 60 | 50 | Edit | Delete |
| Reference Leg Press | Hack Squat | Female | 801-9999 LBS | Machine | 22 | 80 | 70 | 60 | 50 | Edit | Delete |
| Reference Leg Press | Horizontal Calf Raise | male | 0-120 LBS | Machine | 63 | 85 | 75 | 60 | 50 | Edit | Delete |
| Reference Leg Press | Horizontal Calf Raise | Female | 0-120 LBS | Machine | 63 | 80 | 70 | 60 | 50 | Edit | Delete |
| Reference Leg Press | Horizontal Calf Raise | female | 121-180 LBS | Machine | 56 | 80 | 70 | 60 | 50 | Edit | Delete |
| Reference Leg Press | Horizontal Calf Raise | Male | 121-180 LBS | Machine | 56 | 85 | 75 | 60 | 50 | Edit | Delete |

Fig. 7M

| | | | | | | | | | | | |
|---|---|---|---|---|---|---|---|---|---|---|---|
| Reference Leg Press | Horizontal Calf Raise | Female | 181-500 LBS | Machine | 53 | 80 | 70 | 60 | 50 | Edit | Delete |
| Reference Leg Press | Horizontal Calf Raise | Male | 181-500 LBS | Machine | 53 | 85 | 75 | 60 | 50 | Edit | Delete |
| Reference Leg Press | Horizontal Calf Raise | Female | 501-800 LBS | Machine | 47 | 80 | 70 | 60 | 50 | Edit | Delete |
| Reference Leg Press | Horizontal Calf Raise | Male | 501-800 LBS | Machine | 47 | 85 | 75 | 60 | 50 | Edit | Delete |
| Reference Leg Press | Horizontal Calf Raise | Male | 801-9999 LBS | Machine | 41 | 85 | 75 | 60 | 50 | Edit | Delete |
| Reference Leg Press | Horizontal Calf Raise | Female | 801-9999 LBS | Machine | 41 | 80 | 70 | 60 | 50 | Edit | Delete |
| Reference Leg Press | Horizontal Leg Press | female | 0-200 LBS | Machine | 100 | 80 | 75 | 60 | 50 | Edit | Delete |
| Reference Leg Press | Horizontal Leg Press | male | 0-200 LBS | Machine | 100 | 85 | 75 | 60 | 50 | Edit | Delete |
| Reference Leg Press | Horizontal Leg Press | male | 201-250 LBS | Machine | 91 | 85 | 75 | 60 | 50 | Edit | Delete |
| Reference Leg Press | Horizontal Leg Press | female | 201-250 LBS | Machine | 91 | 80 | 75 | 60 | 50 | Edit | Delete |
| Reference Leg Press | Horizontal Leg Press | female | 251-300 LBS | Machine | 87 | 80 | 75 | 60 | 50 | Edit | Delete |
| Reference Leg Press | Horizontal Leg Press | male | 251-300 LBS | Machine | 87 | 85 | 75 | 60 | 50 | Edit | Delete |
| Reference Leg Press | Horizontal Leg Press | male | 301-450 LBS | Machine | 72 | 85 | 75 | 60 | 50 | Edit | Delete |
| Reference Leg Press | Horizontal Leg Press | female | 301-450 LBS | Machine | 72 | 80 | 75 | 60 | 50 | Edit | Delete |
| Reference Leg Press | Horizontal Leg Press | female | 451-550 LBS | Machine | 68 | 80 | 75 | 60 | 50 | Edit | Delete |
| Reference Leg Press | Horizontal Leg Press | male | 451-550 LBS | Machine | 68 | 85 | 75 | 60 | 50 | Edit | Delete |
| Reference Leg Press | Horizontal Leg Press | female | 551-600 LBS | Machine | 60 | 80 | 75 | 60 | 50 | Edit | Delete |
| Reference Leg Press | Horizontal Leg Press | Male | 551-600 LBS | Machine | 60 | 85 | 75 | 60 | 50 | Edit | Delete |
| Reference Leg Press | Horizontal Leg Press | Male | 601-800 LBS | Machine | 56 | 85 | 75 | 60 | 50 | Edit | Delete |
| Reference Leg Press | Horizontal Leg Press | Female | 601-800 LBS | Machine | 56 | 80 | 75 | 60 | 50 | Edit | Delete |
| Reference Leg Press | Horizontal Leg Press | Male | 801-9999 LBS | Machine | 50 | 85 | 75 | 60 | 50 | Edit | Delete |
| Reference Leg Press | Horizontal Leg Press | Female | 801-9999 LBS | Machine | 50 | 80 | 75 | 60 | 50 | Edit | Delete |
| Reference Leg Press | Jumping | Male | 0-999 LBS | Body Weight | 0 | 0 | 0 | 0 | 0 | Edit | Delete |
| Reference Leg Press | Jumping | Female | 0-999 LBS | Body Weight | 0 | 0 | 0 | 0 | 0 | Edit | Delete |
| Reference Leg Press | Jumping Bench Leg Up | Male | 0-0 LBS | Body Weight | 0 | 0 | 0 | 0 | 0 | Edit | Delete |
| Reference Leg Press | Jumping Bench Leg Up | Female | 0-0 LBS | Body Weight | 0 | 0 | 0 | 0 | 0 | Edit | Delete |
| Reference Leg Press | Kneeling Leg Curl | male | 0-154 LBS | Machine | 19 | 85 | 75 | 60 | 50 | Edit | Delete |

Fig. 7N

| | | | | | | | | | | | |
|---|---|---|---|---|---|---|---|---|---|---|---|
| Reference Leg Press | Lying Leg Curl | male | 34-44 LBS | Machine | 68 | 85 | 75 | 60 | 50 | Edit | Delete |
| Reference Leg Press | Lying Leg Curl | Female | 34-44 LBS | Machine | 68 | 80 | 70 | 60 | 50 | Edit | Delete |
| Reference Leg Press | Lying Leg Curl | Female | 45-55 LBS | Machine | 62 | 80 | 70 | 60 | 50 | Edit | Delete |
| Reference Leg Press | Lying Leg Curl | Male | 45-55 LBS | Machine | 62 | 85 | 75 | 60 | 50 | Edit | Delete |
| Reference Leg Press | Lying Leg Curl | female | 56-82 LBS | Machine | 59 | 80 | 70 | 60 | 50 | Edit | Delete |
| Reference Leg Press | Lying Leg Curl | Male | 56-82 LBS | Machine | 59 | 85 | 75 | 60 | 50 | Edit | Delete |
| Reference Leg Press | Lying Leg Curl | female | 83-120 LBS | Machine | 54 | 80 | 75 | 60 | 50 | Edit | Delete |
| Reference Leg Press | Lying Leg Curl | Male | 83-120 LBS | Machine | 54 | 85 | 70 | 60 | 50 | Edit | Delete |
| Reference Leg Press | Lying Leg Curl | female | 121-154 LBS | Machine | 46 | 80 | 75 | 60 | 50 | Edit | Delete |
| Reference Leg Press | Lying Leg Curl | Male | 121-154 LBS | Machine | 46 | 85 | 70 | 60 | 50 | Edit | Delete |
| Reference Leg Press | Lying Leg Curl | male | 155-194 LBS | Machine | 40 | 85 | 75 | 60 | 50 | Edit | Delete |
| Reference Leg Press | Lying Leg Curl | Female | 155-194 LBS | Machine | 40 | 80 | 70 | 60 | 50 | Edit | Delete |
| Reference Leg Press | Lying Leg Curl | Male | 195-239 LBS | Machine | 35 | 85 | 75 | 60 | 50 | Edit | Delete |
| Reference Leg Press | Lying Leg Curl | Female | 195-239 LBS | Machine | 35 | 80 | 70 | 60 | 50 | Edit | Delete |
| Reference Leg Press | Lying Leg Curl | Male | 240-309 LBS | Machine | 32 | 85 | 75 | 60 | 50 | Edit | Delete |
| Reference Leg Press | Lying Leg Curl | Female | 240-309 LBS | Machine | 32 | 80 | 70 | 60 | 50 | Edit | Delete |
| Reference Leg Press | Lying Leg Curl | female | 310-450 LBS | Machine | 26 | 80 | 70 | 60 | 50 | Edit | Delete |
| Reference Leg Press | Lying Leg Curl | Male | 310-450 LBS | Machine | 26 | 85 | 75 | 60 | 50 | Edit | Delete |
| Reference Leg Press | Lying Leg Curl | Male | 451-600 LBS | Machine | 23 | 85 | 75 | 60 | 50 | Edit | Delete |
| Reference Leg Press | Lying Leg Curl | Female | 451-600 LBS | Machine | 23 | 80 | 70 | 60 | 50 | Edit | Delete |
| Reference Leg Press | Lying Leg Curl | Male | 601-9999 LBS | Machine | 20 | 85 | 75 | 60 | 50 | Edit | Delete |
| Reference Leg Press | Lying Leg Curl | Female | 601-9999 LBS | Machine | 20 | 80 | 70 | 60 | 50 | Edit | Delete |
| Reference Leg Press | Lying Outer Hip Raise | female | 0-9999 LBS | Body Weight | 0 | 80 | 70 | 60 | 50 | Edit | Delete |
| Reference Leg Press | Lying Outer Hip Raise | Male | 0-9999 LBS | Body Weight | 0 | 85 | 75 | 60 | 50 | Edit | Delete |
| Reference Leg Press | Lying Prone 1-Leg Lift | Male | 0-9999 LBS | Body Weight | 0 | 85 | 0 | 0 | 0 | Edit | Delete |
| Reference Leg Press | Lying Prone 1-Leg Lift | Female | 0-9999 LBS | Body Weight | 0 | 80 | 0 | 0 | 0 | Edit | Delete |
| Reference Leg Press | Lying Prone 2-Leg Lift | Male | 0-9999 LBS | Body Weight | 0 | 85 | 0 | 0 | 0 | Edit | Delete |

Fig. 7N Cont.

| | | | | | | | | | | | |
|---|---|---|---|---|---|---|---|---|---|---|---|
| Reference Leg Press | Lying Prone 2-Leg Lift | Female | 0-9999 LBS | Body Weight | 0 | 80 | 0 | 0 | 0 | Edit | Delete |
| Reference Leg Press | Pelvic Tilt | Female | 0-9999 LBS | Body Weight | 0 | 80 | 70 | 60 | 50 | Edit | Delete |
| Reference Leg Press | Pelvic Tilt | Male | 0-9999 LBS | Body Weight | 0 | 85 | 75 | 60 | 50 | Edit | Delete |
| Reference Leg Press | Quad Press | Male | 0-55 LBS | Machine | 155 | 85 | 75 | 60 | 50 | Edit | Delete |
| Reference Leg Press | Quad Press | Female | 0-55 LBS | Machine | 155 | 80 | 70 | 60 | 50 | Edit | Delete |
| Reference Leg Press | Quad Press | Male | 56-80 LBS | Machine | 150 | 85 | 75 | 60 | 50 | Edit | Delete |
| Reference Leg Press | Quad Press | Female | 56-80 LBS | Machine | 150 | 80 | 70 | 60 | 50 | Edit | Delete |
| Reference Leg Press | Quad Press | Male | 81-100 LBS | Machine | 140 | 85 | 75 | 60 | 50 | Edit | Delete |
| Reference Leg Press | Quad Press | Female | 81-100 LBS | Machine | 140 | 80 | 70 | 60 | 50 | Edit | Delete |
| Reference Leg Press | Quad Press | Male | 101-150 LBS | Machine | 100 | 85 | 75 | 60 | 50 | Edit | Delete |
| Reference Leg Press | Quad Press | Female | 101-150 LBS | Machine | 100 | 80 | 70 | 60 | 50 | Edit | Delete |
| Reference Leg Press | Quad Press | Male | 151-200 LBS | Machine | 90 | 85 | 75 | 60 | 50 | Edit | Delete |
| Reference Leg Press | Quad Press | Female | 151-200 LBS | Machine | 90 | 80 | 70 | 60 | 50 | Edit | Delete |
| Reference Leg Press | Quad Press | Male | 201-300 LBS | Machine | 80 | 85 | 75 | 60 | 50 | Edit | Delete |
| Reference Leg Press | Quad Press | Female | 201-300 LBS | Machine | 80 | 80 | 70 | 60 | 50 | Edit | Delete |
| Reference Leg Press | Quad Press | Male | 301-400 LBS | Machine | 70 | 85 | 75 | 60 | 50 | Edit | Delete |
| Reference Leg Press | Quad Press | Female | 301-400 LBS | Machine | 70 | 80 | 70 | 60 | 50 | Edit | Delete |
| Reference Leg Press | Quad Press | Male | 401-600 LBS | Machine | 60 | 85 | 75 | 60 | 50 | Edit | Delete |
| Reference Leg Press | Quad Press | Female | 401-600 LBS | Machine | 60 | 80 | 70 | 60 | 50 | Edit | Delete |
| Reference Leg Press | Quad Press | Male | 601-800 LBS | Machine | 55 | 85 | 75 | 60 | 50 | Edit | Delete |
| Reference Leg Press | Quad Press | Female | 601-800 LBS | Machine | 55 | 80 | 70 | 60 | 50 | Edit | Delete |
| Reference Leg Press | Quad Press | Male | 801-999 LBS | Machine | 45 | 85 | 75 | 60 | 50 | Edit | Delete |
| Reference Leg Press | Quad Press | Female | 801-999 LBS | Machine | 45 | 80 | 70 | 60 | 50 | Edit | Delete |
| Reference Leg Press | Reference Leg Press | Male | 0-9999 LBS | Machine | 100 | 85 | 75 | 60 | 50 | Edit | Delete |
| Reference Leg Press | Reference Leg Press | Female | 0-9999 LBS | Machine | 100 | 80 | 70 | 60 | 50 | Edit | Delete |
| Reference Leg Press | Rotary Hip (abduction) | Male | 0-44 LBS | Machine | 73 | 85 | 75 | 60 | 50 | Edit | Delete |
| Reference Leg Press | Rotary Hip (abduction) | Female | 0-44 LBS | Machine | 73 | 80 | 70 | 60 | 50 | Edit | Delete |

Fig. 7-0

| | | | | | | | | | | | |
|---|---|---|---|---|---|---|---|---|---|---|---|
| Reference Leg Press | Rotary Hip (abduction) | male | 45-55 LBS | Machine | 55 | 85 | 75 | 60 | 50 | Edit | Delete |
| Reference Leg Press | Rotary Hip (abduction) | Female | 45-55 LBS | Machine | 55 | 80 | 70 | 60 | 50 | Edit | Delete |
| Reference Leg Press | Rotary Hip (abduction) | male | 56-135 LBS | Machine | 33 | 85 | 75 | 60 | 50 | Edit | Delete |
| Reference Leg Press | Rotary Hip (abduction) | Female | 56-135 LBS | Machine | 33 | 80 | 70 | 60 | 50 | Edit | Delete |
| Reference Leg Press | Rotary Hip (abduction) | female | 136-250 LBS | Machine | 24 | 80 | 70 | 60 | 50 | Edit | Delete |
| Reference Leg Press | Rotary Hip (abduction) | Male | 136-250 LBS | Machine | 24 | 85 | 75 | 60 | 50 | Edit | Delete |
| Reference Leg Press | Rotary Hip (abduction) | Male | 251-308 LBS | Machine | 21 | 85 | 75 | 60 | 50 | Edit | Delete |
| Reference Leg Press | Rotary Hip (abduction) | Female | 251-308 LBS | Machine | 21 | 80 | 70 | 60 | 50 | Edit | Delete |
| Reference Leg Press | Rotary Hip (abduction) | Male | 309-372 LBS | Machine | 19 | 85 | 75 | 60 | 50 | Edit | Delete |
| Reference Leg Press | Rotary Hip (abduction) | Female | 309-372 LBS | Machine | 19 | 80 | 70 | 60 | 50 | Edit | Delete |
| Reference Leg Press | Rotary Hip (abduction) | Male | 373-468 LBS | Machine | 17 | 85 | 75 | 60 | 50 | Edit | Delete |
| Reference Leg Press | Rotary Hip (abduction) | Female | 373-468 LBS | Machine | 17 | 80 | 70 | 60 | 50 | Edit | Delete |
| Reference Leg Press | Rotary Hip (abduction) | Male | 469-570 LBS | Machine | 16 | 85 | 75 | 60 | 50 | Edit | Delete |
| Reference Leg Press | Rotary Hip (abduction) | Female | 469-570 LBS | Machine | 16 | 80 | 70 | 60 | 50 | Edit | Delete |
| Reference Leg Press | Rotary Hip (abduction) | Male | 571-9999 LBS | Machine | 15 | 85 | 75 | 60 | 50 | Edit | Delete |
| Reference Leg Press | Rotary Hip (abduction) | Female | 571-9999 LBS | Machine | 15 | 80 | 70 | 60 | 50 | Edit | Delete |
| Reference Leg Press | Rotary Hip (adduction) | Male | 0-44 LBS | Machine | 73 | 85 | 75 | 60 | 50 | Edit | Delete |
| Reference Leg Press | Rotary Hip (adduction) | Female | 0-44 LBS | Machine | 73 | 80 | 70 | 60 | 50 | Edit | Delete |
| Reference Leg Press | Rotary Hip (adduction) | male | 45-66 LBS | Machine | 64 | 85 | 75 | 60 | 50 | Edit | Delete |
| Reference Leg Press | Rotary Hip (adduction) | Female | 45-66 LBS | Machine | 64 | 80 | 70 | 60 | 50 | Edit | Delete |
| Reference Leg Press | Rotary Hip (adduction) | male | 67-82 LBS | Machine | 55 | 85 | 75 | 60 | 50 | Edit | Delete |
| Reference Leg Press | Rotary Hip (adduction) | Female | 67-82 LBS | Machine | 55 | 80 | 70 | 60 | 50 | Edit | Delete |
| Reference Leg Press | Rotary Hip (adduction) | female | 83-120 LBS | Machine | 50 | 80 | 70 | 60 | 50 | Edit | Delete |
| Reference Leg Press | Rotary Hip (adduction) | Male | 83-120 LBS | Machine | 50 | 85 | 75 | 60 | 50 | Edit | Delete |
| Reference Leg Press | Rotary Hip (adduction) | Male | 121-154 LBS | Machine | 43 | 85 | 75 | 60 | 50 | Edit | Delete |
| Reference Leg Press | Rotary Hip (adduction) | Female | 121-154 LBS | Machine | 43 | 80 | 70 | 60 | 50 | Edit | Delete |
| Reference Leg Press | Rotary Hip (adduction) | Male | 155-194 LBS | Machine | 37 | 85 | 75 | 60 | 50 | Edit | Delete |

Fig. 7P

| | | | | | | | | | | | |
|---|---|---|---|---|---|---|---|---|---|---|---|
| Reference Leg Press | Rotary Hip (adduction) | Female | 155-194 LBS | Machine | 37 | 80 | 70 | 60 | 50 | Edit | Delete |
| Reference Leg Press | Rotary Hip (adduction) | Male | 195-239 LBS | Machine | 33 | 85 | 75 | 60 | 50 | Edit | Delete |
| Reference Leg Press | Rotary Hip (adduction) | Female | 195-239 LBS | Machine | 33 | 80 | 70 | 60 | 50 | Edit | Delete |
| Reference Leg Press | Rotary Hip (adduction) | Male | 240-309 LBS | Machine | 29 | 85 | 75 | 60 | 50 | Edit | Delete |
| Reference Leg Press | Rotary Hip (adduction) | Female | 240-309 LBS | Machine | 29 | 80 | 70 | 60 | 50 | Edit | Delete |
| Reference Leg Press | Rotary Hip (adduction) | Male | 310-9999 LBS | Machine | 24 | 85 | 75 | 60 | 50 | Edit | Delete |
| Reference Leg Press | Rotary Hip (adduction) | Female | 310-9999 LBS | Machine | 24 | 80 | 70 | 60 | 50 | Edit | Delete |
| Reference Leg Press | Rotary Hip (to rear) | female | 0-55 LBS | Machine | 73 | 80 | 70 | 60 | 50 | Edit | Delete |
| Reference Leg Press | Rotary Hip (to rear) | Male | 0-55 LBS | Machine | 80 | 85 | 75 | 60 | 50 | Edit | Delete |
| Reference Leg Press | Rotary Hip (to rear) | female | 56-135 LBS | Machine | 45 | 80 | 70 | 60 | 50 | Edit | Delete |
| Reference Leg Press | Rotary Hip (to rear) | Male | 56-135 LBS | Machine | 55 | 85 | 75 | 60 | 50 | Edit | Delete |
| Reference Leg Press | Rotary Hip (to rear) | female | 136-250 LBS | Machine | 32 | 80 | 70 | 60 | 50 | Edit | Delete |
| Reference Leg Press | Rotary Hip (to rear) | Male | 136-250 LBS | Machine | 40 | 85 | 75 | 60 | 50 | Edit | Delete |
| Reference Leg Press | Rotary Hip (to rear) | female | 251-308 LBS | Machine | 29 | 80 | 70 | 60 | 50 | Edit | Delete |
| Reference Leg Press | Rotary Hip (to rear) | Male | 251-308 LBS | Machine | 33 | 85 | 75 | 60 | 50 | Edit | Delete |
| Reference Leg Press | Rotary Hip (to rear) | female | 309-372 LBS | Machine | 26 | 80 | 70 | 60 | 50 | Edit | Delete |
| Reference Leg Press | Rotary Hip (to rear) | Male | 309-372 LBS | Machine | 30 | 85 | 75 | 60 | 50 | Edit | Delete |
| Reference Leg Press | Rotary Hip (to rear) | female | 373-468 LBS | Machine | 22 | 80 | 70 | 60 | 50 | Edit | Delete |
| Reference Leg Press | Rotary Hip (to rear) | Male | 373-468 LBS | Machine | 25 | 85 | 75 | 60 | 50 | Edit | Delete |
| Reference Leg Press | Rotary Hip (to rear) | female | 469-570 LBS | Machine | 21 | 80 | 70 | 60 | 50 | Edit | Delete |
| Reference Leg Press | Rotary Hip (to rear) | Male | 469-570 LBS | Machine | 23 | 85 | 75 | 60 | 50 | Edit | Delete |
| Reference Leg Press | Rotary Hip (to rear) | female | 571-9999 LBS | Machine | 20 | 80 | 70 | 60 | 50 | Edit | Delete |
| Reference Leg Press | Rotary Hip (to rear) | Male | 571-9999 LBS | Machine | 21 | 85 | 75 | 60 | 50 | Edit | Delete |
| Reference Leg Press | Seated 1-Foot Calf Raise w/ Strap on Knee on Bench | Male | 0-9999 LBS | Machine | 29 | 85 | 75 | 65 | 50 | Edit | Delete |
| Reference Leg Press | Seated 1-Foot Calf Raise w/ Strap on Knee on Bench | Female | 0-9999 LBS | Machine | 29 | 80 | 70 | 60 | 50 | Edit | Delete |
| Reference Leg Press | Seated 1-Leg Curl on Bench | Male | 0-9999 LBS | Machine | 12 | 85 | 75 | 65 | 50 | Edit | Delete |

Fig. 7Q

| | | | | | | | | | | | |
|---|---|---|---|---|---|---|---|---|---|---|---|
| Reference Leg Press | Seated Leg Curl | Male | 121-154 LBS | Machine | 57 | 85 | 75 | 60 | 50 | Edit | Delete |
| Reference Leg Press | Seated Leg Curl | Female | 121-154 LBS | Machine | 57 | 80 | 75 | 60 | 50 | Edit | Delete |
| Reference Leg Press | Seated Leg Curl | Male | 155-194 LBS | Machine | 49 | 85 | 75 | 60 | 50 | Edit | Delete |
| Reference Leg Press | Seated Leg Curl | Female | 155-194 LBS | Machine | 49 | 80 | 75 | 60 | 50 | Edit | Delete |
| Reference Leg Press | Seated Leg Curl | Male | 195-239 LBS | Machine | 43 | 85 | 75 | 60 | 50 | Edit | Delete |
| Reference Leg Press | Seated Leg Curl | Female | 195-239 LBS | Machine | 43 | 80 | 75 | 60 | 50 | Edit | Delete |
| Reference Leg Press | Seated Leg Curl | Male | 240-309 LBS | Machine | 39 | 85 | 75 | 60 | 50 | Edit | Delete |
| Reference Leg Press | Seated Leg Curl | Female | 240-309 LBS | Machine | 39 | 80 | 75 | 60 | 50 | Edit | Delete |
| Reference Leg Press | Seated Leg Curl | male | 310-450 LBS | Machine | 32 | 85 | 75 | 60 | 50 | Edit | Delete |
| Reference Leg Press | Seated Leg Curl | Female | 310-450 LBS | Machine | 32 | 80 | 75 | 60 | 50 | Edit | Delete |
| Reference Leg Press | Seated Leg Curl | Male | 451-600 LBS | Machine | 28 | 85 | 75 | 60 | 50 | Edit | Delete |
| Reference Leg Press | Seated Leg Curl | Female | 451-600 LBS | Machine | 28 | 80 | 75 | 60 | 50 | Edit | Delete |
| Reference Leg Press | Seated Leg Curl | Male | 601-9999 LBS | Machine | 25 | 85 | 75 | 60 | 50 | Edit | Delete |
| Reference Leg Press | Seated Leg Curl | Female | 601-9999 LBS | Machine | 25 | 80 | 75 | 60 | 50 | Edit | Delete |
| Reference Leg Press | Seated Leg Extension | Male | 0-45 LBS | Machine | 75 | 85 | 75 | 60 | 50 | Edit | Delete |
| Reference Leg Press | Seated Leg Extension | Female | 0-45 LBS | Machine | 75 | 80 | 70 | 60 | 50 | Edit | Delete |
| Reference Leg Press | Seated Leg Extension | Male | 46-50 LBS | Machine | 70 | 85 | 75 | 60 | 50 | Edit | Delete |
| Reference Leg Press | Seated Leg Extension | Female | 46-50 LBS | Machine | 70 | 80 | 70 | 60 | 50 | Edit | Delete |
| Reference Leg Press | Seated Leg Extension | Male | 51-60 LBS | Machine | 65 | 85 | 75 | 60 | 50 | Edit | Delete |
| Reference Leg Press | Seated Leg Extension | Female | 51-60 LBS | Machine | 65 | 80 | 70 | 60 | 50 | Edit | Delete |
| Reference Leg Press | Seated Leg Extension | Male | 61-100 LBS | Machine | 60 | 85 | 75 | 60 | 50 | Edit | Delete |
| Reference Leg Press | Seated Leg Extension | Female | 61-100 LBS | Machine | 60 | 80 | 70 | 60 | 50 | Edit | Delete |
| Reference Leg Press | Seated Leg Extension | Female | 101-150 LBS | Machine | 55 | 80 | 70 | 60 | 50 | Edit | Delete |
| Reference Leg Press | Seated Leg Extension | Male | 101-150 LBS | Machine | 55 | 85 | 75 | 60 | 50 | Edit | Delete |
| Reference Leg Press | Seated Leg Extension | Male | 151-300 LBS | Machine | 45 | 85 | 75 | 60 | 50 | Edit | Delete |
| Reference Leg Press | Seated Leg Extension | Female | 151-300 LBS | Machine | 40 | 80 | 70 | 60 | 50 | Edit | Delete |
| Reference Leg Press | Seated Leg Extension | Male | 301-500 LBS | Machine | 35 | 85 | 75 | 60 | 50 | Edit | Delete |

Fig. 7R

| | | | | | | | | | | | |
|---|---|---|---|---|---|---|---|---|---|---|---|
| Reference Leg Press | Seated Leg Extension | Female | 301-500 LBS | Machine | 30 | 80 | 70 | 60 | 50 | Edit | Delete |
| Reference Leg Press | Seated Leg Extension | Female | 501-600 LBS | Machine | 25 | 80 | 70 | 60 | 50 | Edit | Delete |
| Reference Leg Press | Seated Leg Extension | Male | 501-600 LBS | Machine | 30 | 85 | 75 | 60 | 50 | Edit | Delete |
| Reference Leg Press | Seated Leg Extension | Male | 601-9999 LBS | Machine | 25 | 85 | 75 | 60 | 50 | Edit | Delete |
| Reference Leg Press | Seated Leg Extension | Female | 601-9999 LBS | Machine | 20 | 80 | 70 | 60 | 50 | Edit | Delete |
| Reference Leg Press | Seated Leg Press | male | 0-100 LBS | Machine | 125 | 85 | 75 | 60 | 50 | Edit | Delete |
| Reference Leg Press | Seated Leg Press | female | 0-100 LBS | Machine | 125 | 80 | 75 | 60 | 50 | Edit | Delete |
| Reference Leg Press | Seated Leg Press | female | 101-200 LBS | Machine | 96 | 80 | 75 | 60 | 50 | Edit | Delete |
| Reference Leg Press | Seated Leg Press | Male | 101-200 LBS | Machine | 96 | 85 | 75 | 60 | 50 | Edit | Delete |
| Reference Leg Press | Seated Leg Press | female | 201-300 LBS | Machine | 84 | 80 | 75 | 60 | 50 | Edit | Delete |
| Reference Leg Press | Seated Leg Press | Male | 201-300 LBS | Machine | 84 | 85 | 75 | 60 | 50 | Edit | Delete |
| Reference Leg Press | Seated Leg Press | Male | 301-500 LBS | Machine | 77 | 85 | 75 | 60 | 50 | Edit | Delete |
| Reference Leg Press | Seated Leg Press | Female | 301-500 LBS | Machine | 77 | 80 | 75 | 60 | 50 | Edit | Delete |
| Reference Leg Press | Seated Leg Press | female | 501-600 LBS | Machine | 67 | 80 | 75 | 60 | 50 | Edit | Delete |
| Reference Leg Press | Seated Leg Press | Male | 501-600 LBS | Machine | 67 | 85 | 75 | 60 | 50 | Edit | Delete |
| Reference Leg Press | Seated Leg Press | Male | 601-800 LBS | Machine | 65 | 85 | 75 | 60 | 50 | Edit | Delete |
| Reference Leg Press | Seated Leg Press | Female | 601-800 LBS | Machine | 65 | 80 | 75 | 60 | 50 | Edit | Delete |
| Reference Leg Press | Seated Leg Press | Male | 801-9999 LBS | Machine | 63 | 85 | 75 | 60 | 50 | Edit | Delete |
| Reference Leg Press | Seated Leg Press | Female | 801-9999 LBS | Machine | 63 | 80 | 75 | 60 | 50 | Edit | Delete |
| Reference Leg Press | Sprint Calf Raise | Male | 0-55 LBS | Machine | 125 | 85 | 75 | 60 | 50 | Edit | Delete |
| Reference Leg Press | Sprint Calf Raise | Female | 0-55 LBS | Machine | 125 | 80 | 70 | 60 | 50 | Edit | Delete |
| Reference Leg Press | Sprint Calf Raise | Male | 56-80 LBS | Machine | 120 | 85 | 75 | 60 | 50 | Edit | Delete |
| Reference Leg Press | Sprint Calf Raise | Female | 56-80 LBS | Machine | 120 | 80 | 70 | 60 | 50 | Edit | Delete |
| Reference Leg Press | Sprint Calf Raise | Male | 81-100 LBS | Machine | 115 | 85 | 75 | 60 | 50 | Edit | Delete |
| Reference Leg Press | Sprint Calf Raise | Female | 81-100 LBS | Machine | 115 | 80 | 70 | 60 | 50 | Edit | Delete |
| Reference Leg Press | Sprint Calf Raise | Male | 101-150 LBS | Machine | 110 | 85 | 75 | 60 | 50 | Edit | Delete |
| Reference Leg Press | Sprint Calf Raise | Female | 101-150 LBS | Machine | 110 | 80 | 70 | 60 | 50 | Edit | Delete |

Fig. 7R Cont.

| | | | | | | | | | | | |
|---|---|---|---|---|---|---|---|---|---|---|---|
| Reference Leg Press | Sprint Calf Raise | Male | 151-200 LBS | Machine | 100 | 85 | 75 | 60 | 50 | Edit | Delete |
| Reference Leg Press | Sprint Calf Raise | Female | 151-200 LBS | Machine | 100 | 80 | 70 | 60 | 50 | Edit | Delete |
| Reference Leg Press | Sprint Calf Raise | Male | 201-300 LBS | Machine | 80 | 85 | 75 | 60 | 50 | Edit | Delete |
| Reference Leg Press | Sprint Calf Raise | Female | 201-300 LBS | Machine | 80 | 80 | 70 | 60 | 50 | Edit | Delete |
| Reference Leg Press | Sprint Calf Raise | Male | 301-500 LBS | Machine | 70 | 85 | 75 | 60 | 50 | Edit | Delete |
| Reference Leg Press | Sprint Calf Raise | Female | 301-500 LBS | Machine | 70 | 80 | 70 | 60 | 50 | Edit | Delete |
| Reference Leg Press | Sprint Calf Raise | Male | 501-600 LBS | Machine | 65 | 85 | 75 | 60 | 50 | Edit | Delete |
| Reference Leg Press | Sprint Calf Raise | Female | 501-600 LBS | Machine | 65 | 80 | 70 | 60 | 50 | Edit | Delete |
| Reference Leg Press | Sprint Calf Raise | Male | 601-800 LBS | Machine | 60 | 85 | 75 | 60 | 50 | Edit | Delete |
| Reference Leg Press | Sprint Calf Raise | Female | 601-800 LBS | Machine | 60 | 80 | 70 | 60 | 50 | Edit | Delete |
| Reference Leg Press | Sprint Calf Raise | Male | 801-999 LBS | Machine | 50 | 85 | 75 | 60 | 50 | Edit | Delete |
| Reference Leg Press | Sprint Calf Raise | Female | 801-999 LBS | Machine | 50 | 80 | 70 | 60 | 50 | Edit | Delete |
| Reference Leg Press | Squat | female | 0-450 LBS | Machine | 45 | 80 | 70 | 60 | 50 | Edit | Delete |
| Reference Leg Press | Squat | Male | 0-450 LBS | Machine | 45 | 85 | 75 | 60 | 50 | Edit | Delete |
| Reference Leg Press | Squat | Male | 451-9999 LBS | Machine | 40 | 85 | 75 | 60 | 50 | Edit | Delete |
| Reference Leg Press | Squat | Female | 451-9999 LBS | Machine | 40 | 80 | 70 | 60 | 50 | Edit | Delete |
| Reference Leg Press | Squat Holding Strap | Male | 0-9999 LBS | Machine | 27 | 85 | 75 | 65 | 50 | Edit | Delete |
| Reference Leg Press | Squat Holding Strap | Female | 0-9999 LBS | Machine | 27 | 80 | 70 | 60 | 50 | Edit | Delete |
| Reference Leg Press | Squat w/ Abduction | Male | 0-9999 LBS | Machine | 6 | 85 | 75 | 65 | 50 | Edit | Delete |
| Reference Leg Press | Squat w/ Abduction | Female | 0-9999 LBS | Machine | 6 | 80 | 70 | 60 | 50 | Edit | Delete |
| Reference Leg Press | Squat w/ Adduction | Male | 0-9999 LBS | Machine | 8 | 85 | 75 | 65 | 50 | Edit | Delete |
| Reference Leg Press | Squat w/ Adduction | Female | 0-9999 LBS | Machine | 8 | 80 | 70 | 60 | 50 | Edit | Delete |
| Reference Leg Press | Squat w/Strap Behind Neck | Male | 0-9999 LBS | Machine | 23 | 85 | 75 | 65 | 50 | Edit | Delete |
| Reference Leg Press | Squat w/Strap Behind Neck | Female | 0-9999 LBS | Machine | 23 | 80 | 70 | 60 | 50 | Edit | Delete |
| Reference Leg Press | Squat w/Strap on Shoulder | Male | 0-9999 LBS | Machine | 25 | 85 | 75 | 65 | 50 | Edit | Delete |
| Reference Leg Press | Squat w/Strap on Shoulder | Female | 0-9999 LBS | Machine | 25 | 80 | 70 | 60 | 50 | Edit | Delete |
| Reference Leg Press | Stabilized Squat | Male | 0-9999 LBS | Body Weight | 0 | 85 | 0 | 0 | 0 | Edit | Delete |

Fig. 7S

| | | | | | | | | | | | |
|---|---|---|---|---|---|---|---|---|---|---|---|
| Reference Leg Press | Stabilized Squat | Female | 0-9999 LBS | Body Weight | 0 | 80 | 0 | 0 | 0 | Edit | Delete |
| Reference Leg Press | Stabilized Wide Stance Squat | Male | 0-9999 LBS | Body Weight | 0 | 85 | 0 | 0 | 0 | Edit | Delete |
| Reference Leg Press | Stabilized Wide Stance Squat | Female | 0-9999 LBS | Body Weight | 0 | 80 | 0 | 0 | 0 | Edit | Delete |
| Reference Leg Press | Standing 1 Leg (1-DB) Calf Raise | Male | 0-120 LBS | Dumbbell | 12 | 85 | 75 | 60 | 50 | Edit | Delete |
| Reference Leg Press | Standing 1 Leg (1-DB) Calf Raise | Female | 0-120 LBS | Dumbbell | 12 | 80 | 70 | 60 | 50 | Edit | Delete |
| Reference Leg Press | Standing 1 Leg (1-DB) Calf Raise | female | 121-300 LBS | Dumbbell | 11 | 80 | 70 | 60 | 50 | Edit | Delete |
| Reference Leg Press | Standing 1 Leg (1-DB) Calf Raise | Male | 121-300 LBS | Dumbbell | 11 | 85 | 75 | 60 | 50 | Edit | Delete |
| Reference Leg Press | Standing 1 Leg (1-DB) Calf Raise | Male | 301-500 LBS | Dumbbell | 8 | 85 | 75 | 60 | 50 | Edit | Delete |
| Reference Leg Press | Standing 1 Leg (1-DB) Calf Raise | Female | 301-500 LBS | Dumbbell | 8 | 80 | 70 | 60 | 50 | Edit | Delete |
| Reference Leg Press | Standing 1 Leg (1-DB) Calf Raise | Male | 501-9999 LBS | Dumbbell | 6 | 85 | 75 | 60 | 50 | Edit | Delete |
| Reference Leg Press | Standing 1 Leg (1-DB) Calf Raise | Female | 501-9999 LBS | Dumbbell | 6 | 80 | 70 | 60 | 50 | Edit | Delete |
| Reference Leg Press | Standing 1-Leg Calf Raise | Male | 0-120 LBS | Machine | 19 | 85 | 75 | 60 | 50 | Edit | Delete |
| Reference Leg Press | Standing 1-Leg Calf Raise | Female | 0-120 LBS | Machine | 19 | 80 | 70 | 60 | 50 | Edit | Delete |
| Reference Leg Press | Standing 1-Leg Calf Raise | female | 121-180 LBS | Machine | 17 | 80 | 70 | 60 | 50 | Edit | Delete |
| Reference Leg Press | Standing 1-Leg Calf Raise | Male | 121-180 LBS | Machine | 17 | 85 | 75 | 60 | 50 | Edit | Delete |
| Reference Leg Press | Standing 1-Leg Calf Raise | Female | 181-300 LBS | Machine | 16 | 80 | 70 | 60 | 50 | Edit | Delete |
| Reference Leg Press | Standing 1-Leg Calf Raise | Male | 181-300 LBS | Machine | 16 | 85 | 75 | 60 | 50 | Edit | Delete |
| Reference Leg Press | Standing 1-Leg Calf Raise | Female | 301-600 LBS | Machine | 10 | 80 | 70 | 60 | 50 | Edit | Delete |
| Reference Leg Press | Standing 1-Leg Calf Raise | Male | 301-600 LBS | Machine | 10 | 85 | 75 | 60 | 50 | Edit | Delete |
| Reference Leg Press | Standing 1-Leg Calf Raise | Female | 601-9999 LBS | Machine | 8 | 80 | 70 | 60 | 50 | Edit | Delete |
| Reference Leg Press | Standing 1-Leg Calf Raise | Male | 601-9999 LBS | Machine | 8 | 85 | 75 | 60 | 50 | Edit | Delete |
| Reference Leg Press | Standing 1-Leg Elastic Curl | Male | 0-9999 LBS | Body Weight | 0 | 0 | 0 | 0 | 0 | Edit | Delete |
| Reference Leg Press | Standing 1-Leg Elastic Curl | Female | 0-9999 LBS | Body Weight | 0 | 0 | 0 | 0 | 0 | Edit | Delete |
| Reference Leg Press | Standing Calf Raise | female | 0-75 LBS | Machine | 80 | 80 | 70 | 60 | 50 | Edit | Delete |
| Reference Leg Press | Standing Calf Raise | Male | 0-75 LBS | Machine | 80 | 85 | 75 | 60 | 50 | Edit | Delete |
| Reference Leg Press | Standing Calf Raise | female | 76-90 LBS | Machine | 75 | 80 | 70 | 60 | 50 | Edit | Delete |
| Reference Leg Press | Standing Calf Raise | Male | 76-90 LBS | Machine | 75 | 85 | 75 | 60 | 50 | Edit | Delete |

Fig. 7S Cont.

| | | | | | | | | | | | |
|---|---|---|---|---|---|---|---|---|---|---|---|
| Reference Leg Press | Standing Inner Thigh | Male | 0-82 LBS | Machine | 13 | 85 | 75 | 60 | 50 | Edit | Delete |
| Reference Leg Press | Standing Inner Thigh | female | 83-309 LBS | Machine | 10 | 80 | 70 | 60 | 50 | Edit | Delete |
| Reference Leg Press | Standing Inner Thigh | Male | 83-309 LBS | Machine | 12 | 85 | 75 | 60 | 50 | Edit | Delete |
| Reference Leg Press | Standing Inner Thigh | female | 310-9999 LBS | Machine | 9 | 80 | 70 | 60 | 50 | Edit | Delete |
| Reference Leg Press | Standing Inner Thigh | Male | 310-9999 LBS | Machine | 11 | 85 | 75 | 60 | 50 | Edit | Delete |
| Reference Leg Press | Standing Leg Curl | female | 0-9999 LBS | Machine | 10 | 80 | 70 | 60 | 50 | Edit | Delete |
| Reference Leg Press | Standing Leg Curl | Male | 0-9999 LBS | Machine | 12 | 85 | 75 | 60 | 50 | Edit | Delete |
| Reference Leg Press | Standing Straight Leg Extension | Male | 0-9999 LBS | Machine | 10 | 85 | 75 | 65 | 50 | Edit | Delete |
| Reference Leg Press | Standing Straight Leg Extension | Female | 0-9999 LBS | Machine | 10 | 80 | 70 | 60 | 50 | Edit | Delete |
| Reference Leg Press | Standing Straight Leg Extension | Male | 0-9999 LBS | Body Weight | 0 | 85 | 0 | 0 | 0 | Edit | Delete |
| Reference Leg Press | Standing Straight Leg Extension | Female | 0-9999 LBS | Body Weight | 0 | 80 | 0 | 0 | 0 | Edit | Delete |
| Reference Leg Press | Standing Supported 90 Degree Leg Ext | Male | 0-9999 LBS | Machine | 7 | 85 | 75 | 65 | 50 | Edit | Delete |
| Reference Leg Press | Standing Supported 90 Degree Leg Ext | Female | 0-9999 LBS | Machine | 7 | 80 | 70 | 60 | 50 | Edit | Delete |
| Reference Leg Press | Standing Supported Straight Leg Ext | Male | 0-9999 LBS | Machine | 6 | 85 | 75 | 65 | 50 | Edit | Delete |
| Reference Leg Press | Standing Supported Straight Leg Ext | Female | 0-9999 LBS | Machine | 6 | 80 | 70 | 60 | 50 | Edit | Delete |
| Reference Leg Press | Stationary Lunge | female | 0-450 LBS | Dumbbell | 8 | 80 | 70 | 60 | 50 | Edit | Delete |
| Reference Leg Press | Stationary Lunge | Male | 0-450 LBS | Dumbbell | 8 | 85 | 75 | 60 | 50 | Edit | Delete |
| Reference Leg Press | Stationary Lunge | Male | 451-9999 LBS | Dumbbell | 6 | 85 | 75 | 60 | 50 | Edit | Delete |
| Reference Leg Press | Stationary Lunge | Female | 451-9999 LBS | Dumbbell | 6 | 80 | 70 | 60 | 50 | Edit | Delete |
| Reference Leg Press | Supine 1-Leg Straight Leg Ext on Bench | Male | 0-9999 LBS | Dumbbell | 6 | 85 | 75 | 65 | 50 | Edit | Delete |
| Reference Leg Press | Supine 1-Leg Straight Leg Ext on Bench | Female | 0-9999 LBS | Dumbbell | 6 | 80 | 70 | 60 | 50 | Edit | Delete |
| Reference Leg Press | Supine 1-Leg Straight Leg Ext on Floor | Male | 0-9999 LBS | Machine | 6 | 85 | 75 | 65 | 50 | Edit | Delete |
| Reference Leg Press | Supine 1-Leg Straight Leg Ext on Floor | Female | 0-9999 LBS | Machine | 6 | 80 | 70 | 60 | 50 | Edit | Delete |
| Reference Leg Press | Supine 90 Degree 1-Leg Ext on Bench | Male | 0-9999 LBS | Machine | 7 | 85 | 75 | 65 | 50 | Edit | Delete |

Fig. 7T

| | | | | | | | | | | | |
|---|---|---|---|---|---|---|---|---|---|---|---|
| Reference Leg Press | Supine 90 Degree 1-Leg Ext on Bench | Female | 0-9999 LBS | Machine | 7 | 80 | 70 | 60 | 50 | Edit | Delete |
| Reference Leg Press | Supine 90 Degree 1-Leg Ext on Floor | Male | 0-9999 LBS | Machine | 6 | 85 | 75 | 65 | 50 | Edit | Delete |
| Reference Leg Press | Supine 90 Degree 1-Leg Ext on Floor | Female | 0-9999 LBS | Machine | 6 | 80 | 70 | 60 | 50 | Edit | Delete |
| Reference Leg Press | Supported 1-Leg Abduction | Male | 0-9999 LBS | Machine | 7 | 85 | 75 | 65 | 50 | Edit | Delete |
| Reference Leg Press | Supported 1-Leg Abduction | Female | 0-9999 LBS | Machine | 7 | 80 | 70 | 60 | 50 | Edit | Delete |
| Reference Leg Press | Supported 1-Leg Adduction | Male | 0-9999 LBS | Machine | 8 | 85 | 75 | 65 | 50 | Edit | Delete |
| Reference Leg Press | Supported 1-Leg Adduction | Female | 0-9999 LBS | Machine | 8 | 80 | 70 | 60 | 50 | Edit | Delete |
| Reference Leg Press | Supported Hip Extension w/Foot on Strap | Male | 0-9999 LBS | Machine | 12 | 85 | 75 | 65 | 50 | Edit | Delete |
| Reference Leg Press | Supported Hip Extension w/Foot on Strap | Female | 0-9999 LBS | Machine | 12 | 80 | 70 | 60 | 50 | Edit | Delete |
| Reference Leg Press | Supported Straight Leg Hip Extension | Male | 0-9999 LBS | Machine | 9 | 85 | 75 | 65 | 50 | Edit | Delete |
| Reference Leg Press | Supported Straight Leg Hip Extension | Female | 0-9999 LBS | Machine | 9 | 80 | 70 | 60 | 50 | Edit | Delete |
| Reference Leg Press | Vertical Leg Press | female | 0-9999 LBS | Machine | 65 | 80 | 70 | 60 | 50 | Edit | Delete |
| Reference Leg Press | Vertical Leg Press | Male | 0-9999 LBS | Machine | 65 | 85 | 75 | 60 | 50 | Edit | Delete |
| Reference Leg Press | Walking Lunge | female | 0-450 LBS | Dumbbell | 8 | 80 | 70 | 60 | 50 | Edit | Delete |
| Reference Leg Press | Walking Lunge | Male | 0-450 LBS | Dumbbell | 8 | 85 | 75 | 60 | 50 | Edit | Delete |
| Reference Leg Press | Walking Lunge | Male | 451-9999 LBS | Dumbbell | 6 | 85 | 75 | 60 | 50 | Edit | Delete |
| Reference Leg Press | Walking Lunge | Female | 451-9999 LBS | Dumbbell | 6 | 80 | 70 | 60 | 50 | Edit | Delete |
| Reference Leg Press | Wide Stance Leg Press | male | 0-9999 LBS | Machine | 70 | 85 | 75 | 60 | 50 | Edit | Delete |
| Reference Leg Press | Wide Stance Leg Press | Female | 0-9999 LBS | Machine | 70 | 80 | 70 | 60 | 50 | Edit | Delete |
| Reference Leg Press | Wide Stance Squat | Female | 0-450 LBS | Machine | 45 | 80 | 70 | 60 | 50 | Edit | Delete |
| Reference Leg Press | Wide Stance Squat | Male | 0-450 LBS | Machine | 45 | 85 | 75 | 60 | 50 | Edit | Delete |
| Reference Leg Press | Wide Stance Squat | Male | 451-9999 LBS | Machine | 40 | 85 | 75 | 60 | 50 | Edit | Delete |
| Reference Leg Press | Wide Stance Squat | Female | 451-9999 LBS | Machine | 40 | 80 | 70 | 60 | 50 | Edit | Delete |
| Reference Leg Press | Wide Stance Squat (1 Dumbbell) | Male | 0-10 LBS | Dumbbell | 60 | 85 | 75 | 60 | 50 | Edit | Delete |

Fig. 7T Cont.

| | | | | | | | | | | | |
|---|---|---|---|---|---|---|---|---|---|---|---|
| Reference Leg Press | Wide Stance Squat (1 Dumbbell) | Female | 0-10 LBS | Dumbbell | 60 | 80 | 70 | 60 | 50 | Edit | Delete |
| Reference Leg Press | Wide Stance Squat (1 Dumbbell) | Male | 11-20 LBS | Dumbbell | 50 | 85 | 75 | 60 | 50 | Edit | Delete |
| Reference Leg Press | Wide Stance Squat (1 Dumbbell) | Female | 11-20 LBS | Dumbbell | 50 | 80 | 70 | 60 | 50 | Edit | Delete |
| Reference Leg Press | Wide Stance Squat (1 Dumbbell) | female | 21-450 LBS | Dumbbell | 25 | 80 | 70 | 60 | 50 | Edit | Delete |
| Reference Leg Press | Wide Stance Squat (1 Dumbbell) | Male | 21-450 LBS | Dumbbell | 25 | 85 | 75 | 60 | 50 | Edit | Delete |
| Reference Leg Press | Wide Stance Squat (1 Dumbbell) | Male | 451-600 LBS | Dumbbell | 20 | 85 | 75 | 60 | 50 | Edit | Delete |
| Reference Leg Press | Wide Stance Squat (1 Dumbbell) | Female | 451-600 LBS | Dumbbell | 20 | 80 | 70 | 60 | 50 | Edit | Delete |
| Reference Leg Press | Wide Stance Squat (1 Dumbbell) | Male | 601-9999 LBS | Dumbbell | 17 | 85 | 75 | 60 | 50 | Edit | Delete |
| Reference Leg Press | Wide Stance Squat (1 Dumbbell) | Female | 601-9999 LBS | Dumbbell | 17 | 80 | 70 | 60 | 50 | Edit | Delete |
| Reference Leg Press | Wide Stance Squat (Barbell) | Female | 0-500 LBS | Barbell | 45 | 80 | 70 | 60 | 50 | Edit | Delete |
| Reference Leg Press | Wide Stance Squat (Barbell) | Male | 0-500 LBS | Barbell | 45 | 85 | 75 | 60 | 50 | Edit | Delete |
| Reference Leg Press | Wide Stance Squat (Barbell) | Male | 501-600 LBS | Barbell | 42 | 85 | 75 | 60 | 50 | Edit | Delete |
| Reference Leg Press | Wide Stance Squat (Barbell) | Female | 501-600 LBS | Barbell | 42 | 80 | 70 | 60 | 50 | Edit | Delete |
| Reference Leg Press | Wide Stance Squat (Barbell) | Male | 601-800 LBS | Barbell | 37 | 85 | 75 | 60 | 50 | Edit | Delete |
| Reference Leg Press | Wide Stance Squat (Barbell) | Female | 601-800 LBS | Barbell | 37 | 80 | 70 | 60 | 50 | Edit | Delete |
| Reference Leg Press | Wide Stance Squat (Barbell) | Male | 801-9999 LBS | Barbell | 33 | 85 | 75 | 60 | 50 | Edit | Delete |
| Reference Leg Press | Wide Stance Squat (Barbell) | Female | 801-9999 LBS | Barbell | 33 | 80 | 70 | 60 | 50 | Edit | Delete |
| Reference Leg Press | Wide Stance Squat Holding Strap | Male | 0-9999 LBS | Machine | 27 | 85 | 75 | 65 | 50 | Edit | Delete |
| Reference Leg Press | Wide Stance Squat Holding Strap | Female | 0-9999 LBS | Machine | 27 | 80 | 70 | 60 | 50 | Edit | Delete |
| | Dip | Female | 5-9999 LBS | Body Weight | 100 | 80 | 0 | 0 | 0 | Edit | Delete |
| | Dip | Male | 5-9999 LBS | Body Weight | 100 | 85 | 0 | 0 | 0 | Edit | Delete |
| | Weighted Dip | Female | 13-20 LBS | Body Weight | 100 | 80 | 50 | 35 | 20 | Edit | Delete |
| | Weighted Dip | Male | 13-20 LBS | Body Weight | 100 | 85 | 60 | 40 | 30 | Edit | Delete |

Fig. 7U

| | | | | | | | | | | | |
|---|---|---|---|---|---|---|---|---|---|---|---|
| | Weighted Dip | Male | 21-30 LBS | Body Weight | 100 | 85 | 60 | 40 | 30 | Edit | Delete |
| | Weighted Dip | Female | 21-30 LBS | Body Weight | 100 | 80 | 50 | 35 | 20 | Edit | Delete |
| | Weighted Dip | Female | 31-9999 LBS | Body Weight | 100 | 80 | 50 | 35 | 20 | Edit | Delete |
| | Weighted Dip | Male | 31-9999 LBS | Body Weight | 100 | 85 | 60 | 40 | 30 | Edit | Delete |
| Seated Back Extension | 45 Degree Back Extension | Male | 0-9999 LBS | Dumbbell | 25 | 85 | 40 | 40 | 30 | Edit | Delete |
| Seated Back Extension | 45 Degree Back Extension | Female | 0-9999 LBS | Dumbbell | 25 | 80 | 40 | 40 | 30 | Edit | Delete |
| Seated Back Extension | 90 Degree Back Extension | Male | 0-9999 LBS | Dumbbell | 18 | 85 | 40 | 40 | 30 | Edit | Delete |
| Seated Back Extension | 90 Degree Back Extension | Female | 0-9999 LBS | Dumbbell | 18 | 80 | 40 | 40 | 30 | Edit | Delete |
| Seated Back Extension | Chest Press on Heels | Male | 0-9999 LBS | Machine | 33 | 85 | 75 | 65 | 50 | Edit | Delete |
| Seated Back Extension | Chest Press on Heels | Female | 0-9999 LBS | Machine | 33 | 80 | 70 | 60 | 50 | Edit | Delete |
| Seated Back Extension | Dumbbell Deadlift | Male | 0-9999 LBS | Dumbbell | 30 | 85 | 70 | 70 | 55 | Edit | Delete |
| Seated Back Extension | Dumbbell Deadlift | Female | 0-9999 LBS | Dumbbell | 30 | 80 | 70 | 70 | 50 | Edit | Delete |
| Seated Back Extension | Kneeling Back Extension | female | 0-9999 LBS | Machine | 40 | 80 | 70 | 70 | 60 | Edit | Delete |
| Seated Back Extension | Kneeling Back Extension | Male | 0-9999 LBS | Machine | 40 | 85 | 70 | 70 | 60 | Edit | Delete |
| Seated Back Extension | Kneeling Back Extension | Female | 0-9999 LBS | Machine | 100 | 80 | 70 | 70 | 60 | Edit | Delete |
| Seated Back Extension | Lying Prone Back Extension | Male | 0-9999 LBS | Body Weight | 0 | 85 | 0 | 0 | 0 | Edit | Delete |
| Seated Back Extension | Lying Prone Back Extension | Female | 0-9999 LBS | Body Weight | 0 | 80 | 0 | 0 | 0 | Edit | Delete |
| Seated Back Extension | Prone Cobra | Male | 0-9999 LBS | Body Weight | 0 | 0 | 0 | 0 | 0 | Edit | Delete |
| Seated Back Extension | Prone Cobra | Female | 0-9999 LBS | Body Weight | 0 | 0 | 0 | 0 | 0 | Edit | Delete |
| Seated Back Extension | Seated Back Extension | Male | 0-9999 LBS | Machine | 100 | 85 | 70 | 70 | 60 | Edit | Delete |
| Seated Back Extension | Seated Back Extension | Female | 0-9999 LBS | Machine | 100 | 80 | 70 | 70 | 60 | Edit | Delete |
| Seated Back Extension | Stabilized Back Extension on Ball | Male | 0-9999 LBS | Body Weight | 0 | 85 | 0 | 0 | 0 | Edit | Delete |
| Seated Back Extension | Stabilized Back Extension on Ball | Female | 0-9999 LBS | Body Weight | 0 | 80 | 0 | 0 | 0 | Edit | Delete |
| Seated Back Extension | Standing Shoulder Press | Male | 0-9999 LBS | Machine | 28 | 85 | 75 | 65 | 50 | Edit | Delete |
| Seated Back Extension | Standing Shoulder Press | Female | 0-9999 LBS | Machine | 28 | 80 | 70 | 60 | 50 | Edit | Delete |
| Seated Back Extension | Stiff-Legged Deadlift | female | 0-9999 LBS | Barbell | 75 | 80 | 70 | 70 | 60 | Edit | Delete |
| Seated Back Extension | Stiff-Legged Deadlift | Male | 0-9999 LBS | Barbell | 75 | 85 | 75 | 75 | 60 | Edit | Delete |
| Crunch | 90 Degree Crunch | Male | 0-0 LBS | Body Weight | 0 | 85 | 0 | 0 | 0 | Edit | Delete |

Fig. 7U Cont.

| | | | | | | | | | | | |
|---|---|---|---|---|---|---|---|---|---|---|---|
| Crunch | Supine Lower Abdominal (BP cuff) | Female | 0-9999 LBS | Body Weight | 0 | 0 | 0 | 0 | 0 | Edit | Delete |
| Crunch | Torso Rotation | Male | 0-9999 LBS | Machine | 100 | 70 | 70 | 60 | 60 | Edit | Delete |
| Crunch | Torso Rotation | Female | 0-9999 LBS | Machine | 100 | 70 | 70 | 60 | 60 | Edit | Delete |
| Crunch | Weighted Crunch | Male | 0-9999 LBS | Body Weight | 0 | 0 | 0 | 0 | 0 | Edit | Delete |
| Crunch | Weighted Crunch | Female | 0-9999 LBS | Body Weight | 0 | 0 | 0 | 0 | 0 | Edit | Delete |
| Crunch | Weighted Decline Crunch | Male | 0-9999 LBS | Body Weight | 0 | 0 | 0 | 0 | 0 | Edit | Delete |
| Crunch | Weighted Decline Crunch | Female | 0-9999 LBS | Body Weight | 0 | 0 | 0 | 0 | 0 | Edit | Delete |
| Crunch | Weighted Decline Side Oblique Crunch | Male | 0-9999 LBS | Body Weight | 0 | 0 | 0 | 0 | 0 | Edit | Delete |
| Crunch | Weighted Decline Side Oblique Crunch | Female | 0-9999 LBS | Body Weight | 0 | 0 | 0 | 0 | 0 | Edit | Delete |
| Crunch | Weighted Side Oblique Crunch | Male | 0-9999 LBS | Body Weight | 0 | 0 | 0 | 0 | 0 | Edit | Delete |
| Crunch | Weighted Side Oblique Crunch | Female | 0-9999 LBS | Body Weight | 0 | 0 | 0 | 0 | 0 | Edit | Delete |
| Seated Shoulder Press | 1-Arm Side Lateral Raise | Female | 0-9999 LBS | Machine | 15 | 80 | 70 | 60 | 50 | Edit | Delete |
| Seated Shoulder Press | 1-Arm Side Lateral Raise | Male | 0-9999 LBS | Machine | 15 | 85 | 75 | 60 | 50 | Edit | Delete |
| Seated Shoulder Press | Barbell Seated Shoulder Press | Male | 0-9999 LBS | Barbell | 70 | 85 | 75 | 60 | 50 | Edit | Delete |
| Seated Shoulder Press | Barbell Seated Shoulder Press | Female | 0-9999 LBS | Barbell | 70 | 80 | 70 | 60 | 50 | Edit | Delete |
| Seated Shoulder Press | Bent Over Elastic Rear Deltoid | Male | 0-9999 LBS | Body Weight | 0 | 85 | 0 | 0 | 0 | Edit | Delete |
| Seated Shoulder Press | Bent Over Elastic Rear Deltoid | Female | 0-9999 LBS | Body Weight | 0 | 80 | 0 | 0 | 0 | Edit | Delete |
| Seated Shoulder Press | Bent Over Rear Deltoid | female | 0-13 LBS | Dumbbell | 60 | 80 | 70 | 60 | 50 | Edit | Delete |
| Seated Shoulder Press | Bent Over Rear Deltoid | Male | 0-13 LBS | Dumbbell | 60 | 85 | 75 | 60 | 50 | Edit | Delete |
| Seated Shoulder Press | Bent Over Rear Deltoid | female | 14-20 LBS | Dumbbell | 40 | 80 | 70 | 60 | 50 | Edit | Delete |
| Seated Shoulder Press | Bent Over Rear Deltoid | Male | 14-20 LBS | Dumbbell | 40 | 85 | 75 | 60 | 50 | Edit | Delete |

Fig. 7V

| | | | | | | | | | | | |
|---|---|---|---|---|---|---|---|---|---|---|---|
| Seated Shoulder Press | Front Deltoid Raise | Female | 21-30 LBS | Dumbbell | 30 | 80 | 70 | 60 | 50 | Edit | Delete |
| Seated Shoulder Press | Front Deltoid Raise | Male | 31-9999 LBS | Dumbbell | 25 | 85 | 75 | 60 | 50 | Edit | Delete |
| Seated Shoulder Press | Front Deltoid Raise | Female | 31-9999 LBS | Dumbbell | 25 | 80 | 70 | 60 | 50 | Edit | Delete |
| Seated Shoulder Press | Front Deltoid Raise | Female | 0-9999 LBS | Barbell | 45 | 80 | 70 | 60 | 50 | Edit | Delete |
| Seated Shoulder Press | Front Deltoid Raise | Male | 0-9999 LBS | Barbell | 45 | 85 | 75 | 60 | 50 | Edit | Delete |
| Seated Shoulder Press | Front Deltoid Raise on Bench | Male | 0-9999 LBS | Machine | 15 | 85 | 75 | 65 | 50 | Edit | Delete |
| Seated Shoulder Press | Front Deltoid Raise on Bench | Female | 0-9999 LBS | Machine | 15 | 80 | 70 | 60 | 50 | Edit | Delete |
| Seated Shoulder Press | Front Deltoid Raise on Heels | Male | 0-9999 LBS | Machine | 15 | 85 | 75 | 65 | 50 | Edit | Delete |
| Seated Shoulder Press | Front Deltoid Raise on Heels | Female | 0-9999 LBS | Machine | 15 | 80 | 70 | 60 | 50 | Edit | Delete |
| Seated Shoulder Press | Horizontal Grip Elastic Rear Deltoid | Male | 0-9999 LBS | Body Weight | 0 | 0 | 0 | 0 | 0 | Edit | Delete |
| Seated Shoulder Press | Horizontal Grip Elastic Rear Deltoid | Female | 0-9999 LBS | Body Weight | 0 | 0 | 0 | 0 | 0 | Edit | Delete |
| Seated Shoulder Press | Lateral Raise on Bench | Male | 0-9999 LBS | Machine | 12 | 85 | 75 | 65 | 50 | Edit | Delete |
| Seated Shoulder Press | Lateral Raise on Bench | Female | 0-9999 LBS | Machine | 12 | 80 | 70 | 60 | 50 | Edit | Delete |
| Seated Shoulder Press | Lateral Raise on Heels | Male | 0-9999 LBS | Machine | 12 | 85 | 75 | 65 | 50 | Edit | Delete |
| Seated Shoulder Press | Lateral Raise on Heels | Female | 0-9999 LBS | Machine | 12 | 80 | 70 | 60 | 50 | Edit | Delete |
| Seated Shoulder Press | Lateral Raise w/ Alternating Lunge | Male | 0-9999 LBS | Machine | 15 | 85 | 75 | 65 | 50 | Edit | Delete |
| Seated Shoulder Press | Lateral Raise w/ Alternating Lunge | Female | 0-9999 LBS | Machine | 15 | 80 | 70 | 60 | 50 | Edit | Delete |
| Seated Shoulder Press | Lateral Raise w/ Static Lunge | Male | 0-9999 LBS | Machine | 15 | 85 | 75 | 65 | 50 | Edit | Delete |
| Seated Shoulder Press | Lateral Raise w/ Static Lunge | Female | 0-9999 LBS | Machine | 15 | 80 | 70 | 60 | 50 | Edit | Delete |

Fig. 7V Cont.

| | | | | | | | | | | | |
|---|---|---|---|---|---|---|---|---|---|---|---|
| Seated Shoulder Press | Seated Rear Deltoid | Female | 0-25 LBS | Machine | 95 | 80 | 70 | 60 | 50 | Edit | Delete |
| Seated Shoulder Press | Seated Rear Deltoid | Male | 26-35 LBS | Machine | 85 | 85 | 75 | 60 | 50 | Edit | Delete |
| Seated Shoulder Press | Seated Rear Deltoid | Female | 26-35 LBS | Machine | 85 | 80 | 70 | 60 | 50 | Edit | Delete |
| Seated Shoulder Press | Seated Rear Deltoid | Male | 36-45 LBS | Machine | 75 | 85 | 75 | 60 | 50 | Edit | Delete |
| Seated Shoulder Press | Seated Rear Deltoid | Female | 36-45 LBS | Machine | 75 | 80 | 70 | 60 | 50 | Edit | Delete |
| Seated Shoulder Press | Seated Rear Deltoid | Male | 46-9999 LBS | Machine | 70 | 85 | 75 | 60 | 50 | Edit | Delete |
| Seated Shoulder Press | Seated Rear Deltoid | Female | 46-9999 LBS | Machine | 70 | 80 | 70 | 60 | 50 | Edit | Delete |
| Seated Shoulder Press | Seated Shoulder Press | Female | 0-13 LBS | Dumbbell | 60 | 80 | 70 | 60 | 50 | Edit | Delete |
| Seated Shoulder Press | Seated Shoulder Press | Male | 0-13 LBS | Dumbbell | 60 | 85 | 75 | 60 | 50 | Edit | Delete |
| Seated Shoulder Press | Seated Shoulder Press | Male | 14-50 LBS | Dumbbell | 40 | 85 | 75 | 60 | 50 | Edit | Delete |
| Seated Shoulder Press | Seated Shoulder Press | Female | 14-50 LBS | Dumbbell | 40 | 80 | 70 | 60 | 50 | Edit | Delete |
| Seated Shoulder Press | Seated Shoulder Press | Male | 51-100 LBS | Dumbbell | 35 | 85 | 75 | 60 | 50 | Edit | Delete |
| Seated Shoulder Press | Seated Shoulder Press | Female | 51-100 LBS | Dumbbell | 35 | 80 | 70 | 60 | 50 | Edit | Delete |
| Seated Shoulder Press | Seated Shoulder Press | female | 101-9999 LBS | Dumbbell | 30 | 80 | 70 | 60 | 50 | Edit | Delete |
| Seated Shoulder Press | Seated Shoulder Press | Male | 101-9999 LBS | Dumbbell | 30 | 85 | 75 | 60 | 50 | Edit | Delete |
| Seated Shoulder Press | Seated Shoulder Press | Female | 0-9999 LBS | Barbell | 80 | 80 | 70 | 60 | 50 | Edit | Delete |
| Seated Shoulder Press | Seated Shoulder Press | Female | 0-9999 LBS | Machine | 100 | 80 | 70 | 60 | 50 | Edit | Delete |
| Seated Shoulder Press | Seated Shoulder Press | Male | 0-9999 LBS | Barbell | 80 | 85 | 75 | 60 | 50 | Edit | Delete |
| Seated Shoulder Press | Seated Shoulder Press | Male | 0-9999 LBS | Machine | 100 | 85 | 75 | 60 | 50 | Edit | Delete |

Fig. 7W

| | | | | | | | | | | | |
|---|---|---|---|---|---|---|---|---|---|---|---|
| Seated Shoulder Press | Seated Side Lateral Raise | Female | 21-35 LBS | Dumbbell | 35 | 80 | 70 | 60 | 50 | Edit | Delete |
| Seated Shoulder Press | Seated Side Lateral Raise | female | 31-50 LBS | Machine | 80 | 80 | 70 | 60 | 50 | Edit | Delete |
| Seated Shoulder Press | Seated Side Lateral Raise | Male | 31-50 LBS | Machine | 80 | 85 | 75 | 60 | 50 | Edit | Delete |
| Seated Shoulder Press | Seated Side Lateral Raise | female | 36-65 LBS | Dumbbell | 25 | 80 | 70 | 60 | 50 | Edit | Delete |
| Seated Shoulder Press | Seated Side Lateral Raise | Male | 36-65 LBS | Dumbbell | 25 | 85 | 75 | 60 | 50 | Edit | Delete |
| Seated Shoulder Press | Seated Side Lateral Raise | female | 66-9999 LBS | Dumbbell | 20 | 80 | 70 | 60 | 50 | Edit | Delete |
| Seated Shoulder Press | Seated Side Lateral Raise | Male | 66-9999 LBS | Dumbbell | 20 | 85 | 75 | 60 | 50 | Edit | Delete |
| Seated Shoulder Press | Seated Side Lateral Raise | female | 51-9999 LBS | Machine | 65 | 80 | 70 | 60 | 50 | Edit | Delete |
| Seated Shoulder Press | Seated Side Lateral Raise | Male | 51-9999 LBS | Machine | 65 | 85 | 75 | 60 | 50 | Edit | Delete |
| Seated Shoulder Press | Shoulder Press on Bench | Male | 0-9999 LBS | Body Weight | 30 | 85 | 75 | 65 | 50 | Edit | Delete |
| Seated Shoulder Press | Shoulder Press on Bench | Female | 0-9999 LBS | Body Weight | 30 | 80 | 70 | 60 | 50 | Edit | Delete |
| Seated Shoulder Press | Shoulder Press on Heels | Male | 0-9999 LBS | Machine | 28 | 85 | 75 | 65 | 50 | Edit | Delete |
| Seated Shoulder Press | Shoulder Press on Heels | Female | 0-9999 LBS | Machine | 28 | 80 | 70 | 60 | 50 | Edit | Delete |
| Seated Shoulder Press | Standing 1-Arm 90-Degree Rotation | Male | 0-9999 LBS | Body Weight | 0 | 0 | 0 | 0 | 0 | Edit | Delete |
| Seated Shoulder Press | Standing 1-Arm 90-Degree Rotation | Female | 0-9999 LBS | Body Weight | 0 | 0 | 0 | 0 | 0 | Edit | Delete |
| Seated Shoulder Press | Standing Barbell Shrug | female | 0-9999 LBS | Barbell | 60 | 80 | 70 | 60 | 50 | Edit | Delete |
| Seated Shoulder Press | Standing Barbell Shrug | Male | 0-9999 LBS | Barbell | 150 | 85 | 75 | 60 | 50 | Edit | Delete |
| Seated Shoulder Press | Standing Elastic Rear Deltoid | Male | 0-9999 LBS | Body Weight | 0 | 0 | 0 | 0 | 0 | Edit | Delete |
| Seated Shoulder Press | Standing Elastic Rear Deltoid | Female | 0-9999 LBS | Body Weight | 0 | 0 | 0 | 0 | 0 | Edit | Delete |

Fig. 7W Cont.

| | | | | | | | | | | | |
|---|---|---|---|---|---|---|---|---|---|---|---|
| Seated Shoulder Press | Standing Front Deltoid Raise | female | 0-9999 LBS | Machine | 15 | 80 | 70 | 60 | 50 | Edit | Delete |
| Seated Shoulder Press | Standing Front Deltoid Raise | Male | 0-9999 LBS | Machine | 15 | 85 | 75 | 65 | 50 | Edit | Delete |
| Seated Shoulder Press | Standing Lateral Raise | Male | 0-9999 LBS | Machine | 15 | 85 | 75 | 65 | 50 | Edit | Delete |
| Seated Shoulder Press | Standing Lateral Raise | Female | 0-9999 LBS | Machine | 15 | 80 | 70 | 60 | 50 | Edit | Delete |
| Seated Shoulder Press | Standing Rear Deltoid | Male | 0-9999 LBS | Machine | 17 | 85 | 75 | 65 | 50 | Edit | Delete |
| Seated Shoulder Press | Standing Rear Deltoid | Female | 0-9999 LBS | Machine | 17 | 80 | 70 | 60 | 50 | Edit | Delete |
| Seated Shoulder Press | Standing Shrug | female | 0-13 LBS | Dumbbell | 60 | 80 | 70 | 60 | 50 | Edit | Delete |
| Seated Shoulder Press | Standing Shrug | Male | 0-13 LBS | Dumbbell | 60 | 85 | 75 | 60 | 50 | Edit | Delete |
| Seated Shoulder Press | Standing Shrug | female | 14-9999 LBS | Dumbbell | 55 | 80 | 70 | 60 | 50 | Edit | Delete |
| Seated Shoulder Press | Standing Shrug | Male | 14-9999 LBS | Dumbbell | 60 | 85 | 75 | 60 | 50 | Edit | Delete |
| Seated Shoulder Press | Standing Shrug | female | 0-9999 LBS | Machine | 60 | 80 | 70 | 60 | 50 | Edit | Delete |
| Seated Shoulder Press | Standing Shrug | Male | 0-9999 LBS | Machine | 150 | 85 | 75 | 60 | 50 | Edit | Delete |
| Seated Shoulder Press | Standing Side Lateral Raise | female | 0-13 LBS | Dumbbell | 60 | 80 | 70 | 60 | 50 | Edit | Delete |
| Seated Shoulder Press | Standing Side Lateral Raise | Male | 0-13 LBS | Dumbbell | 60 | 85 | 75 | 60 | 50 | Edit | Delete |
| Seated Shoulder Press | Standing Side Lateral Raise | female | 14-20 LBS | Dumbbell | 40 | 80 | 70 | 60 | 50 | Edit | Delete |
| Seated Shoulder Press | Standing Side Lateral Raise | Male | 14-20 LBS | Dumbbell | 40 | 85 | 75 | 60 | 50 | Edit | Delete |
| Seated Shoulder Press | Standing Side Lateral Raise | Male | 21-35 LBS | Dumbbell | 35 | 85 | 75 | 60 | 50 | Edit | Delete |
| Seated Shoulder Press | Standing Side Lateral Raise | Female | 21-35 LBS | Dumbbell | 35 | 80 | 70 | 60 | 50 | Edit | Delete |
| Seated Shoulder Press | Standing Side Lateral Raise | female | 36-65 LBS | Dumbbell | 25 | 80 | 70 | 60 | 50 | Edit | Delete |

Fig. 7X

| | | | | | | | | | | | |
|---|---|---|---|---|---|---|---|---|---|---|---|
| Seated Shoulder Press | Upright Row | Male | 0-9999 LBS | Barbell | 70 | 85 | 75 | 60 | 50 | Edit | Delete |
| Seated Shoulder Press | Upright Row | Male | 0-9999 LBS | Machine | 69 | 85 | 75 | 60 | 50 | Edit | Delete |
| Seated Shoulder Press | Upright Row on Bench | Male | 0-9999 LBS | Machine | 50 | 85 | 75 | 65 | 50 | Edit | Delete |
| Seated Shoulder Press | Upright Row on Bench | Female | 0-9999 LBS | Machine | 50 | 80 | 70 | 60 | 50 | Edit | Delete |
| Seated Shoulder Press | Upright Row on Heels | Male | 0-9999 LBS | Machine | 50 | 85 | 75 | 65 | 50 | Edit | Delete |
| Seated Shoulder Press | Upright Row on Heels | Female | 0-9999 LBS | Machine | 50 | 80 | 70 | 60 | 50 | Edit | Delete |
| Seated Shoulder Press | Upright Row w/ Backward Alternating Lunge | Male | 0-9999 LBS | Machine | 46 | 85 | 75 | 65 | 50 | Edit | Delete |
| Seated Shoulder Press | Upright Row w/ Backward Alternating Lunge | Female | 0-9999 LBS | Machine | 46 | 80 | 70 | 60 | 50 | Edit | Delete |
| Seated Shoulder Press | Upright Row w/ Static Backward Lunge | Male | 0-9999 LBS | Machine | 46 | 85 | 75 | 65 | 50 | Edit | Delete |
| Seated Shoulder Press | Upright Row w/ Static Backward Lunge | Female | 0-9999 LBS | Machine | 46 | 80 | 70 | 60 | 50 | Edit | Delete |

Fig. 8

| | Manufacturer | Make | Equipment | Model | Exercise | Coefficient |
|---|---|---|---|---|---|---|
| 56 | Body Masters | N/A | Bench Press | CM262 | Bench Press | 1 |
| | Body Masters | N/A | Bench Press | PS100 | Bench Press | 1 |
| | Cybex | N/A | Bench Press | 5225 | Bench Press | 1 |
| | Icarian | Flite | Bench Press | FLT 540 | Bench Press | 0.6 |
| 58 | Nautilus | Super Smooth Technology | Bench Press | 2ST | Bench Press | 1.05 |
| | Nautilus | N/A | Bench Press | N/A | Bench Press | 0.96 |
| | Nautilus | Power Plus | Bench Press | N/A | Bench Press | 1.1 |
| | Nautilus | Next Generation | Bench Press | N/A | Bench Press | 1 |

FIG. 9

ONE, SALLY

Training Type: Splitbody
Result Desired: Tone, Shape, Define
Activity ID: W300333

ActivTrax
WE'VE GOT PLANS FOR YOUR BODY

Day Description: Upper Body

TODAY'S SUGGESTED WARM-UP

Perform 5-10 minutes of cardio, then stretch.

60

| Exercise Equipment Name | SET 1 WT | SET 1 REPS | SET 1 REST | SET 2 WT | SET 2 REPS | SET 2 REST |
|---|---|---|---|---|---|---|
| Bench Press Dumbbell | 15 | 12-15 | 0:30 | 15 | 12-15 | 0:30 |

*Please note: Warm-up exercise is suggested independently of your preferred restrictions.

MESSAGE CENTER: Congratulations on your commitment to fitness. Please do not hesitate to call on me if you have any questions regarding your workout.

HAVE MY COACH, GARY ALBERT, CONTACT ME

TODAY'S RESISTANCE WORKOUT

Level One, Intro Day: 1 | Estimated time to complete resistance workout: 32

Date of Workout: / / | Resistance Start Time: AM / PM

| EXPECTED FEEL Region Target Area | SEAT OTHER | EXERCISE Manufacturer Equipment Name | SET 1 WT | SET 1 REPS | SET 1 REST | TODAY'S REPS | SET 2 WT | SET 2 REPS | SET 2 REST | TODAY'S REPS | SET 3 WT | SET 3 REPS | SET 3 REST | TODAY'S REPS |
|---|---|---|---|---|---|---|---|---|---|---|---|---|---|---|
| Light Chest Pecs | N/A | Seated Chest Press Life Fitness (#24) Chest Press | 45+P | 10-15 | 1:00 | | 45+P | 10-15 | 1:00 | | 60 | 10-15 | 1:00 | |
| Medium Back Lats | | Wide Grip Pulldown (front) Icarian Multigym Modular (#47) Pulldown | 90 | 10-15 | 1:00 | | 90 | 10-15 | 1:30 | | 100+P | 8-12 | 1:00 | |
| Medium Back Lower Back | | Seated Back Extension Life Fitness (#38) Low Back Extension | 105+P | 10-15 | 1:30 | | 105+P | BEST | 1:00 | | | | | |
| Medium Shoulders Delts | N/A | Seated Shoulder Press Life Fitness (#44) Shoulder Press | 100 | BEST | 1:30 | | 100 | 10-15 | 1:00 | | 110+P | BEST | 1:00 | |
| Medium Arms Lower Biceps | N/A | Seated Arm Curl Life Fitness (#26) Arm Curl | 40+P | BEST | 1:00 | | 40+P | BEST | 1:00 | | | | | |
| Medium Arms Triceps | N/A | Seated Tricep Extension Life Fitness (#21) Arm Extension | 40 | 10-15 | 1:00 | | 40 | BEST | 1:00 | | | | | |

*BEST means do the "best" you can, but don't exceed 20 repetitions.
+P means add a supplemental plate, +2P means add two supplemental plates, and so on.

Resistance End Time: AM / PM

TODAY'S ABS

62

| | Exercise | Reps | Rest | Today's | | Exercise | Reps | Rest | Today's |
|---|---|---|---|---|---|---|---|---|---|
| #1 | Crunch Floor | 12-15 | 0:15 | | #2 | 90 Degree Reverse Crunch Floor | 10-12 | 0:15 | |
| #3 | Side Oblique Crunch with Heel Push Floor | 8-10 | 0:30 | | #4 | Crunch with Legs Vertical Floor | 10-12 | 0:15 | |

TODAY'S CARDIO

Record the minutes performed on each of the following activities:

| | | | | | | | |
|---|---|---|---|---|---|---|---|
| Minimum Time Recommended | 20 Minutes | Stair Master | | Recumbent Bike | | Aerobic | |
| | | Tread Mill | | Upright Bike | | Spinning | |
| Target Heart Rate | 142 - 153 | Ski Machine | | Elliptical Trainer | | Swimming | |
| | | Row Machine | | Running | | Other | |

64

MY NOTES

IMPORTANT: This area is for your own notes. They will be recorded, but will NOT be sent to your coach or to ActivTrax.

Activtrax Demo Studio
Printed on 12/14/2004

© 2005 ActivTrax, LLC. All rights reserved. 110306S118-4336
3 of 4

WORKOUT ID# 8089

FIG. 11

*My Employee Profile*

Cleopatra Jones

| | | | |
|---|---|---|---|
| **Club Name:** | Garys Club Training Studio (1014) | **Title:** | |
| **User Name:** | Cleopatra | **Roles(s):** | Coach |
| **Address:** | sdgds<br>sfg<br>AK 11111 | **Phone:** | (111) 111-1111 |
| **Email:** | | **Cell:** | |

EDIT MY PROFILE

View Members

Fig. 12

Coach: [ ] List Certified Coaches Only — (All Coaches)

Search: SUBMIT (No search in effect)

[ ] Search Anywhere in Selected Fields
[ ] Ignore Settings When Searching
[x] Show Results on a Single Page Active Filter: Most Recent Settings — (None)

Apply Selected Filter
Save As...
Edit Page Settings

Member List
Admirals Cove

Showing 1 to 8 of 8

| | | | | | | | | | |
|---|---|---|---|---|---|---|---|---|---|
| 1 | 52456 | Activitrax, Isforme | ATX | Active | None | N/A | N/A | Level One, 3-day | |
| 2 | 71707 | Archer, Troy | None | Pending | None | N/A | N/A | N/A | |
| 3 | 76349 | Card, Report | ATX | Active | Phone Call, 1st Appt | N/A | N/A | Level One, 3-day | |
| 4 | 87272 | Kaplan, Ben | ATX | Active | Phone Call, 1st Appt | N/A | N/A | Level One, 3-day | |
| 5 | 72661 | Kaplan, Harold | ATX | Active | None | N/A | N/A | Level One, 4-day | |
| 6 | 72659 | Kaplan, Howard | ATX | Active | None | N/A | N/A | Level One, 3-day | |
| 7 | 55675 | Merritt, Security | ATX | Active | None | N/A | N/A | Level One, 3-day | |
| 8 | 76547 | Super, Slow | ATX | Active | Phone Call, 1st Appt | N/A | N/A | Level Three, 3-day | |

Legend: Blue = Pending / Partially Evaluated  Green = Active / Introductory  Purple = Started / Evaluated / Suspended / Expired / Cancelled  Red = Removed

FIG. 13

ActivTrax
WE'VE GOT PLANS FOR YOUR BODY

Weekly Call / Status Report

Printed for Wednesday, February 09, 2005

Coach: User, Demo
Demo Studio

Page 1 of 1

| STATUS SYMBOL | MEMBER INFORMATION | WEEKS / WORKOUTS | ATTENDANCE | DAYS ATTENDED (last two weeks) | CURRENT PROGRAM | AVERAGE WORKOUT TIME | | WEEKLY ATTENDANCE GRAPH | AVG # OF DAYS | REASON |
|---|---|---|---|---|---|---|---|---|---|---|
| | Name / Preferred Contact Number / Gender/Age Salesperson | | Weekly % / Monthly % / Annual % | S M T W T F S / S M T W T F S | Days/Wk / Level / Intensity | Training | Cardio | 18 Nov, 25 Nov, 02 Dec, 09 Dec, 16 Dec, 23 Dec, 30 Dec | Week / Month | Your Reason To Call Your Member |
| **PHONE THESE MEMBERS** | | | | | | | | | | |
| P | Partial, Pat (Partially Evaluated) / (301) 222-3333 Home / Female/38 N/A | Weeks 0 Workouts | 0 % / 0 % / 0 % | | 3 days/wk / Level 1 / Normal | 0 min | 0 min | 100 / 50 / % 0 0 0 0 0 0 0 0 | 0 / 0 | Partially Evaluated Member Strength Evaluation Required |
| | Newcomer, Nancy (Active) / (301) 222-3333 Home / Female/38 N/A | 1 Week 3 Workouts | 100 % / 100 % / 100 % | | 3 days/wk / Level 1 / Normal | 0 min | 20 min | 100 / 50 / % 0 0 0 0 0 0 0 100 | 3 / 12 | New Member Check-In Call |
| + | Fitness, Frankie (Active) / (301) 222-3333 Home / Male/38 N/A | 5 Weeks 25 Workouts | 166 % / 208 % / 192 % | | 3 days/wk / Level 1 / Normal | 0 min | 20 min | 100 / 50 / % 0 0 0 300 233 233 233 166 | 6 / 23 | Member Overattending Compliance Call |
| ! | Machines, Megan (Active) / (301) 222-3333 Home / Female/38 N/A | 5 Weeks 7 Workouts | 0 % / 0 % / 0 % | | 2 days/wk / Level 1 / Normal | 0 min | 20 min | 100 / 50 / % 0 0 0 0 0 0 0 0 | 1 / 6 | Member Off Track (2+ wks) Motivation Call |
| X | Transferred, Tom (Cancelled) / (301) 222-3333 Home / Male/38 N/A | 5 Weeks 0 Workouts | 0 % / 0 % / 0 % | | 3 days/wk / Level 1 / Normal | 0 min | 0 min | 100 / 50 / % 0 0 0 0 0 0 0 0 | 0 / 0 | Cancelled 1/5/2005 Reason: Relocated out of country |
| | Toning, Toni (Active) / (301) 222-3333 Home / Female/38 N/A | 9 Weeks 5 Workouts | 68 % / 41 % / 20 % | | 3 days/wk / Level 1 / Normal | 0 min | 20 min | 100 / 50 / % 0 0 0 0 0 0 100 66 | 1 / 2 | Re-Evaluation Due Schedule Appointment |
| **ACTIVE MEMBERS** | | | | | | | | | | |
| A | Rockclimber, Robin (Intro Set Active) / (301) 222-3333 Home / Female/38 N/A | 4 Weeks 6 Workouts | 100 % / 66 % / 66 % | | 3 days/wk / Level 1 / Normal | 0 min | 20 min | 100 / 50 / % 0 0 0 0 0 33 133 100 | 1 / 7 | Intro Going Active Last Day: 1/13/2005 |
| ? | Slacker, Sam (Active) / (301) 222-3333 Home / Male/38 N/A | 5 Weeks 6 Workouts | 0 % / 50 % / 46 % | | 3 days/wk / Level 1 / Normal | 0 min | 20 min | 100 / 50 / % 0 0 0 0 0 133 100 0 | 1 / 5 | Member Off Track (1 wk) |
| ★ | Barbells, Bob (Active) / (301) 222-3333 Home / Male/38 N/A | 4 Weeks 6 Workouts | 100 % / 66 % / 66 % | | 3 days/wk / Level 1 / Normal | 0 min | 20 min | 100 / 50 / % 0 0 0 0 0 66 0 100 | 1 / 7 | Member Back On Track |
| ★ | Motivated, Mike (Active) / (301) 222-3333 Home / Male/38 N/A | 5 Weeks 6 Workouts | 100 % / 50 % / 46 % | | 3 days/wk / Level 1 / Normal | 0 min | 20 min | 100 / 50 / % 0 0 0 200 66 0 33 100 | 1 / 5 | Member Back On Track |

120

| Status Symbol Legend | E Intro About to Expire (122) | Member On Track (124) | ? Off Track (1 wk) (126) | ! Off Track (2+ wks) (128) | ★ Back On Track (130) | + Over-Attending (132) | S Member Suspended (134) | X Member Cancelled (136) | Re-Evaluation Due (138) |
|---|---|---|---|---|---|---|---|---|---|

FIG. 14

Activtrax Demo Studio
Member Report Card
Prepared for: Gingrich, Debra
Printed on: 02/07/2006

ActivTrax
WE'VE GOT PLANS FOR YOUR BODY

YOUR MEMBER INFORMATION

Name: Gingrich, Debra
Home:* (301) 840-2145
Work:
Cell:
Gender: Female
Age: 51
Email: gingrichd@aol.com
*Preferred contact number

YOUR PROGRAM HISTORY

| Res Level | Abs Level | Days/Week | Intensity | Barbells | Start Date | End Date |
|---|---|---|---|---|---|---|
| Level Three | 7 | 3 | Normal | Yes | | |

YOUR STRENGTH EVALUATION

| Exercises | Initial Evaluation 01/17/2005 |
|---|---|
| Seated Chest Press | 90 |
| Wide Grip Pulldown (front) | 80 |
| Seated Leg Press | 250 |
| Seated Shoulder Press | 55 |
| Seated Back Extension | 138 |
| Crunch | 60 |

* Reflects increase since your initial evaluation.
** Weight values represent conversion to recommended 8-rep max and most recently used equipment and excercises.

YOUR PERSONAL GOALS PROFILE

| Member's Goals | Date | 1 | 2 | 3 | 4 | 5 | 6 | 7 | 8 | 9 | 10 |
|---|---|---|---|---|---|---|---|---|---|---|---|
| Improve Strength | 01/18/2005 | | | | | | | | | | |
| | 01/18/2005 | | | | | | | | | | |
| Increase Energy Level | 01/18/2005 | | | | | | | | | | |
| | 01/18/2005 | | | | | | | | | | |
| Lose Weight/Body Fat | 01/18/2005 | | | | | | | | | | |
| | 01/18/2005 | | | | | | | | | | |
| Shape, Tone & Define | 01/18/2005 | | | | | | | | | | |
| | 01/18/2005 | | | | | | | | | | |

YOUR MEASUREMENTS

| Date | Resting Heart Rate | Weight | % Body Fat |
|---|---|---|---|
| 01/17/2005 | 55 | 0 lbs. | 0 % |

YOUR FITNESS ANALYSIS

| Date | Upper Body Strength | Lower Body Strength | % Body Fat | Total Score |
|---|---|---|---|---|
| 01/17/2005 | No Body Weight<br>We are unable to compare your strength data because your body weight was not measured during this evaluation. | No Body Weight<br>We are unable to compare your strength data because your body weight was not measured during this evaluation. | No Data<br>We cannot compare your Body Composition data because this evaluation does not contain a measurement for it. | Needs Improvement (0%)<br>Your Total Score needs attention. You will achieve the rating of Fair when your Total Score reaches 10. |

Key: Rating (measurement, percentile)

Fig. 15A

| 150 Source Exercise | 152 Source Resistance | Weight | 154 Range | Result Exercise | Result Resistance | Coefficient | Male (lbs) | Female (lbs) |
|---|---|---|---|---|---|---|---|---|
| Bench Press | Barbell | 0 | 65 | Bench Press | Barbell | 2 | 2 | 1.5 |
| Bench Press | Barbell | 0 | 75 | Bench Press | Barbell | 2 | 2 | 1.5 |
| Bench Press | Barbell | 0 | 65 | Bench Press | Barbell | 2 | 2 | 1.5 |
| Bench Press | Barbell | 0 | 65 | Bench Press | Barbell | 1 | 2 | 1.5 |
| Bench Press | Barbell | 0 | 75 | Bench Press | Barbell | 1 | 2 | 1.5 |
| Bench Press | Barbell | 0 | 75 | Bench Press | Barbell | 2 | 2 | 1.5 |
| Bench Press | Barbell | 0 | 12 | Bench Press | Barbell | 1 | 2 | 1.5 |
| Bench Press | Barbell | 0 | 30 | Bench Press | Barbell | 2 | 2 | 1.5 |
| Bench Press | Barbell | 0 | 30 | Bench Press | Barbell | 2 | 2 | 1.5 |
| Bench Press | Barbell | 0 | 75 | Bench Press | Body Weight | 2 | 2 | 1.5 |
| Bench Press | Barbell | 0 | 65 | Bench Press | Body Weight | 2 | 2 | 1.5 |
| Bench Press | Barbell | 0 | 30 | Bench Press | Body Weight | 2 | 2 | 1.5 |
| Bench Press | Barbell | 0 | 30 | Bench Press | Body Weight | 2 | 2 | 1.5 |
| Bench Press | Barbell | 0 | 12 | Bench Press | Body Weight | 1 | 2 | 1.5 |
| Bench Press | Barbell | 0 | 75 | Bench Press | Body Weight | 2 | 2 | 1.5 |
| Bench Press | Barbell | 0 | 75 | Bench Press | Body Weight | 1 | 2 | 1.5 |
| Bench Press | Barbell | 0 | 65 | Bench Press | Body Weight | 1 | 2 | 1.5 |
| Bench Press | Barbell | 0 | 65 | Bench Press | Body Weight | 2 | 2 | 1.5 |
| Bench Press | Barbell | 0 | 65 | Bench Press | Body Weight | 2 | 2 | 1.5 |
| Bench Press | Barbell | 0 | 75 | Bench Press | Dumbbell | 2 | 2 | 1.5 |
| Bench Press | Barbell | 0 | 65 | Bench Press | Dumbbell | 2 | 2 | 1.5 |
| Bench Press | Barbell | 0 | 65 | Bench Press | Dumbbell | 1 | 2 | 1.5 |
| Bench Press | Barbell | 0 | 75 | Bench Press | Dumbbell | 1 | 2 | 1.5 |
| Bench Press | Barbell | 0 | 75 | Bench Press | Dumbbell | 2 | 2 | 1.5 |
| Bench Press | Barbell | 0 | 12 | Bench Press | Dumbbell | 1 | 2 | 1.5 |
| Bench Press | Barbell | 0 | 30 | Bench Press | Dumbbell | 2 | 2 | 1.5 |
| Bench Press | Barbell | 0 | 30 | Bench Press | Dumbbell | 2 | 2 | 1.5 |
| Bench Press | Barbell | 0 | 75 | Bench Press | Machine | 2 | 2 | 1.5 |

Fig. 15B

| Source Exercise | Source Resistance | Weight | Range | Result Exercise | Result Resistance | Coeffi-cient | Male (lbs) | Female (lbs) |
|---|---|---|---|---|---|---|---|---|
| Bench Press | Barbell | 0 | 65 | Bench Press | Machine | 2 | 2 | 1.5 |
| Bench Press | Barbell | 0 | 30 | Bench Press | Machine | 2 | 2 | 1.5 |
| Bench Press | Barbell | 0 | 30 | Bench Press | Machine | 2 | 2 | 1.5 |
| Bench Press | Barbell | 0 | 12 | Bench Press | Machine | 1 | 2 | 1.5 |
| Bench Press | Barbell | 0 | 75 | Bench Press | Machine | 2 | 2 | 1.5 |
| Bench Press | Barbell | 0 | 75 | Bench Press | Machine | 1 | 2 | 1.5 |
| Bench Press | Barbell | 0 | 65 | Bench Press | Machine | 1 | 2 | 1.5 |
| Bench Press | Barbell | 0 | 65 | Bench Press | Machine | 2 | 2 | 1.5 |
| Bench Press | Barbell | 0 | 150 | Cable Crossover | Barbell | 1.5 | 2 | 1.5 |
| Bench Press | Barbell | 0 | 150 | Cable Crossover | Barbell | 1.5 | 2 | 1.5 |
| Bench Press | Barbell | 0 | 50 | Cable Crossover | Barbell | 1.5 | 2 | 1.5 |
| Bench Press | Barbell | 0 | 50 | Cable Crossover | Body Weight | 1.5 | 2 | 1.5 |
| Bench Press | Barbell | 0 | 150 | Cable Crossover | Body Weight | 1.5 | 2 | 1.5 |
| Bench Press | Barbell | 0 | 150 | Cable Crossover | Body Weight | 1.5 | 2 | 1.5 |
| Bench Press | Barbell | 0 | 150 | Cable Crossover | Dumbbell | 1.5 | 2 | 1.5 |
| Bench Press | Barbell | 0 | 150 | Cable Crossover | Dumbbell | 1.5 | 2 | 1.5 |
| Bench Press | Barbell | 0 | 50 | Cable Crossover | Dumbbell | 1.5 | 2 | 1.5 |
| Bench Press | Barbell | 0 | 50 | Cable Crossover | Machine | 1.5 | 2 | 1.5 |
| Bench Press | Barbell | 0 | 150 | Cable Crossover | Machine | 1.5 | 2 | 1.5 |
| Bench Press | Barbell | 0 | 150 | Close Grip Bench Press | Barbell | 1.5 | 2 | 1.5 |
| Bench Press | Barbell | 0 | 65 | Close Grip Bench Press | Barbell | 2 | 5 | 2 |
| Bench Press | Barbell | 0 | 75 | Close Grip Bench Press | Barbell | 2 | 5 | 2 |
| Bench Press | Barbell | 0 | 30 | Close Grip Bench Press | Body Weight | 2 | 5 | 2 |
| Bench Press | Barbell | 0 | 30 | Close Grip Bench Press | Body Weight | 2 | 5 | 2 |
| Bench Press | Barbell | 0 | 75 | Close Grip Bench Press | Body Weight | 2 | 5 | 2 |
| Bench Press | Barbell | 0 | 65 | Close Grip Bench Press | Dumbbell | 2 | 5 | 2 |
| Bench Press | Barbell | 0 | 65 | Close Grip Bench Press | Dumbbell | 2 | 5 | 2 |
| Bench Press | Barbell | 0 | 75 | Close Grip Bench Press | Dumbbell | 2 | 5 | 2 |
| Bench Press | Barbell | 0 | 30 | Close Grip Bench Press | Dumbbell | 2 | 5 | 2 |

Fig. 15C

| Source Exercise | Source Resistance | Weight | Range | Result Exercise | Result Resistance | Coeffi-cient | Male (lbs) | Female (lbs) |
|---|---|---|---|---|---|---|---|---|
| Bench Press | Barbell | 0 | 30 | Close Grip Bench Press | Machine | 2 | 5 | 2 |
| Bench Press | Barbell | 0 | 75 | Close Grip Bench Press | Barbell | 2 | 5 | 2 |
| Bench Press | Barbell | 0 | 65 | Close Grip Bench Press | Barbell | 2 | 5 | 2 |
| Bench Press | Barbell | 0 | 65 | Decline Barbell Bench Press | Barbell | 2 | 5 | 5 |
| Bench Press | Barbell | 0 | 75 | Decline Barbell Bench Press | Barbell | 2 | 5 | 5 |
| Bench Press | Barbell | 0 | 30 | Decline Barbell Bench Press | Barbell | 2 | 5 | 5 |
| Bench Press | Barbell | 0 | 75 | Decline Barbell Bench Press | Body Weight | 2 | 5 | 5 |
| Bench Press | Barbell | 0 | 65 | Decline Barbell Bench Press | Body Weight | 2 | 5 | 5 |
| Bench Press | Barbell | 0 | 30 | Decline Barbell Bench Press | Body Weight | 2 | 5 | 5 |
| Bench Press | Barbell | 0 | 65 | Decline Barbell Bench Press | Dumbbell | 2 | 5 | 5 |
| Bench Press | Barbell | 0 | 75 | Decline Barbell Bench Press | Dumbbell | 2 | 5 | 5 |
| Bench Press | Barbell | 0 | 60 | Decline Barbell Bench Press | Dumbbell | 2 | 5 | 5 |
| Bench Press | Barbell | 0 | 75 | Decline Barbell Bench Press | Machine | 2 | 5 | 5 |
| Bench Press | Barbell | 0 | 65 | Decline Barbell Bench Press | Machine | 2 | 5 | 5 |
| Bench Press | Barbell | 0 | 30 | Decline Barbell Bench Press | Machine | 2 | 5 | 5 |
| Bench Press | Barbell | 0 | 60 | Decline Bench Press | Barbell | 2 | 0 | 0 |
| Bench Press | Barbell | 0 | 25 | Decline Bench Press | Barbell | 2 | 0 | 0 |
| Bench Press | Barbell | 0 | 60 | Decline Bench Press | Barbell | 2 | 0 | 0 |
| Bench Press | Barbell | 0 | 60 | Decline Bench Press | Body Weight | 2 | 0 | 0 |
| Bench Press | Barbell | 0 | 25 | Decline Bench Press | Body Weight | 2 | 0 | 0 |
| Bench Press | Barbell | 0 | 60 | Decline Bench Press | Body Weight | 2 | 0 | 0 |
| Bench Press | Barbell | 0 | 60 | Decline Bench Press | Dumbbell | 2 | 0 | 0 |
| Bench Press | Barbell | 0 | 25 | Decline Bench Press | Dumbbell | 2 | 0 | 0 |
| Bench Press | Barbell | 0 | 60 | Decline Bench Press | Dumbbell | 2 | 0 | 0 |
| Bench Press | Barbell | 0 | 60 | Decline Bench Press | Machine | 2 | 0 | 0 |
| Bench Press | Barbell | 0 | 25 | Decline Bench Press | Machine | 2 | 0 | 0 |
| Bench Press | Barbell | 0 | 60 | Decline Bench Press | Machine | 2 | 0 | 0 |
| Bench Press | Barbell | 0 | | Decline Dumbbell Bench Press | Machine | 1 | 2 | 1.5 |

Fig. 15D

| Source Exercise | Source Resistance | Weight | Range | Result Exercise | Result Resistance | Coeffi-cient | Male (lbs) | Female (lbs) |
|---|---|---|---|---|---|---|---|---|
| Bench Press | Barbell | 0 | 75 | Decline Dumbbell Bench Press | Barbell | 1 | 2 | 1.5 |
| Bench Press | Barbell | 0 | 65 | Decline Dumbbell Bench Press | Barbell | 1 | 2 | 1.5 |
| Bench Press | Barbell | 0 | 75 | Decline Dumbbell Bench Press | Body Weight | 1 | 2 | 1.5 |
| Bench Press | Barbell | 0 | 65 | Decline Dumbbell Bench Press | Body Weight | 1 | 2 | 1.5 |
| Bench Press | Barbell | 0 | 12 | Decline Dumbbell Bench Press | Body Weight | 1 | 2 | 1.5 |
| Bench Press | Barbell | 0 | 12 | Decline Dumbbell Bench Press | Dumbbell | 1 | 2 | 1.5 |
| Bench Press | Barbell | 0 | 75 | Decline Dumbbell Bench Press | Dumbbell | 1 | 2 | 1.5 |
| Bench Press | Barbell | 0 | 65 | Decline Dumbbell Bench Press | Dumbbell | 1 | 2 | 1.5 |
| Bench Press | Barbell | 0 | 65 | Decline Dumbbell Bench Press | Machine | 1 | 2 | 1.5 |
| Bench Press | Barbell | 0 | 75 | Decline Dumbbell Bench Press | Machine | 1 | 2 | 1.5 |
| Bench Press | Barbell | 0 | 12 | Decline Dumbbell Bench Press | Machine | 1 | 2 | 1.5 |
| Bench Press | Barbell | 0 | 15 | Decline Dumbbell Fly | Barbell | 1 | 2 | 1.5 |
| Bench Press | Barbell | 0 | 80 | Decline Dumbbell Fly | Barbell | 1 | 2 | 1.5 |
| Bench Press | Barbell | 0 | 75 | Decline Dumbbell Fly | Barbell | 1 | 2 | 1.5 |
| Bench Press | Barbell | 0 | 75 | Decline Dumbbell Fly | Body Weight | 1 | 2 | 1.5 |
| Bench Press | Barbell | 0 | 80 | Decline Dumbbell Fly | Body Weight | 1 | 2 | 1.5 |
| Bench Press | Barbell | 0 | 15 | Decline Dumbbell Fly | Body Weight | 1 | 2 | 1.5 |
| Bench Press | Barbell | 0 | 15 | Decline Dumbbell Fly | Dumbbell | 1 | 2 | 1.5 |

Fig. 15E

| Source Exercise | Source Resistance | Weight | Range | Result Exercise | Result Resistance | Coeffi-cient | Male (lbs) | Female (lbs) |
|---|---|---|---|---|---|---|---|---|
| Bench Press | Barbell | 0 | 80 | Decline Dumbbell Fly | Dumbbell | 1 | 2 | 1.5 |
| Bench Press | Barbell | 0 | 75 | Decline Dumbbell Fly | Dumbbell | 1 | 2 | 1.5 |
| Bench Press | Barbell | 0 | 75 | Decline Dumbbell Fly | Machine | 1 | 2 | 1.5 |
| Bench Press | Barbell | 0 | 80 | Decline Dumbbell Fly | Machine | 1 | 2 | 1.5 |
| Bench Press | Barbell | 0 | 15 | Decline Dumbbell Fly | Machine | 1 | 2 | 1.5 |
| Bench Press | Barbell | 0 | 15 | Fly | Barbell | 1 | 2 | 1.5 |
| Bench Press | Barbell | 0 | 75 | Fly | Barbell | 1 | 2 | 1.5 |
| Bench Press | Barbell | 0 | 65 | Fly | Barbell | 1 | 2 | 1.5 |
| Bench Press | Barbell | 0 | 65 | Fly | Body Weight | 1 | 2 | 1.5 |
| Bench Press | Barbell | 0 | 75 | Fly | Body Weight | 1 | 2 | 1.5 |
| Bench Press | Barbell | 0 | 15 | Fly | Body Weight | 1 | 2 | 1.5 |
| Bench Press | Barbell | 0 | 15 | Fly | Dumbbell | 1 | 2 | 1.5 |
| Bench Press | Barbell | 0 | 75 | Fly | Dumbbell | 1 | 2 | 1.5 |
| Bench Press | Barbell | 0 | 65 | Fly | Dumbbell | 1 | 2 | 1.5 |
| Bench Press | Barbell | 0 | 65 | Fly | Machine | 1 | 2 | 1.5 |
| Bench Press | Barbell | 0 | 75 | Fly | Machine | 1 | 2 | 1.5 |
| Bench Press | Barbell | 0 | 15 | Fly | Machine | 1 | 2 | 1.5 |
| Bench Press | Barbell | 0 | 40 | Incline Barbell Bench Press | Barbell | 2 | 5 | 2 |
| Bench Press | Barbell | 0 | 65 | Incline Barbell Bench Press | Barbell | 1.5 | 5 | 2 |
| Bench Press | Barbell | 0 | 75 | Incline Barbell Bench Press | Barbell | 1.5 | 5 | 2 |
| Bench Press | Barbell | 0 | 75 | Incline Barbell Bench Press | Body Weight | 1.5 | 5 | 2 |
| Bench Press | Barbell | 0 | 65 | Incline Barbell Bench Press | Body Weight | 1.5 | 5 | 2 |
| Bench Press | Barbell | 0 | 40 | Incline Barbell Bench Press | Body Weight | 2 | 5 | 2 |
| Bench Press | Barbell | 0 | 40 | Incline Barbell Bench Press | Dumbbell | 2 | 5 | 2 |
| Bench Press | Barbell | 0 | 65 | Incline Barbell Bench Press | Dumbbell | 1.5 | 5 | 2 |
| Bench Press | Barbell | 0 | 75 | Incline Barbell Bench Press | Dumbbell | 1.5 | 5 | 2 |
| Bench Press | Barbell | 0 | 75 | Incline Barbell Bench Press | Machine | 1.5 | 5 | 2 |
| Bench Press | Barbell | 0 | 65 | Incline Barbell Bench Press | Machine | 1.5 | 5 | 2 |
| | | | 40 | Incline Barbell Bench Press | Machine | 2 | 5 | 2 |

Fig. 15F

| Source Exercise | Source Resistance | Weight | Range | Result Exercise | Result Resistance | Coeffi-cient | Male (lbs) | Female (lbs) |
|---|---|---|---|---|---|---|---|---|
| Bench Press | Barbell | 0 | 15 | Incline Bench Press | Barbell | 1 | 2 | 1.5 |
| Bench Press | Barbell | 0 | 40 | Incline Bench Press | Barbell | 2 | 2 | 1.5 |
| Bench Press | Barbell | 0 | 75 | Incline Bench Press | Barbell | 1 | 2 | 1.5 |
| Bench Press | Barbell | 0 | 75 | Incline Bench Press | Barbell | 2 | 2 | 1.5 |
| Bench Press | Barbell | 0 | 65 | Incline Bench Press | Barbell | 1 | 2 | 1.5 |
| Bench Press | Barbell | 0 | 65 | Incline Bench Press | Barbell | 2 | 2 | 1.5 |
| Bench Press | Barbell | 0 | 65 | Incline Bench Press | Body Weight | 2 | 2 | 1.5 |
| Bench Press | Barbell | 0 | 65 | Incline Bench Press | Body Weight | 1 | 2 | 1.5 |
| Bench Press | Barbell | 0 | 75 | Incline Bench Press | Body Weight | 2 | 2 | 1.5 |
| Bench Press | Barbell | 0 | 75 | Incline Bench Press | Body Weight | 1 | 2 | 1.5 |
| Bench Press | Barbell | 0 | 40 | Incline Bench Press | Body Weight | 2 | 2 | 1.5 |
| Bench Press | Barbell | 0 | 15 | Incline Bench Press | Body Weight | 1 | 2 | 1.5 |
| Bench Press | Barbell | 0 | 15 | Incline Bench Press | Dumbbell | 1 | 2 | 1.5 |
| Bench Press | Barbell | 0 | 40 | Incline Bench Press | Dumbbell | 2 | 2 | 1.5 |
| Bench Press | Barbell | 0 | 75 | Incline Bench Press | Dumbbell | 1 | 2 | 1.5 |
| Bench Press | Barbell | 0 | 75 | Incline Bench Press | Dumbbell | 2 | 2 | 1.5 |
| Bench Press | Barbell | 0 | 65 | Incline Bench Press | Dumbbell | 1 | 2 | 1.5 |
| Bench Press | Barbell | 0 | 65 | Incline Bench Press | Dumbbell | 2 | 2 | 1.5 |
| Bench Press | Barbell | 0 | 65 | Incline Bench Press | Machine | 2 | 2 | 1.5 |
| Bench Press | Barbell | 0 | 65 | Incline Bench Press | Machine | 1 | 2 | 1.5 |
| Bench Press | Barbell | 0 | 75 | Incline Bench Press | Machine | 2 | 2 | 1.5 |
| Bench Press | Barbell | 0 | 75 | Incline Bench Press | Machine | 1 | 2 | 1.5 |
| Bench Press | Barbell | 0 | 40 | Incline Bench Press | Machine | 2 | 2 | 1.5 |
| Bench Press | Barbell | 0 | 15 | Incline Bench Press | Machine | 1 | 2 | 1.5 |
| Bench Press | Barbell | 0 | 40 | Incline Chest Press | Barbell | 2 | 5 | 2 |
| Bench Press | Barbell | 0 | 75 | Incline Chest Press | Barbell | 2 | 5 | 2 |
| Bench Press | Barbell | 0 | 65 | Incline Chest Press | Barbell | 2 | 5 | 2 |
| Bench Press | Barbell | 0 | 65 | Incline Chest Press | Body Weight | 2 | 5 | 2 |
| Bench Press | Barbell | 0 | 75 | Incline Chest Press | Body Weight | 2 | 5 | 2 |

Fig. 15G

| Source Exercise | Source Resistance | Weight | Range | Result Exercise | Result Resistance | Coeffi-cient | Male (lbs) | Female (lbs) |
|---|---|---|---|---|---|---|---|---|
| Bench Press | Barbell | 0 | 40 | Incline Chest Press | Body Weight | 2 | 5 | 2 |
| Bench Press | Barbell | 0 | 40 | Incline Chest Press | Dumbbell | 2 | 5 | 2 |
| Bench Press | Barbell | 0 | 75 | Incline Chest Press | Dumbbell | 2 | 5 | 2 |
| Bench Press | Barbell | 0 | 65 | Incline Chest Press | Dumbbell | 2 | 5 | 2 |
| Bench Press | Barbell | 0 | 65 | Incline Chest Press | Machine | 2 | 5 | 2 |
| Bench Press | Barbell | 0 | 75 | Incline Chest Press | Machine | 2 | 5 | 2 |
| Bench Press | Barbell | 0 | 40 | Incline Chest Press | Machine | 2 | 5 | 2 |
| Bench Press | Barbell | 0 | 15 | Incline Fly | Barbell | 1 | 2 | 1.5 |
| Bench Press | Barbell | 0 | 80 | Incline Fly | Barbell | 1 | 2 | 1.5 |
| Bench Press | Barbell | 0 | 75 | Incline Fly | Barbell | 1 | 2 | 1.5 |
| Bench Press | Barbell | 0 | 75 | Incline Fly | Body Weight | 1 | 2 | 1.5 |
| Bench Press | Barbell | 0 | 80 | Incline Fly | Body Weight | 1 | 2 | 1.5 |
| Bench Press | Barbell | 0 | 15 | Incline Fly | Body Weight | 1 | 2 | 1.5 |
| Bench Press | Barbell | 0 | 15 | Incline Fly | Dumbbell | 1 | 2 | 1.5 |
| Bench Press | Barbell | 0 | 80 | Incline Fly | Dumbbell | 1 | 2 | 1.5 |
| Bench Press | Barbell | 0 | 75 | Incline Fly | Dumbbell | 1 | 2 | 1.5 |
| Bench Press | Barbell | 0 | 75 | Incline Fly | Machine | 1 | 2 | 1.5 |
| Bench Press | Barbell | 0 | 80 | Incline Fly | Machine | 1 | 2 | 1.5 |
| Bench Press | Barbell | 0 | 15 | Incline Fly | Machine | 1 | 2 | 1.5 |
| Bench Press | Barbell | 0 | 65 | Lying Chest Press | Barbell | 2 | 0 | 0 |
| Bench Press | Barbell | 0 | 30 | Lying Chest Press | Barbell | 2 | 0 | 0 |
| Bench Press | Barbell | 0 | 75 | Lying Chest Press | Barbell | 2 | 0 | 0 |
| Bench Press | Barbell | 0 | 75 | Lying Chest Press | Body Weight | 2 | 0 | 0 |
| Bench Press | Barbell | 0 | 30 | Lying Chest Press | Body Weight | 2 | 0 | 0 |
| Bench Press | Barbell | 0 | 65 | Lying Chest Press | Body Weight | 2 | 0 | 0 |
| Bench Press | Barbell | 0 | 65 | Lying Chest Press | Dumbbell | 2 | 0 | 0 |
| Bench Press | Barbell | 0 | 30 | Lying Chest Press | Dumbbell | 2 | 0 | 0 |
| Bench Press | Barbell | 0 | 75 | Lying Chest Press | Dumbbell | 2 | 0 | 0 |
| | | | 75 | Lying Chest Press | Machine | 2 | 0 | 0 |

Fig. 15H

| Source Exercise | Source Resistance | Weight | Range | Result Exercise | Result Resistance | Coeffi-cient | Male (lbs) | Female (lbs) |
|---|---|---|---|---|---|---|---|---|
| Bench Press | Barbell | 0 | 30 | Lying Chest Press | Machine | 2 | 0 | 2 |
| Bench Press | Barbell | 0 | 65 | Lying Chest Press | Machine | 2 | 0 | 0 |
| Bench Press | Barbell | 0 | 65 | Lying Extension | Barbell | 1 | 2 | 1.5 |
| Bench Press | Barbell | 0 | 75 | Lying Extension | Barbell | 1 | 2 | 1.5 |
| Bench Press | Barbell | 0 | 40 | Lying Extension | Barbell | 2 | 2 | 1.5 |
| Bench Press | Barbell | 0 | 20 | Lying Extension | Barbell | 1 | 2 | 1.5 |
| Bench Press | Barbell | 0 | 75 | Lying Extension | Barbell | 1.5 | 2 | 1.5 |
| Bench Press | Barbell | 0 | 65 | Lying Extension | Barbell | 1.5 | 2 | 1.5 |
| Bench Press | Barbell | 0 | 75 | Lying Extension | Body Weight | 1 | 2 | 1.5 |
| Bench Press | Barbell | 0 | 65 | Lying Extension | Body Weight | 1 | 2 | 1.5 |
| Bench Press | Barbell | 0 | 20 | Lying Extension | Body Weight | 1 | 2 | 1.5 |
| Bench Press | Barbell | 0 | 40 | Lying Extension | Body Weight | 2 | 2 | 1.5 |
| Bench Press | Barbell | 0 | 65 | Lying Extension | Body Weight | 1.5 | 2 | 1.5 |
| Bench Press | Barbell | 0 | 75 | Lying Extension | Body Weight | 1.5 | 2 | 1.5 |
| Bench Press | Barbell | 0 | 65 | Lying Extension | Dumbbell | 1 | 2 | 1.5 |
| Bench Press | Barbell | 0 | 75 | Lying Extension | Dumbbell | 1 | 2 | 1.5 |
| Bench Press | Barbell | 0 | 4 | Lying Extension | Dumbbell | 2 | 2 | 1.5 |
| Bench Press | Barbell | 0 | 20 | Lying Extension | Dumbbell | 1 | 2 | 1.5 |
| Bench Press | Barbell | 0 | 75 | Lying Extension | Dumbbell | 1.5 | 2 | 1.5 |
| Bench Press | Barbell | 0 | 65 | Lying Extension | Dumbbell | 1.5 | 2 | 1.5 |
| Bench Press | Barbell | 0 | 75 | Lying Extension | Machine | 1 | 2 | 1.5 |
| Bench Press | Barbell | 0 | 65 | Lying Extension | Machine | 1 | 2 | 1.5 |
| Bench Press | Barbell | 0 | 20 | Lying Extension | Machine | 1 | 2 | 1.5 |
| Bench Press | Barbell | 0 | 40 | Lying Extension | Machine | 2 | 2 | 1.5 |
| Bench Press | Barbell | 0 | 65 | Pec Fly | Machine | 1.5 | 2 | 1.5 |
| Bench Press | Barbell | 0 | 75 | Pec Fly | Machine | 1.5 | 2 | 1.5 |
| Bench Press | Barbell | 0 | 40 | Lying Chest Press | Barbell | 1.5 | 2 | 1.5 |
| Bench Press | Barbell | 0 | 75 | Lying Chest Press | Barbell | 1.5 | 2 | 1.5 |
| Bench Press | Barbell | 0 | 65 | Lying Chest Press | Barbell | 1.5 | 2 | 1.5 |

Fig. 15-I

| Source Exercise | Source Resistance | Weight | Range | Result Exercise | Result Resistance | Coeffi-cient | Male (lbs) | Female (lbs) |
|---|---|---|---|---|---|---|---|---|
| Bench Press | Barbell | 0 | 40 | Pec Fly | Body Weight | 1.5 | 2 | 2 |
| Bench Press | Barbell | 0 | 65 | Pec Fly | Body Weight | 1.5 | 2 | 2 |
| Bench Press | Barbell | 0 | 75 | Pec Fly | Body Weight | 1.5 | 2 | 2 |
| Bench Press | Barbell | 0 | 40 | Pec Fly | Dumbbell | 1.5 | 2 | 2 |
| Bench Press | Barbell | 0 | 75 | Pec Fly | Dumbbell | 1.5 | 2 | 2 |
| Bench Press | Barbell | 0 | 65 | Pec Fly | Dumbbell | 1.5 | 2 | 2 |
| Bench Press | Barbell | 0 | 75 | Pec Fly | Machine | 1.5 | 2 | 2 |
| Bench Press | Barbell | 0 | 20 | Pec Fly | Machine | 1.5 | 2 | 2 |
| Bench Press | Barbell | 0 | 75 | Pec Fly | Machine | 1.5 | 2 | 2 |
| Bench Press | Barbell | 0 | 20 | Reverse Grip Pushdown | Barbell | 1 | 5 | 2 |
| Bench Press | Barbell | 0 | 75 | Reverse Grip Pushdown | Barbell | 1.5 | 5 | 2 |
| Bench Press | Barbell | 0 | 65 | Reverse Grip Pushdown | Barbell | 1.5 | 5 | 2 |
| Bench Press | Barbell | 0 | 20 | Reverse Grip Pushdown | Body Weight | 1 | 5 | 2 |
| Bench Press | Barbell | 0 | 65 | Reverse Grip Pushdown | Body Weight | 1.5 | 5 | 2 |
| Bench Press | Barbell | 0 | 75 | Reverse Grip Pushdown | Body Weight | 1.5 | 5 | 2 |
| Bench Press | Barbell | 0 | 20 | Reverse Grip Pushdown | Dumbbell | 1 | 5 | 2 |
| Bench Press | Barbell | 0 | 75 | Reverse Grip Pushdown | Dumbbell | 1.5 | 5 | 2 |
| Bench Press | Barbell | 0 | 65 | Reverse Grip Pushdown | Dumbbell | 1.5 | 5 | 2 |
| Bench Press | Barbell | 0 | 20 | Reverse Grip Pushdown | Machine | 1 | 5 | 2 |
| Bench Press | Barbell | 0 | 65 | Reverse Grip Pushdown | Machine | 1.5 | 5 | 2 |
| Bench Press | Barbell | 0 | 75 | Reverse Grip Pushdown | Machine | 1.5 | 5 | 2 |
| Bench Press | Barbell | 0 | 20 | Rope Pushdown | Barbell | 1 | 5 | 2 |
| Bench Press | Barbell | 0 | 75 | Rope Pushdown | Barbell | 1.5 | 5 | 2 |
| Bench Press | Barbell | 0 | 65 | Rope Pushdown | Barbell | 1.5 | 5 | 2 |
| Bench Press | Barbell | 0 | 20 | Rope Pushdown | Body Weight | 1 | 5 | 2 |
| Bench Press | Barbell | 0 | 65 | Rope Pushdown | Body Weight | 1.5 | 5 | 2 |
| Bench Press | Barbell | 0 | 75 | Rope Pushdown | Body Weight | 1.5 | 5 | 2 |
| Bench Press | Barbell | 0 | 20 | Rope Pushdown | Dumbbell | 1 | 5 | 2 |
| Bench Press | Barbell | 0 | 75 | Rope Pushdown | Dumbbell | 1.5 | 5 | 2 |

Fig. 15J

| Source Exercise | Source Resistance | Weight | Range | Result Exercise | Result Resistance | Coeffi-cient | Male (lbs) | Female (lbs) |
|---|---|---|---|---|---|---|---|---|
| Bench Press | Barbell | 0 | 65 | Rope Pushdown | Dumbbell | 1.5 | 5 | 2 |
| Bench Press | Barbell | 0 | 20 | Rope Pushdown | Machine | 1 | 5 | 2 |
| Bench Press | Barbell | 0 | 65 | Rope Pushdown | Machine | 1.5 | 5 | 2 |
| Bench Press | Barbell | 0 | 75 | Rope Pushdown | Machine | 1.5 | 5 | 2 |
| Bench Press | Barbell | 0 | 30 | Seated Chest Press | Barbell | 2 | 5 | 5 |
| Bench Press | Barbell | 0 | 75 | Seated Chest Press | Barbell | 2 | 5 | 5 |
| Bench Press | Barbell | 0 | 65 | Seated Chest Press | Barbell | 2 | 5 | 5 |
| Bench Press | Barbell | 0 | 30 | Seated Chest Press | Body Weight | 2 | 5 | 5 |
| Bench Press | Barbell | 0 | 65 | Seated Chest Press | Body Weight | 2 | 5 | 5 |
| Bench Press | Barbell | 0 | 75 | Seated Chest Press | Body Weight | 2 | 5 | 5 |
| Bench Press | Barbell | 0 | 30 | Seated Chest Press | Dumbbell | 2 | 5 | 5 |
| Bench Press | Barbell | 0 | 75 | Seated Chest Press | Dumbbell | 2 | 5 | 5 |
| Bench Press | Barbell | 0 | 65 | Seated Chest Press | Dumbbell | 2 | 5 | 5 |
| Bench Press | Barbell | 0 | 30 | Seated Chest Press | Machine | 2 | 5 | 5 |
| Bench Press | Barbell | 0 | 65 | Seated Chest Press | Machine | 2 | 5 | 5 |
| Bench Press | Barbell | 0 | 75 | Seated Chest Press | Machine | 2 | 5 | 5 |
| Bench Press | Barbell | 0 | 40 | Seated Dip | Barbell | 2 | 5 | 5 |
| Bench Press | Barbell | 0 | 75 | Seated Dip | Barbell | 1.5 | 5 | 5 |
| Bench Press | Barbell | 0 | 65 | Seated Dip | Barbell | 1.5 | 5 | 5 |
| Bench Press | Barbell | 0 | 40 | Seated Dip | Body Weight | 2 | 5 | 5 |
| Bench Press | Barbell | 0 | 75 | Seated Dip | Body Weight | 1.5 | 5 | 5 |
| Bench Press | Barbell | 0 | 65 | Seated Dip | Body Weight | 1.5 | 5 | 5 |
| Bench Press | Barbell | 0 | 40 | Seated Dip | Dumbbell | 2 | 5 | 5 |
| Bench Press | Barbell | 0 | 75 | Seated Dip | Dumbbell | 1.5 | 5 | 5 |
| Bench Press | Barbell | 0 | 65 | Seated Dip | Dumbbell | 1.5 | 5 | 5 |
| Bench Press | Barbell | 0 | 40 | Seated Dip | Machine | 2 | 5 | 5 |
| Bench Press | Barbell | 0 | 65 | Seated Dip | Machine | 1.5 | 5 | 5 |
| Bench Press | Barbell | 0 | 75 | Seated Dip | Machine | 1.5 | 5 | 5 |
| Bench Press | Barbell | 0 | 25 | Seated Overhead Extension | Barbell | 1 | 0 | 0 |

Fig. 15K

| Source Exercise | Source Resistance | Weight | Range | Result Exercise | Result Resistance | Coeffi-cient | Male (lbs) | Female (lbs) |
|---|---|---|---|---|---|---|---|---|
| Bench Press | Barbell | 0 | 75 | 1-(DB) Seated Overhead Extension | Barbell | 1 | 0 | 0 |
| Bench Press | Barbell | 0 | 65 | 1-(DB) Seated Overhead Extension | Barbell | 1 | 0 | 0 |
| Bench Press | Barbell | 0 | 25 | 1-(DB) Seated Overhead Extension | Body Weight | 1 | 0 | 0 |
| Bench Press | Barbell | 0 | 65 | 1-(DB) Seated Overhead Extension | Body Weight | 1 | 0 | 0 |
| Bench Press | Barbell | 0 | 75 | 1-(DB) Seated Overhead Extension | Body Weight | 1 | 0 | 0 |
| Bench Press | Barbell | 0 | 25 | 1-(DB) Seated Overhead Extension | Dumbbell | 1 | 0 | 0 |
| Bench Press | Barbell | 0 | 75 | 1-(DB) Seated Overhead Extension | Dumbbell | 1 | 0 | 0 |
| Bench Press | Barbell | 0 | 65 | 1-(DB) Seated Overhead Extension | Dumbbell | 1 | 0 | 0 |
| Bench Press | Barbell | 0 | 25 | 1-(DB) Seated Overhead Extension | Machine | 1 | 0 | 0 |
| Bench Press | Barbell | 0 | 65 | 1-(DB) Seated Overhead Extension | Machine | 1 | 0 | 0 |
| Bench Press | Barbell | 0 | 75 | 1-(DB) Seated Overhead Extension | Machine | 1 | 0 | 0 |
| Bench Press | Barbell | 0 | 25 | Seated Tricep Extension | Barbell | 1 | 5 | 2 |
| Bench Press | Barbell | 0 | 75 | Seated Tricep Extension | Barbell | 1 | 5 | 2 |
| Bench Press | Barbell | 0 | 65 | Seated Tricep Extension | Barbell | 1 | 5 | 2 |
| Bench Press | Barbell | 0 | 25 | Seated Tricep Extension | Body Weight | 1 | 5 | 2 |
| Bench Press | Barbell | 0 | 65 | Seated Tricep Extension | Body Weight | 1 | 5 | 2 |
| Bench Press | Barbell | 0 | 75 | Seated Tricep Extension | Body Weight | 1 | 5 | 2 |

Fig. 15L

| Source Exercise | Source Resistance | Weight | Range | Result Exercise | Result Resistance | Coeffi-cient | Male (lbs) | Female (lbs) |
|---|---|---|---|---|---|---|---|---|
| Bench Press | Barbell | 0 | 25 | Seated Tricep Extension | Dumbbell | 1 | 5 | 2 |
| Bench Press | Barbell | 0 | 75 | Seated Tricep Extension | Dumbbell | 1 | 5 | 2 |
| Bench Press | Barbell | 0 | 65 | Seated Tricep Extension | Dumbbell | 1 | 5 | 2 |
| Bench Press | Barbell | 0 | 25 | Seated Tricep Extension | Machine | 1 | 5 | 2 |
| Bench Press | Barbell | 0 | 65 | Seated Tricep Extension | Machine | 1 | 5 | 2 |
| Bench Press | Barbell | 0 | 75 | Seated Tricep Extension | Machine | 1 | 5 | 2 |
| Bench Press | Barbell | 0 | 20 | Straight Bar Pushdown | Barbell | 1 | 5 | 2 |
| Bench Press | Barbell | 0 | 75 | Straight Bar Pushdown | Barbell | 1.5 | 5 | 2 |
| Bench Press | Barbell | 0 | 65 | Straight Bar Pushdown | Barbell | 1.5 | 5 | 2 |
| Bench Press | Barbell | 0 | 20 | Straight Bar Pushdown | Body Weight | 1 | 5 | 2 |
| Bench Press | Barbell | 0 | 75 | Straight Bar Pushdown | Body Weight | 1.5 | 5 | 2 |
| Bench Press | Barbell | 0 | 65 | Straight Bar Pushdown | Body Weight | 1.5 | 5 | 2 |
| Bench Press | Barbell | 0 | 20 | Straight Bar Pushdown | Dumbbell | 1 | 5 | 2 |
| Bench Press | Barbell | 0 | 65 | Straight Bar Pushdown | Dumbbell | 1.5 | 5 | 2 |
| Bench Press | Barbell | 0 | 75 | Straight Bar Pushdown | Dumbbell | 1.5 | 5 | 2 |
| Bench Press | Barbell | 0 | 20 | Straight Bar Pushdown | Machine | 1 | 5 | 2 |
| Bench Press | Barbell | 0 | 65 | Straight Bar Pushdown | Machine | 1.5 | 5 | 2 |
| Bench Press | Barbell | 0 | 75 | Straight Bar Pushdown | Machine | 1.5 | 5 | 2 |
| Bench Press | Barbell | 0 | 20 | V-Bar Pushdown | Barbell | 1 | 5 | 2 |
| Bench Press | Barbell | 0 | 75 | V-Bar Pushdown | Barbell | 1.5 | 5 | 2 |
| Bench Press | Barbell | 0 | 65 | V-Bar Pushdown | Barbell | 1.5 | 5 | 2 |
| Bench Press | Barbell | 0 | 20 | V-Bar Pushdown | Body Weight | 1 | 5 | 2 |
| Bench Press | Barbell | 0 | 65 | V-Bar Pushdown | Body Weight | 1.5 | 5 | 2 |
| Bench Press | Barbell | 0 | 75 | V-Bar Pushdown | Body Weight | 1.5 | 5 | 2 |
| Bench Press | Barbell | 0 | 20 | V-Bar Pushdown | Dumbbell | 1 | 5 | 2 |
| Bench Press | Barbell | 0 | 75 | V-Bar Pushdown | Dumbbell | 1.5 | 5 | 2 |
| Bench Press | Barbell | 0 | 65 | V-Bar Pushdown | Body Weight | 1.5 | 5 | 2 |
| Bench Press | Barbell | 0 | 20 | V-Bar Pushdown | Machine | 1 | 5 | 2 |
| Bench Press | Barbell | 0 | 65 | V-Bar Pushdown | Machine | 1.5 | 5 | 2 |

Fig. 15M

| Source Exercise | Source Resistance | Weight | Range | Result Exercise | Result Resistance | Coeffi-cient | Male (lbs) | Female (lbs) |
|---|---|---|---|---|---|---|---|---|
| Bench Press | Barbell | 0 | 75 | V-Bar Pushdown | Machine | 1.5 | 5 | 2 |
| Bench Press | Barbell | 0 | 30 | Wide Chest Press | Barbell | 2 | 5 | 5 |
| Bench Press | Barbell | 0 | 75 | Wide Chest Press | Barbell | 2 | 5 | 5 |
| Bench Press | Barbell | 0 | 65 | Wide Chest Press | Barbell | 2 | 5 | 5 |
| Bench Press | Barbell | 0 | 30 | Wide Chest Press | Body Weight | 2 | 5 | 5 |
| Bench Press | Barbell | 0 | 65 | Wide Chest Press | Body Weight | 2 | 5 | 5 |
| Bench Press | Barbell | 0 | 75 | Wide Chest Press | Body Weight | 2 | 5 | 5 |
| Bench Press | Barbell | 0 | 30 | Wide Chest Press | Dumbbell | 2 | 5 | 5 |
| Bench Press | Barbell | 0 | 75 | Wide Chest Press | Dumbbell | 2 | 5 | 5 |
| Bench Press | Barbell | 0 | 65 | Wide Chest Press | Dumbbell | 2 | 5 | 5 |
| Bench Press | Barbell | 0 | 30 | Wide Chest Press | Machine | 2 | 5 | 5 |
| Bench Press | Barbell | 0 | 65 | Wide Chest Press | Machine | 2 | 5 | 5 |
| Bench Press | Barbell | 0 | 75 | Wide Chest Press | Machine | 2 | 5 | 5 |
| Bench Press | Barbell | 13 | 25 | Bench Press | Barbell | 1.5 | 2 | 1.5 |
| Bench Press | Barbell | 13 | 25 | Bench Press | Body Weight | 1.5 | 2 | 1.5 |
| Bench Press | Barbell | 13 | 25 | Bench Press | Dumbbell | 1.5 | 2 | 1.5 |
| Bench Press | Barbell | 13 | 25 | Bench Press | Machine | 1.5 | 2 | 1.5 |
| Bench Press | Barbell | 13 | 25 | Decline Dumbbell Bench Press | Barbell | 1.5 | 2 | 1.5 |
| Bench Press | Barbell | 13 | 25 | Decline Dumbbell Bench Press | Body Weight | 1.5 | 2 | 1.5 |
| Bench Press | Barbell | 13 | 25 | Decline Dumbbell Bench Press | Dumbbell | 1.5 | 2 | 1.5 |
| Bench Press | Barbell | 13 | 25 | Decline Dumbbell Bench Press | Machine | 1.5 | 2 | 1.5 |
| Bench Press | Barbell | 16 | 30 | Decline Dumbbell Fly | Barbell | 1.5 | 2 | 1.5 |
| Bench Press | Barbell | 16 | 30 | Decline Dumbbell Fly | Body Weight | 1.5 | 2 | 1.5 |
| Bench Press | Barbell | 16 | 30 | Decline Dumbbell Fly | Dumbbell | 1.5 | 2 | 1.5 |
| Bench Press | Barbell | 16 | 30 | Decline Dumbbell Fly | Machine | 1.5 | 2 | 1.5 |

Fig. 15N

| Source Exercise | Source Resistance | Weight | Range | Result Exercise | Result Resistance | Coefficient | Male (lbs) | Female (lbs) |
|---|---|---|---|---|---|---|---|---|
| Bench Press | Barbell | 16 | 25 | Fly | Barbell | 1.5 | 2 | 1.5 |
| Bench Press | Barbell | 16 | 25 | Fly | Body Weight | 1.5 | 2 | 1.5 |
| Bench Press | Barbell | 16 | 25 | Fly | Dumbbell | 1.5 | 2 | 1.5 |
| Bench Press | Barbell | 16 | 25 | Fly | Machine | 1.5 | 2 | 1.5 |
| Bench Press | Barbell | 16 | 16 | Incline Bench Press | Barbell | 1.5 | 2 | 1.5 |
| Bench Press | Barbell | 16 | 16 | Incline Bench Press | Body Weight | 1.5 | 2 | 1.5 |
| Bench Press | Barbell | 16 | 16 | Incline Bench Press | Dumbbell | 1.5 | 2 | 1.5 |
| Bench Press | Barbell | 16 | 16 | Incline Bench Press | Machine | 1.5 | 2 | 1.5 |
| Bench Press | Barbell | 16 | 16 | Incline Fly | Barbell | 1.5 | 2 | 1.5 |
| Bench Press | Barbell | 16 | 16 | Incline Fly | Body Weight | 1.5 | 2 | 1.5 |
| Bench Press | Barbell | 16 | 16 | Incline Fly | Dumbbell | 1.5 | 2 | 1.5 |
| Bench Press | Barbell | 16 | 16 | Incline Fly | Machine | 1.5 | 2 | 1.5 |
| Bench Press | Barbell | 21 | 35 | Lying Extension | Barbell | 1.5 | 2 | 1.5 |
| Bench Press | Barbell | 21 | 35 | Lying Extension | Body Weight | 1.5 | 2 | 1.5 |
| Bench Press | Barbell | 21 | 35 | Lying Extension | Dumbbell | 1.5 | 2 | 1.5 |
| Bench Press | Barbell | 21 | 35 | Lying Extension | Machine | 1.5 | 2 | 1.5 |
| Bench Press | Barbell | 21 | 40 | Reverse Grip Pushdown | Barbell | 1.5 | 5 | 2 |
| Bench Press | Barbell | 21 | 40 | Reverse Grip Pushdown | Body Weight | 1.5 | 5 | 2 |
| Bench Press | Barbell | 21 | 40 | Reverse Grip Pushdown | Dumbbell | 1.5 | 5 | 2 |
| Bench Press | Barbell | 21 | 40 | Reverse Grip Pushdown | Machine | 1.5 | 5 | 2 |
| Bench Press | Barbell | 21 | 40 | Rope Pushdown | Barbell | 1.5 | 5 | 2 |
| Bench Press | Barbell | 21 | 40 | Rope Pushdown | Body Weight | 1.5 | 5 | 2 |
| Bench Press | Barbell | 21 | 40 | Rope Pushdown | Dumbbell | 1.5 | 5 | 2 |
| Bench Press | Barbell | 21 | 40 | Rope Pushdown | Machine | 1.5 | 5 | 2 |
| Bench Press | Barbell | 21 | 40 | Straight Bar Pushdown | Barbell | 1.5 | 5 | 2 |
| Bench Press | Barbell | 21 | 40 | Straight Bar Pushdown | Body Weight | 1.5 | 5 | 2 |
| Bench Press | Barbell | 21 | 40 | Straight Bar Pushdown | Dumbbell | 1.5 | 5 | 2 |
| Bench Press | Barbell | 21 | 40 | Straight Bar Pushdown | Machine | 1.5 | 5 | 2 |
| Bench Press | Barbell | 21 | 40 | V-Bar Pushdown | Barbell | 1.5 | 5 | 2 |

Fig. 15-O

| Source Exercise | Source Resistance | Weight | Range | Result Exercise | Result Resistance | Coeffi-cient | Male (lbs) | Female (lbs) |
|---|---|---|---|---|---|---|---|---|
| Bench Press | Barbell | 21 | 40 | V-Bar Pushdown | Body Weight | 1.5 | 5 | 2 |
| Bench Press | Barbell | 21 | 40 | V-Bar Pushdown | Dumbbell | 1.5 | 5 | 2 |
| Bench Press | Barbell | 21 | 40 | V-Bar Pushdown | Machine | 1.5 | 5 | 2 |
| Bench Press | Barbell | 26 | 45 | Bench Press | Barbell | 2 | 2 | 1.5 |
| Bench Press | Barbell | 26 | 45 | Bench Press | Body Weight | 1.5 | 2 | 2 |
| Bench Press | Barbell | 26 | 45 | Bench Press | Dumbbell | 1.5 | 2 | 2 |
| Bench Press | Barbell | 26 | 45 | Bench Press | Machine | 1.5 | 2 | 2 |
| Bench Press | Barbell | 26 | 45 | Decline Bench Press | Barbell | 1.5 | 2 | 2 |
| Bench Press | Barbell | 26 | 45 | Decline Bench Press | Body Weight | 2.5 | 0 | 0 |
| Bench Press | Barbell | 26 | 45 | Decline Bench Press | Dumbbell | 2.5 | 0 | 0 |
| Bench Press | Barbell | 26 | 45 | Decline Bench Press | Machine | 2.5 | 0 | 0 |
| Bench Press | Barbell | 26 | 45 | Decline Dumbbell Bench Press | Barbell | 2.5 | 0 | 0 |
| Bench Press | Barbell | 26 | 45 | Decline Dumbbell Bench Press | Body Weight | 2 | 2 | 1.5 |
| Bench Press | Barbell | 26 | 45 | Decline Dumbbell Bench Press | Dumbbell | 2 | 2 | 1.5 |
| Bench Press | Barbell | 26 | 45 | Decline Dumbbell Bench Press | Machine | 2 | 2 | 1.5 |
| Bench Press | Barbell | 26 | 45 | Fly | Barbell | 2 | 2 | 1.5 |
| Bench Press | Barbell | 26 | 45 | Fly | Body Weight | 2 | 2 | 1.5 |
| Bench Press | Barbell | 26 | 45 | Fly | Dumbbell | 2 | 2 | 1.5 |
| Bench Press | Barbell | 26 | 45 | Fly | Machine | 2 | 2 | 1.5 |
| Bench Press | Barbell | 26 | 45 | 1-(DB) Seated Overhead Extension | Barbell | 1.5 | 0 | 0 |
| Bench Press | Barbell | 26 | 45 | 1-(DB) Seated Overhead Extension | Body Weight | 1.5 | 0 | 0 |
| Bench Press | Barbell | 26 | 45 | 1-(DB) Seated Overhead Extension | Dumbbell | 1.5 | 0 | 0 |

Fig. 15P

| Source Exercise | Source Resistance | Weight | Range | Result Exercise | Result Resistance | Coeffi-cient | Male (lbs) | Female (lbs) |
|---|---|---|---|---|---|---|---|---|
| Bench Press | Barbell | 26 | 45 | 1-(DB) Seated Overhead Extension | Machine | 1.5 | 0 | 0 |
| Bench Press | Barbell | 26 | 40 | Seated Tricep Extension | Barbell | 1.5 | 5 | 2 |
| Bench Press | Barbell | 26 | 40 | Seated Tricep Extension | Body Weight | 1.5 | 5 | 2 |
| Bench Press | Barbell | 26 | 40 | Seated Tricep Extension | Dumbbell | 1.5 | 5 | 2 |
| Bench Press | Barbell | 26 | 40 | Seated Tricep Extension | Machine | 1.5 | 5 | 2 |
| Bench Press | Barbell | 31 | 50 | Bench Press | Barbell | 2.5 | 5 | 1.5 |
| Bench Press | Barbell | 31 | 50 | Bench Press | Barbell | 2.5 | 5 | 1.5 |
| Bench Press | Barbell | 31 | 50 | Bench Press | Body Weight | 2.5 | 5 | 1.5 |
| Bench Press | Barbell | 31 | 50 | Bench Press | Body Weight | 2.5 | 5 | 1.5 |
| Bench Press | Barbell | 31 | 50 | Bench Press | Dumbbell | 2.5 | 5 | 1.5 |
| Bench Press | Barbell | 31 | 50 | Bench Press | Dumbbell | 2.5 | 5 | 1.5 |
| Bench Press | Barbell | 31 | 50 | Bench Press | Machine | 2.5 | 5 | 1.5 |
| Bench Press | Barbell | 31 | 50 | Bench Press | Machine | 2.5 | 5 | 1.5 |
| Bench Press | Barbell | 31 | 50 | Close Grip Bench Press | Barbell | 2.5 | 5 | 2 |
| Bench Press | Barbell | 31 | 50 | Close Grip Bench Press | Body Weight | 2.5 | 5 | 2 |
| Bench Press | Barbell | 31 | 50 | Close Grip Bench Press | Dumbbell | 2.5 | 5 | 2 |
| Bench Press | Barbell | 31 | 50 | Close Grip Bench Press | Machine | 2.5 | 5 | 2 |
| Bench Press | Barbell | 31 | 50 | Decline Barbell Bench Press | Barbell | 2.5 | 5 | 2 |
| Bench Press | Barbell | 31 | 50 | Decline Barbell Bench Press | Body Weight | 2.5 | 5 | 2 |
| Bench Press | Barbell | 31 | 50 | Decline Barbell Bench Press | Dumbbell | 2.5 | 5 | 2 |
| Bench Press | Barbell | 31 | 50 | Decline Barbell Bench Press | Machine | 2.5 | 5 | 2 |
| Bench Press | Barbell | 31 | 50 | Decline Dumbbell Fly | Barbell | 2 | 2 | 1.5 |
| Bench Press | Barbell | 31 | 50 | Decline Dumbbell Fly | Body Weight | 2 | 2 | 1.5 |
| Bench Press | Barbell | 31 | 50 | Decline Dumbbell Fly | Dumbbell | 2 | 2 | 1.5 |
| Bench Press | Barbell | 31 | 50 | Decline Dumbbell Fly | Machine | 2 | 2 | 1.5 |
| Bench Press | Barbell | 31 | 50 | Incline Bench Press | Barbell | 2 | 2 | 1.5 |
| Bench Press | Barbell | 31 | 50 | Incline Bench Press | Body Weight | 2 | 2 | 1.5 |
| Bench Press | Barbell | 31 | 50 | Incline Bench Press | Dumbbell | 2 | 2 | 1.5 |

Fig. 15Q

| Source Exercise | Source Resistance | Weight | Range | Result Exercise | Result Resistance | Coefficient | Male (lbs) | Female (lbs) |
|---|---|---|---|---|---|---|---|---|
| Bench Press | Barbell | 31 | 40 | Incline Bench Press | Machine | 2 | 2 | 1.5 |
| Bench Press | Barbell | 31 | 55 | Incline Fly | Barbell | 2 | 2 | 1.5 |
| Bench Press | Barbell | 31 | 55 | Incline Fly | Body Weight | 2 | 2 | 1.5 |
| Bench Press | Barbell | 31 | 55 | Incline Fly | Dumbbell | 2 | 2 | 1.5 |
| Bench Press | Barbell | 31 | 55 | Incline Fly | Machine | 2 | 2 | 1.5 |
| Bench Press | Barbell | 31 | 50 | Lying Chest Press | Barbell | 2.5 | 0 | 0 |
| Bench Press | Barbell | 31 | 50 | Lying Chest Press | Body Weight | 2.5 | 0 | 0 |
| Bench Press | Barbell | 31 | 50 | Lying Chest Press | Dumbbell | 2.5 | 0 | 0 |
| Bench Press | Barbell | 31 | 50 | Lying Chest Press | Machine | 2.5 | 0 | 0 |
| Bench Press | Barbell | 31 | 50 | Seated Chest Press | Barbell | 2.5 | 5 | 5 |
| Bench Press | Barbell | 31 | 50 | Seated Chest Press | Body Weight | 2.5 | 5 | 5 |
| Bench Press | Barbell | 31 | 50 | Seated Chest Press | Dumbbell | 2.5 | 5 | 5 |
| Bench Press | Barbell | 31 | 50 | Seated Chest Press | Machine | 2.5 | 5 | 5 |
| Bench Press | Barbell | 31 | 50 | Wide Chest Press | Barbell | 2.5 | 5 | 5 |
| Bench Press | Barbell | 31 | 50 | Wide Chest Press | Body Weight | 2.5 | 5 | 5 |
| Bench Press | Barbell | 31 | 50 | Wide Chest Press | Dumbbell | 2.5 | 5 | 5 |
| Bench Press | Barbell | 31 | 50 | Wide Chest Press | Machine | 2.5 | 5 | 5 |
| Bench Press | Barbell | 36 | 55 | Lying Extension | Barbell | 2 | 2 | 1.5 |
| Bench Press | Barbell | 36 | 55 | Lying Extension | Body Weight | 2 | 2 | 1.5 |
| Bench Press | Barbell | 36 | 55 | Lying Extension | Dumbbell | 2 | 2 | 1.5 |
| Bench Press | Barbell | 36 | 55 | Lying Extension | Machine | 2 | 2 | 1.5 |
| Bench Press | Barbell | 41 | 55 | Incline Barbell Bench Press | Barbell | 2.5 | 5 | 2 |
| Bench Press | Barbell | 41 | 55 | Incline Barbell Bench Press | Body Weight | 2.5 | 5 | 2 |
| Bench Press | Barbell | 41 | 55 | Incline Barbell Bench Press | Dumbbell | 2.5 | 5 | 2 |
| Bench Press | Barbell | 41 | 55 | Incline Barbell Bench Press | Machine | 2.5 | 2 | 1.5 |
| Bench Press | Barbell | 41 | 55 | Incline Bench Press | Barbell | 2.5 | 2 | 1.5 |
| Bench Press | Barbell | 41 | 55 | Incline Bench Press | Body Weight | 2.5 | 2 | 1.5 |
| Bench Press | Barbell | 41 | 55 | Incline Bench Press | Dumbbell | 2.5 | 2 | 1.5 |
| Bench Press | Barbell | 41 | 55 | Incline Bench Press | Machine | 2.5 | 2 | 1.5 |

Fig. 15R

| Source Exercise | Source Resistance | Weight | Range | Result Exercise | Result Resistance | Coeffi-cient | Male (lbs) | Female (lbs) |
|---|---|---|---|---|---|---|---|---|
| Bench Press | Barbell | 41 | 60 | Lying Extension | Barbell | 2 | 2 | 1.5 |
| Bench Press | Barbell | 41 | 60 | Lying Extension | Body Weight | 2 | 2 | 1.5 |
| Bench Press | Barbell | 41 | 60 | Lying Extension | Dumbbell | 2 | 2 | 1.5 |
| Bench Press | Barbell | 41 | 60 | Lying Extension | Machine | 2 | 2 | 1.5 |
| Bench Press | Barbell | 41 | 300 | Pec Fly | Barbell | 2 | 2 | 1.5 |
| Bench Press | Barbell | 41 | 300 | Pec Fly | Body Weight | 2 | 2 | 1.5 |
| Bench Press | Barbell | 41 | 300 | Pec Fly | Dumbbell | 2 | 2 | 1.5 |
| Bench Press | Barbell | 41 | 300 | Pec Fly | Machine | 2 | 2 | 1.5 |
| Bench Press | Barbell | 41 | 50 | Reverse Grip Pushdown | Barbell | 2 | 5 | 2 |
| Bench Press | Barbell | 41 | 50 | Reverse Grip Pushdown | Body Weight | 2 | 5 | 2 |
| Bench Press | Barbell | 41 | 50 | Reverse Grip Pushdown | Dumbbell | 2 | 5 | 2 |
| Bench Press | Barbell | 41 | 50 | Reverse Grip Pushdown | Machine | 2 | 5 | 2 |
| Bench Press | Barbell | 41 | 50 | Rope Pushdown | Barbell | 2 | 5 | 2 |
| Bench Press | Barbell | 41 | 50 | Rope Pushdown | Body Weight | 2 | 5 | 2 |
| Bench Press | Barbell | 41 | 50 | Rope Pushdown | Dumbbell | 2 | 5 | 2 |
| Bench Press | Barbell | 41 | 50 | Rope Pushdown | Machine | 2 | 5 | 2 |
| Bench Press | Barbell | 41 | 60 | Seated Dip | Barbell | 2.5 | 5 | 2 |
| Bench Press | Barbell | 41 | 60 | Seated Dip | Body Weight | 2.5 | 5 | 2 |
| Bench Press | Barbell | 41 | 60 | Seated Dip | Dumbbell | 2.5 | 5 | 2 |
| Bench Press | Barbell | 41 | 60 | Seated Dip | Machine | 2.5 | 5 | 2 |
| Bench Press | Barbell | 41 | 50 | Seated Tricep Extension | Barbell | 2 | 5 | 2 |
| Bench Press | Barbell | 41 | 50 | Seated Tricep Extension | Body Weight | 2 | 5 | 2 |
| Bench Press | Barbell | 41 | 50 | Seated Tricep Extension | Dumbbell | 2 | 5 | 2 |
| Bench Press | Barbell | 41 | 50 | Seated Tricep Extension | Machine | 2 | 5 | 2 |
| Bench Press | Barbell | 41 | 50 | Straight Bar Pushdown | Barbell | 2 | 5 | 2 |
| Bench Press | Barbell | 41 | 50 | Straight Bar Pushdown | Body Weight | 2 | 5 | 2 |
| Bench Press | Barbell | 41 | 50 | Straight Bar Pushdown | Dumbbell | 2 | 5 | 2 |
| Bench Press | Barbell | 41 | 50 | Straight Bar Pushdown | Machine | 2 | 5 | 2 |
| Bench Press | Barbell | 41 | 50 | V-Bar Pushdown | Barbell | 2 | 5 | 2 |

Fig. 15S

| Source Exercise | Source Resistance | Weight | Range | Result Exercise | Result Resistance | Coeffi-cient | Male (lbs) | Female (lbs) |
|---|---|---|---|---|---|---|---|---|
| Bench Press | Barbell | 41 | 50 | V-Bar Pushdown | Body Weight | 2 | 5 | 2 |
| Bench Press | Barbell | 41 | 50 | V-Bar Pushdown | Dumbbell | 2 | 5 | 2 |
| Bench Press | Barbell | 41 | 50 | V-Bar Pushdown | Machine | 2 | 5 | 2 |
| Bench Press | Barbell | 46 | 50 | Bench Press | Barbell | 2.5 | 2 | 1.5 |
| Bench Press | Barbell | 46 | 50 | Bench Press | Body Weight | 2.5 | 2 | 1.5 |
| Bench Press | Barbell | 46 | 50 | Bench Press | Dumbbell | 2.5 | 2 | 1.5 |
| Bench Press | Barbell | 46 | 55 | Decline Bench Press | Barbell | 5 | 0 | 0 |
| Bench Press | Barbell | 46 | 55 | Decline Bench Press | Body Weight | 5 | 0 | 0 |
| Bench Press | Barbell | 46 | 55 | Decline Bench Press | Dumbbell | 5 | 0 | 0 |
| Bench Press | Barbell | 46 | 55 | Decline Bench Press | Machine | 5 | 0 | 0 |
| Bench Press | Barbell | 46 | 60 | Decline Dumbbell Bench Press | Barbell | 2.5 | 2 | 1.5 |
| Bench Press | Barbell | 46 | 60 | Decline Dumbbell Bench Press | Body Weight | 2.5 | 2 | 1.5 |
| Bench Press | Barbell | 46 | 60 | Decline Dumbbell Bench Press | Dumbbell | 2.5 | 2 | 1.5 |
| Bench Press | Barbell | 46 | 60 | Decline Dumbbell Bench Press | Machine | 2.5 | 2 | 1.5 |
| Bench Press | Barbell | 46 | 60 | Fly | Barbell | 2.5 | 2 | 1.5 |
| Bench Press | Barbell | 46 | 60 | Fly | Body Weight | 2.5 | 2 | 1.5 |
| Bench Press | Barbell | 46 | 60 | Fly | Dumbbell | 2.5 | 2 | 1.5 |
| Bench Press | Barbell | 46 | 60 | Fly | Machine | 2.5 | 2 | 1.5 |
| Bench Press | Barbell | 46 | 55 | Seated Overhead Extension (1-DB) | Barbell | 2 | 0 | 0 |
| Bench Press | Barbell | 46 | 55 | Seated Overhead Extension (1-DB) | Body Weight | 2 | 0 | 0 |
| Bench Press | Barbell | 46 | 55 | Seated Overhead Extension (1-DB) | Dumbbell | 2 | 0 | 0 |

Fig. 15T

| Source Exercise | Source Resistance | Weight | Range | Result Exercise | Result Resistance | Coeffi-cient | Male (lbs) | Female (lbs) |
|---|---|---|---|---|---|---|---|---|
| Bench Press | Barbell | 46 | 55 | Seated Overhead Extension (1-DB) | Machine | 2 | 0 | 0 |
| Bench Press | Barbell | 51 | 60 | Bench Press | Barbell | 5 | 2 | 1.5 |
| Bench Press | Barbell | 51 | 300 | Bench Press | Barbell | 5 | 2 | 1.5 |
| Bench Press | Barbell | 51 | 300 | Bench Press | Body Weight | 5 | 2 | 1.5 |
| Bench Press | Barbell | 51 | 60 | Bench Press | Body Weight | 5 | 2 | 1.5 |
| Bench Press | Barbell | 51 | 606 | Bench Press | Dumbbell | 5 | 2 | 1.5 |
| Bench Press | Barbell | 51 | 300 | Bench Press | Dumbbell | 5 | 2 | 1.5 |
| Bench Press | Barbell | 51 | 300 | Bench Press | Machine | 5 | 2 | 1.5 |
| Bench Press | Barbell | 51 | 60 | Bench Press | Machine | 5 | 2 | 1.5 |
| Bench Press | Barbell | 51 | 300 | Cable Crossover | Barbell | 5 | 5 | 2 |
| Bench Press | Barbell | 51 | 300 | Cable Crossover | Body Weight | 5 | 5 | 2 |
| Bench Press | Barbell | 51 | 300 | Cable Crossover | Dumbbell | 5 | 5 | 2 |
| Bench Press | Barbell | 51 | 300 | Cable Crossover | Machine | 5 | 5 | 2 |
| Bench Press | Barbell | 51 | 300 | Close Grip Bench Press | Barbell | 5 | 5 | 2 |
| Bench Press | Barbell | 51 | 300 | Close Grip Bench Press | Body Weight | 5 | 5 | 2 |
| Bench Press | Barbell | 51 | 300 | Close Grip Bench Press | Dumbbell | 5 | 5 | 2 |
| Bench Press | Barbell | 51 | 300 | Close Grip Bench Press | Machine | 5 | 5 | 2 |
| Bench Press | Barbell | 51 | 300 | Decline Barbell Bench Press | Barbell | 5 | 5 | 5 |
| Bench Press | Barbell | 51 | 300 | Decline Barbell Bench Press | Body Weight | 5 | 5 | 5 |
| Bench Press | Barbell | 51 | 300 | Decline Barbell Bench Press | Dumbbell | 5 | 5 | 5 |
| Bench Press | Barbell | 51 | 300 | Decline Barbell Bench Press | Machine | 5 | 5 | 5 |
| Bench Press | Barbell | 51 | 60 | Decline Dumbbell Fly | Barbell | 2.5 | 2 | 1.5 |
| Bench Press | Barbell | 51 | 60 | Decline Dumbbell Fly | Body Weight | 2.5 | 2 | 1.5 |
| Bench Press | Barbell | 51 | 60 | Decline Dumbbell Fly | Dumbbell | 2.5 | 2 | 1.5 |
| Bench Press | Barbell | 51 | 60 | Decline Dumbbell Fly | Machine | 2.5 | 2 | 1.5 |
| Bench Press | Barbell | 51 | 60 | Incline Bench Press | Barbell | 2.5 | 2 | 1.5 |
| Bench Press | Barbell | 51 | 60 | Incline Bench Press | Body Weight | 2.5 | 2 | 1.5 |
| Bench Press | Barbell | 51 | 60 | Incline Bench Press | Dumbbell | 2.5 | 2 | 1.5 |

Fig. 15U

| Source Exercise | Source Resistance | Weight | Range | Result Exercise | Result Resistance | Coeffi-cient | Male (lbs) | Female (lbs) |
|---|---|---|---|---|---|---|---|---|
| Bench Press | Barbell | 51 | 60 | Incline Bench Press | Machine | 2.5 | 2 | 1.5 |
| Bench Press | Barbell | 51 | 60 | Lying Chest Press | Body Weight | 5 | 0 | 0 |
| Bench Press | Barbell | 51 | 60 | Lying Chest Press | Dumbbell | 5 | 0 | 0 |
| Bench Press | Barbell | 51 | 60 | Lying Chest Press | Machine | 5 | 0 | 0 |
| Bench Press | Barbell | 51 | 60 | Lying Chest Press | Barbell | 5 | 0 | 0 |
| Bench Press | Barbell | 51 | 60 | Reverse Grip Pushdown | Barbell | 2.5 | 5 | 2 |
| Bench Press | Barbell | 51 | 60 | Reverse Grip Pushdown | Body Weight | 2.5 | 5 | 2 |
| Bench Press | Barbell | 51 | 60 | Reverse Grip Pushdown | Dumbbell | 2.5 | 5 | 2 |
| Bench Press | Barbell | 51 | 60 | Reverse Grip Pushdown | Machine | 2.5 | 5 | 2 |
| Bench Press | Barbell | 51 | 60 | Rope Pushdown | Barbell | 2.5 | 5 | 2 |
| Bench Press | Barbell | 51 | 60 | Rope Pushdown | Body Weight | 2.5 | 5 | 2 |
| Bench Press | Barbell | 51 | 60 | Rope Pushdown | Dumbbell | 2.5 | 5 | 2 |
| Bench Press | Barbell | 51 | 60 | Rope Pushdown | Machine | 2.5 | 5 | 2 |
| Bench Press | Barbell | 51 | 60 | Seated Chest Press | Barbell | 5 | 5 | 5 |
| Bench Press | Barbell | 51 | 60 | Seated Chest Press | Body Weight | 5 | 5 | 5 |
| Bench Press | Barbell | 51 | 60 | Seated Chest Press | Dumbbell | 5 | 5 | 5 |
| Bench Press | Barbell | 51 | 60 | Seated Chest Press | Machine | 5 | 5 | 5 |
| Bench Press | Barbell | 51 | 60 | Seated Tricep Extension | Barbell | 2.5 | 5 | 2 |
| Bench Press | Barbell | 51 | 60 | Seated Tricep Extension | Body Weight | 2.5 | 5 | 2 |
| Bench Press | Barbell | 51 | 60 | Seated Tricep Extension | Dumbbell | 2.5 | 5 | 2 |
| Bench Press | Barbell | 51 | 60 | Seated Tricep Extension | Machine | 2.5 | 5 | 2 |
| Bench Press | Barbell | 51 | 60 | Straight Bar Pushdown | Barbell | 2.5 | 5 | 2 |
| Bench Press | Barbell | 51 | 60 | Straight Bar Pushdown | Body Weight | 2.5 | 5 | 2 |
| Bench Press | Barbell | 51 | 60 | Straight Bar Pushdown | Dumbbell | 2.5 | 5 | 2 |
| Bench Press | Barbell | 51 | 60 | Straight Bar Pushdown | Machine | 2.5 | 5 | 2 |
| Bench Press | Barbell | 51 | 60 | V-Bar Pushdown | Barbell | 2.5 | 5 | 2 |
| Bench Press | Barbell | 51 | 60 | V-Bar Pushdown | Body Weight | 2.5 | 5 | 2 |
| Bench Press | Barbell | 51 | 60 | V-Bar Pushdown | Dumbbell | 2.5 | 5 | 2 |
| Bench Press | Barbell | 51 | 60 | V-Bar Pushdown | Machine | 2.5 | 5 | 2 |

Fig. 15V

| Source Exercise | Source Resistance | Weight | Range | Result Exercise | Result Resistance | Coeffi-cient | Male (lbs) | Female (lbs) |
|---|---|---|---|---|---|---|---|---|
| Bench Press | Barbell | 51 | 60 | Wide Chest Press | Barbell | 5 | 5 | 5 |
| Bench Press | Barbell | 51 | 60 | Wide Chest Press | Body Weight | 5 | 5 | 5 |
| Bench Press | Barbell | 51 | 60 | Wide Chest Press | Dumbbell | 5 | 5 | 5 |
| Bench Press | Barbell | 51 | 60 | Wide Chest Press | Machine | 5 | 5 | 5 |
| Bench Press | Barbell | 56 | 300 | Decline Bench Press | Barbell | 10 | 0 | 0 |
| Bench Press | Barbell | 56 | 300 | Decline Bench Press | Body Weight | 10 | 0 | 0 |
| Bench Press | Barbell | 56 | 300 | Decline Bench Press | Dumbbell | 10 | 0 | 0 |
| Bench Press | Barbell | 56 | 300 | Decline Bench Press | Machine | 10 | 0 | 0 |
| Bench Press | Barbell | 56 | 300 | Incline Barbell Bench Press | Barbell | 5 | 5 | 2 |
| Bench Press | Barbell | 56 | 300 | Incline Barbell Bench Press | Body Weight | 5 | 5 | 2 |
| Bench Press | Barbell | 56 | 300 | Incline Barbell Bench Press | Dumbbell | 5 | 5 | 2 |
| Bench Press | Barbell | 56 | 300 | Incline Barbell Bench Press | Machine | 5 | 5 | 2 |
| Bench Press | Barbell | 56 | 300 | Incline Bench Press | Barbell | 5 | 2 | 1.5 |
| Bench Press | Barbell | 56 | 300 | Incline Bench Press | Body Weight | 5 | 2 | 1.5 |
| Bench Press | Barbell | 56 | 300 | Incline Bench Press | Dumbbell | 5 | 2 | 1.5 |
| Bench Press | Barbell | 56 | 300 | Incline Bench Press | Machine | 5 | 2 | 1.5 |
| Bench Press | Barbell | 56 | 300 | Incline Chest Press | Barbell | 5 | 5 | 2 |
| Bench Press | Barbell | 56 | 300 | Incline Chest Press | Body Weight | 5 | 5 | 2 |
| Bench Press | Barbell | 56 | 300 | Incline Chest Press | Dumbbell | 5 | 5 | 2 |
| Bench Press | Barbell | 56 | 300 | Incline Chest Press | Machine | 5 | 5 | 2 |
| Bench Press | Barbell | 56 | 65 | Incline Fly | Barbell | 2.5 | 2 | 1.5 |
| Bench Press | Barbell | 56 | 65 | Incline Fly | Body Weight | 2.5 | 2 | 1.5 |
| Bench Press | Barbell | 56 | 65 | Incline Fly | Dumbbell | 2.5 | 2 | 1.5 |
| Bench Press | Barbell | 56 | 65 | Incline Fly | Machine | 2.5 | 2 | 1.5 |
| Bench Press | Barbell | 56 | 60 | Lying Extension | Barbell | 2.5 | 2 | 1.5 |
| Bench Press | Barbell | 56 | 60 | Lying Extension | Body Weight | 2.5 | 2 | 1.5 |
| Bench Press | Barbell | 56 | 60 | Lying Extension | Dumbbell | 2.5 | 2 | 1.5 |
| Bench Press | Barbell | 56 | 60 | Lying Extension | Machine | 2.5 | 2 | 1.5 |
| Bench Press | Barbell | 56 | 65 | Seated Overhead Extension (1-DB) | Barbell | 2.5 | 0 | 0 |

Fig. 15W

| Source Exercise | Source Resistance | Weight | Range | Result Exercise | Result Resistance | Coeffi-cient | Male (lbs) | Female (lbs) |
|---|---|---|---|---|---|---|---|---|
| Bench Press | Barbell | 56 | 65 | Seated Overhead Extension (1-DB) | Body Weight | 2.5 | 0 | 0 |
| Bench Press | Barbell | 56 | 65 | Seated Overhead Extension (1-DB) | Dumbbell | 2.5 | 0 | 0 |
| Bench Press | Barbell | 56 | 65 | Seated Overhead Extension (1-DB) | Machine | 2.5 | 0 | 0 |
| Bench Press | Barbell | 61 | 300 | Bench Press | Barbell | 10 | 2 | 1.5 |
| Bench Press | Barbell | 61 | 300 | Bench Press | Barbell | 5 | 2 | 1.5 |
| Bench Press | Barbell | 61 | 300 | Bench Press | Body Weight | 5 | 2 | 1.5 |
| Bench Press | Barbell | 61 | 300 | Bench Press | Body Weight | 10 | 2 | 1.5 |
| Bench Press | Barbell | 61 | 300 | Bench Press | Dumbbell | 10 | 2 | 1.5 |
| Bench Press | Barbell | 61 | 300 | Bench Press | Dumbbell | 5 | 2 | 1.5 |
| Bench Press | Barbell | 61 | 300 | Bench Press | Machine | 5 | 2 | 1.5 |
| Bench Press | Barbell | 61 | 300 | Bench Press | Machine | 10 | 2 | 1.5 |
| Bench Press | Barbell | 61 | 90 | Decline Bench Press | Barbell | 2.5 | 0 | 0 |
| Bench Press | Barbell | 61 | 80 | Decline Bench Press | Barbell | 2.5 | 0 | 0 |
| Bench Press | Barbell | 61 | 80 | Decline Bench Press | Body Weight | 2.5 | 0 | 0 |
| Bench Press | Barbell | 61 | 90 | Decline Bench Press | Body Weight | 2.5 | 0 | 0 |
| Bench Press | Barbell | 61 | 90 | Decline Bench Press | Dumbbell | 2.5 | 0 | 0 |
| Bench Press | Barbell | 61 | 80 | Decline Bench Press | Dumbbell | 2.5 | 0 | 0 |
| Bench Press | Barbell | 61 | 80 | Decline Bench Press | Machine | 2.5 | 0 | 0 |
| Bench Press | Barbell | 61 | 90 | Decline Bench Press | Machine | 2.5 | 0 | 0 |
| Bench Press | Barbell | 61 | 300 | Decline Dumbbell Bench Press | Barbell | 5 | 2 | 1.5 |
| Bench Press | Barbell | 61 | 300 | Decline Dumbbell Bench Press | Body Weight | 5 | 2 | 1.5 |
| Bench Press | Barbell | 61 | 300 | Decline Dumbbell Bench Press | Dumbbell | 5 | 2 | 1.5 |

Fig. 15X

| Source Exercise | Source Resistance | Weight | Range | Result Exercise | Result Resistance | Coeffi-cient | Male (lbs) | Female (lbs) |
|---|---|---|---|---|---|---|---|---|
| Bench Press | Barbell | 61 | 300 | Decline Dumbbell Bench Press | Machine | 5 | 2 | 1.5 |
| Bench Press | Barbell | 61 | 300 | Decline Dumbbell Fly | Barbell | 5 | 2 | 1.5 |
| Bench Press | Barbell | 61 | 300 | Decline Dumbbell Fly | Body Weight | 5 | 2 | 1.5 |
| Bench Press | Barbell | 61 | 300 | Decline Dumbbell Fly | Dumbbell | 5 | 2 | 1.5 |
| Bench Press | Barbell | 61 | 300 | Decline Dumbbell Fly | Machine | 5 | 2 | 1.5 |
| Bench Press | Barbell | 61 | 300 | Fly | Barbell | 5 | 2 | 1.5 |
| Bench Press | Barbell | 61 | 300 | Fly | Body Weight | 5 | 2 | 1.5 |
| Bench Press | Barbell | 61 | 300 | Fly | Dumbbell | 5 | 2 | 1.5 |
| Bench Press | Barbell | 61 | 300 | Fly | Machine | 5 | 2 | 1.5 |
| Bench Press | Barbell | 61 | 300 | Incline Bench Press | Barbell | 5 | 2 | 1.5 |
| Bench Press | Barbell | 61 | 300 | Incline Bench Press | Body Weight | 5 | 2 | 1.5 |
| Bench Press | Barbell | 61 | 300 | Incline Bench Press | Dumbbell | 5 | 2 | 1.5 |
| Bench Press | Barbell | 61 | 300 | Incline Bench Press | Machine | 5 | 2 | 1.5 |
| Bench Press | Barbell | 61 | 300 | Lying Chest Press | Barbell | 10 | 0 | 0 |
| Bench Press | Barbell | 61 | 300 | Lying Chest Press | Body Weight | 10 | 0 | 0 |
| Bench Press | Barbell | 61 | 300 | Lying Chest Press | Dumbbell | 10 | 0 | 0 |
| Bench Press | Barbell | 61 | 300 | Lying Chest Press | Machine | 10 | 0 | 0 |
| Bench Press | Barbell | 61 | 300 | Lying Extension | Barbell | 5 | 2 | 1.5 |
| Bench Press | Barbell | 61 | 300 | Lying Extension | Barbell | 5 | 2 | 1.5 |
| Bench Press | Barbell | 61 | 300 | Lying Extension | Body Weight | 5 | 2 | 1.5 |
| Bench Press | Barbell | 61 | 300 | Lying Extension | Body Weight | 5 | 2 | 1.5 |
| Bench Press | Barbell | 61 | 300 | Lying Extension | Dumbbell | 5 | 2 | 1.5 |
| Bench Press | Barbell | 61 | 300 | Lying Extension | Dumbbell | 5 | 2 | 1.5 |
| Bench Press | Barbell | 61 | 300 | Lying Extension | Machine | 5 | 2 | 1.5 |
| Bench Press | Barbell | 61 | 300 | Lying Extension | Machine | 5 | 2 | 1.5 |
| Bench Press | Barbell | 61 | 300 | Reverse Grip Pushdown | Barbell | 5 | 5 | 2 |
| Bench Press | Barbell | 61 | 300 | Reverse Grip Pushdown | Body Weight | 5 | 5 | 2 |
| Bench Press | Barbell | 61 | 300 | Reverse Grip Pushdown | Dumbbell | 5 | 5 | 2 |

Fig. 15Y

| Source Exercise | Source Resistance | Weight | Range | Result Exercise | Result Resistance | Coeffi-cient | Male (lbs) | Female (lbs) |
|---|---|---|---|---|---|---|---|---|
| Bench Press | Barbell | 61 | 300 | Reverse Grip Pushdown | Machine | 5 | 5 | 2 |
| Bench Press | Barbell | 61 | 300 | Rope Pushdown | Barbell | 5 | 5 | 2 |
| Bench Press | Barbell | 61 | 300 | Rope Pushdown | Body Weight | 5 | 5 | 2 |
| Bench Press | Barbell | 61 | 300 | Rope Pushdown | Dumbbell | 5 | 5 | 2 |
| Bench Press | Barbell | 61 | 300 | Rope Pushdown | Machine | 5 | 5 | 2 |
| Bench Press | Barbell | 61 | 300 | Seated Chest Press | Barbell | 10 | 5 | 5 |
| Bench Press | Barbell | 61 | 300 | Seated Chest Press | Body Weight | 10 | 5 | 5 |
| Bench Press | Barbell | 61 | 300 | Seated Chest Press | Dumbbell | 10 | 5 | 5 |
| Bench Press | Barbell | 61 | 300 | Seated Chest Press | Machine | 10 | 5 | 5 |
| Bench Press | Barbell | 61 | 300 | Seated Dip | Barbell | 5 | 5 | 5 |
| Bench Press | Barbell | 61 | 300 | Seated Dip | Body Weight | 5 | 5 | 5 |
| Bench Press | Barbell | 61 | 300 | Seated Dip | Dumbbell | 5 | 5 | 5 |
| Bench Press | Barbell | 61 | 300 | Seated Dip | Machine | 5 | 5 | 5 |
| Bench Press | Barbell | 61 | 300 | Seated Tricep Extension | Barbell | 5 | 5 | 2 |
| Bench Press | Barbell | 61 | 300 | Seated Tricep Extension | Body Weight | 5 | 5 | 2 |
| Bench Press | Barbell | 61 | 300 | Seated Tricep Extension | Dumbbell | 5 | 5 | 2 |
| Bench Press | Barbell | 61 | 300 | Seated Tricep Extension | Machine | 5 | 5 | 2 |
| Bench Press | Barbell | 61 | 300 | Straight Bar Pushdown | Barbell | 5 | 5 | 2 |
| Bench Press | Barbell | 61 | 300 | Straight Bar Pushdown | Body Weight | 5 | 5 | 2 |
| Bench Press | Barbell | 61 | 300 | Straight Bar Pushdown | Dumbbell | 5 | 5 | 2 |
| Bench Press | Barbell | 61 | 300 | Straight Bar Pushdown | Machine | 5 | 5 | 2 |
| Bench Press | Barbell | 61 | 300 | V-Bar Pushdown | Barbell | 5 | 5 | 2 |
| Bench Press | Barbell | 61 | 300 | V-Bar Pushdown | Body Weight | 5 | 5 | 2 |
| Bench Press | Barbell | 61 | 300 | V-Bar Pushdown | Dumbbell | 5 | 5 | 2 |
| Bench Press | Barbell | 61 | 300 | V-Bar Pushdown | Machine | 5 | 5 | 2 |
| Bench Press | Barbell | 61 | 300 | Wide Chest Press | Barbell | 10 | 5 | 5 |
| Bench Press | Barbell | 61 | 300 | Wide Chest Press | Body Weight | 10 | 5 | 5 |
| Bench Press | Barbell | 61 | 300 | Wide Chest Press | Dumbbell | 10 | 5 | 5 |
| Bench Press | Barbell | 61 | 300 | Wide Chest Press | Machine | 10 | 5 | 5 |

Fig. 15Z

| Source Exercise | Source Resistance | Weight | Range | Result Exercise | Result Resistance | Coeffi-cient | Male (lbs) | Female (lbs) |
|---|---|---|---|---|---|---|---|---|
| Bench Press | Barbell | 65 | 300 | Pec Fly | Barbell | 2 | 2 | 1.5 |
| Bench Press | Barbell | 65 | 300 | Pec Fly | Body Weight | 2 | 2 | 1.5 |
| Bench Press | Barbell | 65 | 300 | Pec Fly | Dumbbell | 2 | 2 | 1.5 |
| Bench Press | Barbell | 65 | 300 | Pec Fly | Machine | 2 | 2 | 1.5 |
| Bench Press | Barbell | 66 | 100 | Bench Press | Barbell | 2.5 | 2 | 1.5 |

SYSTEM AND METHOD FOR PREPARING WORKOUTS FOR A PLURALITY OF INDIVIDUALS AND MONITORING INDIVIDUAL COMPLIANCE

NOTICE REGARDING COPYRIGHTED MATERIAL

A portion of the disclosure of this patent document contains materials which are subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD OF THE INVENTION

The present invention is directed toward a system and method of preparing exercise programs for a plurality of users and monitoring compliance by the users with their particular programs, and more specifically, toward a system and method for receiving as input data relating to a user's physical condition and a user's performance on a series of test exercises and developing from the input an exercise program for the individual to help the user exercise effectively, automatically generating workouts, and determining on a periodic basis whether the user is following the exercise program.

BACKGROUND OF THE INVENTION

Many people exercise. Their reasons for doing so include a desire to lose weight, improve muscle tone, improve cardiovascular health, and generally to become or remain fit and healthy.

Different exercise regimens are appropriate for different individuals, depending on their health and physical condition, the goals they wish to achieve and their time available for exercising. Developing an exercise regimen that is safe for a user and that will help that user reach his specific goals requires considerable expertise. Without access to such expertise, a user may exercise in a manner that is ineffective or, even worse, harmful to the user's heath.

Many people exercise at gyms or fitness centers and health clubs. (Hereinafter, these facilities may be referred to generically by any one of these terms or by the general term "club.") Often, upon joining a club, persons will consult a personal trainer who will provide instruction on the proper use of exercise equipment and who will recommend a workout or exercise schedule based on the user's age and general health. If the person desires, he can schedule workout sessions with a personal trainer who will monitor his progress, provide suggestions and encouragement for exercising more effectively, and adjust his workout as necessary to help him achieve his goals. However, the use of a personal trainer can be expensive, and most clubs provide only a limited amount of training for new members before they begin to charge extra for personal training services, at an hourly rate, for example. Moreover, personal trainers generally work with multiple individuals and work only certain hours on certain days. Thus, if one wishes to work with a personal trainer, he must schedule his workouts when that personal trainer is available; this may not be easy if the individual exercises at unusual or irregular times. Therefore, many individuals forego the benefits of a personal trainer and attempt to exercise on their own.

Even at well-run clubs, nearly half of all members will stop exercising after six months, and more that forty percent will quit. Full-time, one-on-one training is the best way to retain members; however, for the reasons discussed above, this is not an option for all or even most members. Individuals who do not work with a trainer are more likely to exercise ineffectively, deviate from an effective exercise plan if one was initially developed for them, fail to achieve their workout goals, become frustrated, and eventually, stop visiting a club. This is partly due to the lack of encouragement that a trainer can provide, and partly due to the boredom that may set in if an exercise routine is not varied and the individual ends up doing the same series of exercises repeatedly over the course of weeks or months. Trainers can often recommend different exercises that work a given muscle or muscle group, but many individuals will not readily learn dozens of exercises and the benefits of each without substantial guidance by a professional. Moreover, without a personal trainer tracking a user's attendance, club management may not learn of a drop off in a user's activity quickly enough for corrective action to be taken.

Likewise, it can be difficult for club management to determine the effectiveness of various personal trainers; for example some trainers may be in great demand while the members working with other trainers frequently quit. Thus many individuals needlessly loses the health benefits that could be obtained by exercising regularly, and clubs lose the income that would have been produced by the lost members. It would therefore be desirable to provide a system that could automatically generate varied workouts for individuals, and to provide a system and method for tracking a user's compliance with an exercise program in order to provide timely follow up if a user deviates from the program.

SUMMARY OF THE INVENTION

These problems and others are addressed by the present invention which comprises a system and method for developing workouts and tracking compliance by a person using the system with the various workouts produced by the system.

In a first aspect, the invention comprises a system for automatically generating a workout which system includes a processor having an input and an output, a memory device operably connected to the processor, an input device operably connected to the processor input, and a display device operably connected to the processor output. The system is configured to display a set of workout instructions based on input comprising a plurality of physical characteristics of an individual, the results of a physical assessment of the individual on a series of test exercises, and a list of exercise equipment available to the individual.

Another aspect of the invention comprises a method of automatically generating a workout for a user that involves obtaining health information of the user, measuring a performance of the user on a series of test exercises and identifying a plurality of exercise devices available to the user. A workout plan is then prepared based on the health information and the plurality of exercise devices available to the user. Workouts are automatically generated based on the workout plan and the performance of the individual on the series of test exercises.

A further aspect of the invention comprises a method of monitoring compliance by a plurality of individuals with a personal exercise program assigned to each of the plurality of individuals that involves providing in a database a record for each of the plurality of individuals, each record including an individual identifier field, a goal number of workouts per unit time period field, and an actual number of workouts per unit time period field. A numerical value representing a goal number of workouts per unit time is entered into the goal number of workouts per unit time field of each record, and a numerical value representing an actual number of workouts completed is entered into the actual number of workouts per unit time field of each record. Then, for each record, for each time period, the actual number of workouts is compared with the goal number of workouts, and, for each time period, each record in which the actual number of workouts differs from the goal number of workouts is identified.

Another aspect of the invention comprises a method of preparing an exercise program for an individual that involves providing a computer having a processor, a memory operably connected to the processor, an input device operably connected to the processor and an output device operably connected to the processor. Data relating to a physical condition of an individual is stored in the memory. The performance of the individual on a series of physical tests is measured, and data related to this performance is entered into the memory device. An exercise program is developed for the individual based on the data in the memory device, and a first workout for the individual to follow at a first time is automatically generated. The first workout is printed, and data concerning the performance of the individual during the first workout is entered into the memory. A second workout for the individual to follow at a second time subsequent to the first time is printed, the second workout being based in part on the data concerning the performance of the individual during the first workout at the first time.

A further aspect of the invention comprises a method of determining an appropriate resistance for an individual to use in exercising in a given manner that involves determining the maximum resistance a user can manipulate during a first exercise and determining a function that relates the first exercise to at least one given exercise. From the function, a maximum resistance with which the user will be able to exercise during the at least one given exercise is predicted, and an indication of the maximum resistance or a function of the maximum resistance is displayed.

Another aspect of the invention is a method of establishing an appropriate resistance for an individual to use in performing an exercise that involves determining the maximum resistance a user can manipulate during a first exercise performed with a first exercise device and determining a function that relates the first exercise to at least a second exercise. From the function, a maximum resistance the user will be able to manipulate during the second exercise performed on a second exercise device is predicted, and a resistance level on a second exercise device is set to a level related to the second exercise maximum resistance.

Also disclosed is a method of establishing an appropriate resistance for an individual to use in performing an exercise that involves determining the maximum resistance a user can manipulate during a first exercise performed with a first exercise device and determining a plurality of functions that relate the first exercise to a plurality of second exercises. From a selected one of the plurality of functions, a maximum resistance the user will be able to manipulate during a selected one of the plurality of second exercises is predicted, and a second exercise device is selected from a group of exercise devices for performing the second exercise. A relationship is determined among the exercise devices in the group, and a resistance level is set on the selected second exercise device to a level related to the second exercise maximum resistance and to the relationship among the exercise devices in the group.

Also disclosed is a method of developing a workout comprising a series of exercises and communicating the workout to a user that involves identifying a muscle group to use during a workout, selecting an intensity level for exercising the muscle group, selecting an exercise from a plurality of exercises for exercising the muscle group, and selecting a routine from a plurality of routines for performing each of the plurality of exercises at the selected intensity level, each of the plurality of routines comprising a number of repetitions. A resistance level related to the maximum resistance the user was able to manipulate on a first exercise machine is determined, and a second exercise machine is selected for performing the selected exercise. Then a workout comprising an identification of the second exercise machine, a name of an exercise to be performed on the second exercise machine, a resistance level to be used in performing the named exercise on the second exercise machine, and information relating to the number of repetitions and sets of the exercise to be performed is displayed.

Also disclosed is a method of generating workouts for a person that involves developing a workout routine comprising a series of muscles to be used, an intensity level for working each muscle in the series of muscles and a number of sets of exercises to be performed with each muscle, and measuring a maximum resistance against which a person performs a baseline exercise on a first exercise machine, automatically selecting an exercise for one of the muscles in the series of muscles, and automatically selecting a second exercise machine for performing the selected exercise. Next, a workout resistance for the second exercise is selected as a function of the selected exercise, and the maximum resistance, and a workout comprising an identification of the second exercise, the second exercise machine and the working resistance is displayed.

Another aspect of the invention comprises a system for generating a workout for a person that includes a processor having an input and an output, a memory device operably connected to the processor, an input device operably connected to the processor input and a display device operably connected to the processor output. A workout routine is stored in the memory comprising a list of a series of muscles to be used, an intensity level for working each muscle in the series of muscles and a number of sets of exercises to be performed with each muscle. A first value representing a maximum resistance against which a person performs a baseline exercise on a first exercise machine is stored in the memory, as is an identification of an exercise for one of the muscles in the list of a series of muscles. An identification of a second exercise machine for performing the selected exercise is also stored in the memory along with an identification of a workout resistance for the second exercise. The workout resistance for the second exercise is a function of the selected exercise and the maximum resistance, and a workout comprising an identification of the second exercise, the second exercise machine and the working resistance is displayed.

BRIEF DESCRIPTION OF THE DRAWINGS

These aspects of the invention and others will become apparent from a reading and understanding of the following detailed description of the invention together with the following drawings.

FIGS. 3*a–b* show a data entry screen for entering a member evaluation.

FIG. 4 is a routine for the first day of a two day per week workout.

FIG. 6 shows examples of weight rules used in developing a workout.

FIG. 7*a–x* is a table showing the relationship between a baseline exercise and various other exercises and the percentage of maximum resistance that should be used in workouts of different intensities.

FIG. 8 is a table of coefficients for normalizing a number of bench press machines.

FIG. 9 is an example of a workout sheet generated by the present invention.

FIG. 11 is an club employee record.

FIG. 12 is a screen capture of a club member list.

FIG. 13 shows a weekly call/status report.

FIG. 14 shows a member report card.

FIGS. 15*a–z* is a table showing exercises related to the bench press for purposes of increasing weight levels after an increase threshold has been exceeded a predetermined number of times using a base weight of between 0 and 65 pounds.

DETAILED DESCRIPTION OF THE INVENTION

Figure 1:
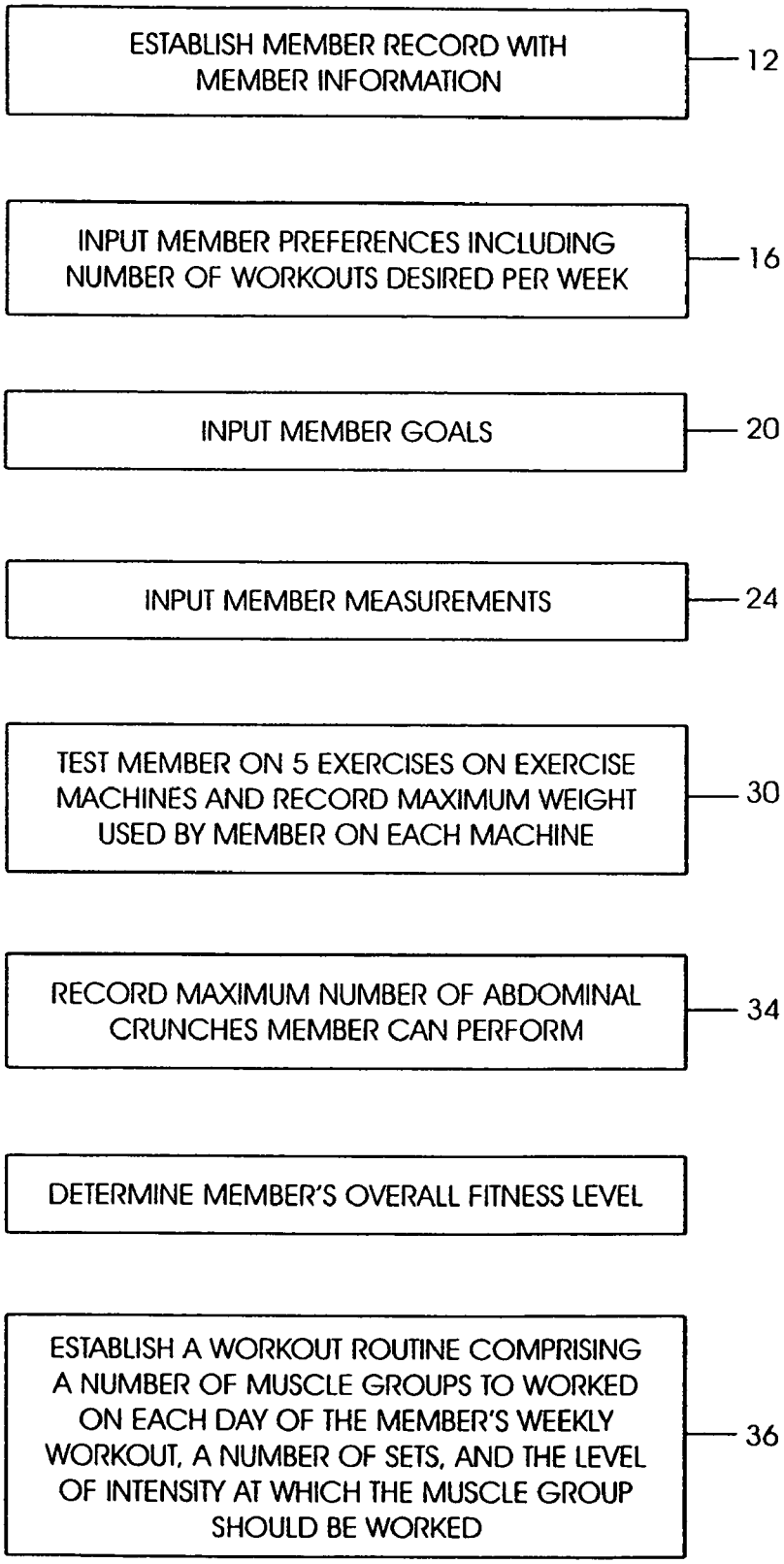
FIG. 1 is a flow chart showing the steps of establishing a workout routine for a club member.

The preferred embodiment of the invention comprises a system for developing an exercise routine for health club members, automatically generating individual workouts to use in furtherance of the routine, monitoring member performance on these workouts, and tracking how well members are following their routines. The routines are based on each member's measured physical ability, and workouts take into account member performance during previous workouts.

The exercises that make up each workout are varied over the course of several days to maintain a person's interest, and, as the person demonstrates increased physical abilities, the exercises and workouts are adjusted accordingly. Records of individual performance are maintained and reviewed periodically by a trainer who can contact persons who are not complying with their workout regimen and provide instruction and encouragement. In this manner, the system provides more club members with the benefits of working with a personal trainer. The personal trainer, however, is not required to be present at each workout or to develop workout routines for each member, but can nonetheless monitor the progress of members and provide useful feedback on performance. In this manner, the trainer can leverage his time and work with a greater number of members than would be possible on a full-time, one-on-one basis.

The preferred embodiment of the present invention comprises a central computer server that is maintained by a service provider. The administrators of the system make their services available to various clubs, and the clubs, in turn, can offer their members the benefits of having personalized workouts generated for them each time they visit the club.

Once the system is licensed to a club, club members are interviewed and evaluated to obtain basic information needed by the system. This information is then sent to the central server where it is used to select an exercise routine appropriate for the individual in question. This process generally involves determining the number of days per week that the individual wishes to work out and the gender of the individual. Routines for two, three and four day workouts are stored in the system, and different routines are assigned to men and women. Alternately, routines can be generated based on the specific circumstances and/or goals of a particular user, either automatically or via the input of an experienced exercise professional. These workout plans are associated with the particular individual. From this point, the system automatically generates varied workouts for the club member to follow on each visit to the club. After completing a workout, the member records the number of repetitions performed or provides some other input to show his performance during a given workout. This data is sent to the central server and used to generate subsequent workouts. The system also monitors a user's progress and sends reports to each club so that a club employee can contact any member who appears to be deviating from a set plan.

Figure 2:
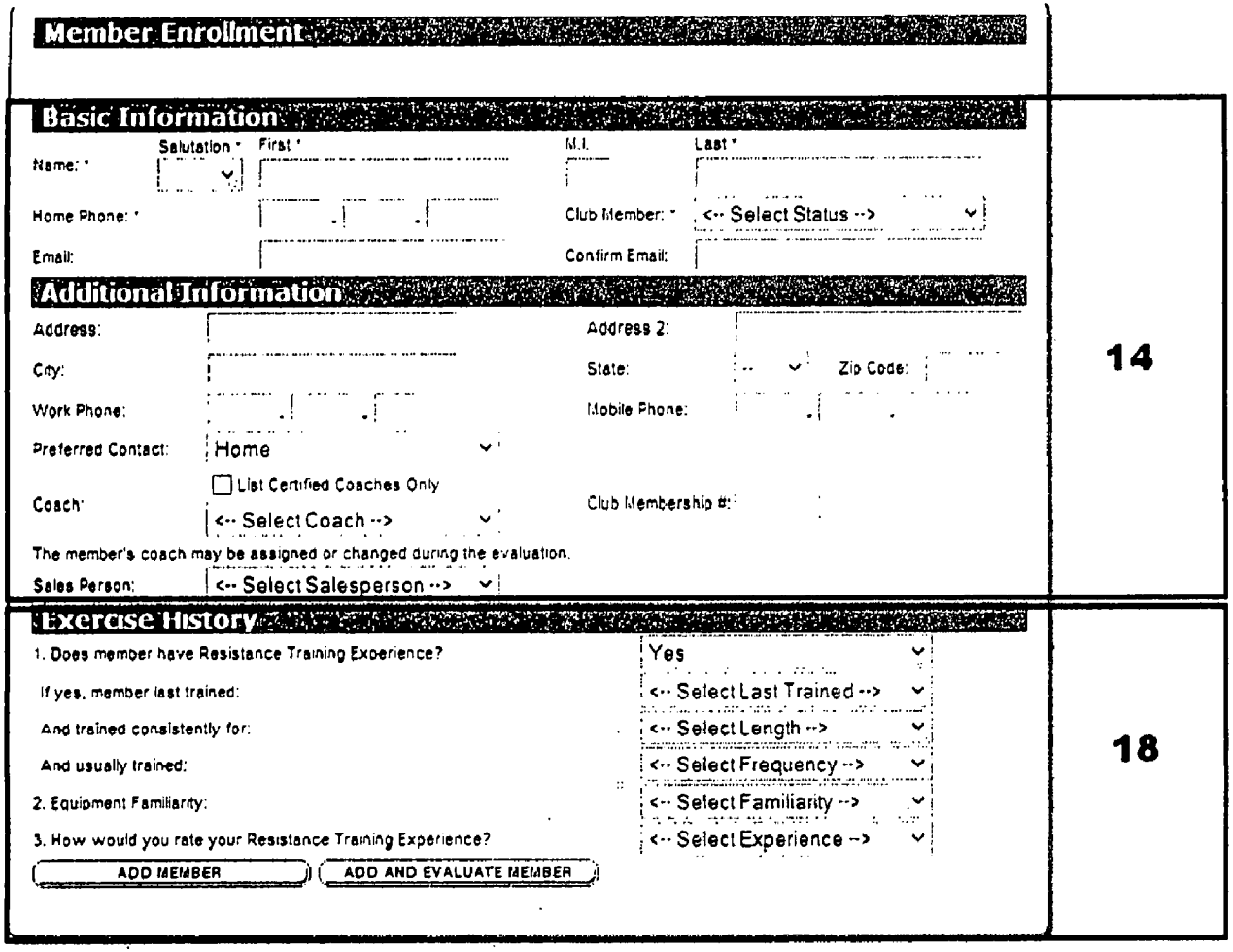
FIG. 2 is an example of a data entry screen for entering member information.

Referring now to the drawings, which are for the purpose of illustrating a preferred embodiment of the invention only, and not for the purpose of limiting same, FIG. 1 shows a flow chart listing the steps involved in entering a new member into the workout system of the present invention, and FIG. 2 shows a form 10 used for collecting this information. At a first step 12 in FIG. 1, information concerning the member is entered into the system. Form 10 includes a first section 14 into which information such as the member's name, address, phone number, and gender is input. In a second step 16 information concerning the member's preferences, such as the number of days per week that the member wishes to exercise, the member's previous resistance training experience, the member's willingness to perform barbell exercises and the member's resistance training experience level, is input into a second section 18 on form 110. Preference information may also be added to this section as the user completes several workouts.

It should be noted that resistance training involves working ones muscles against some source of resistance to muscle movement. Often the source of resistance is a weight, but it may also be a spring, a hydraulic cylinder, the user's own body mass, etc. Thus, unless differences are noted between the sources of resistance, the words weight and resistance are used interchangeably herein.

Figure 3B:
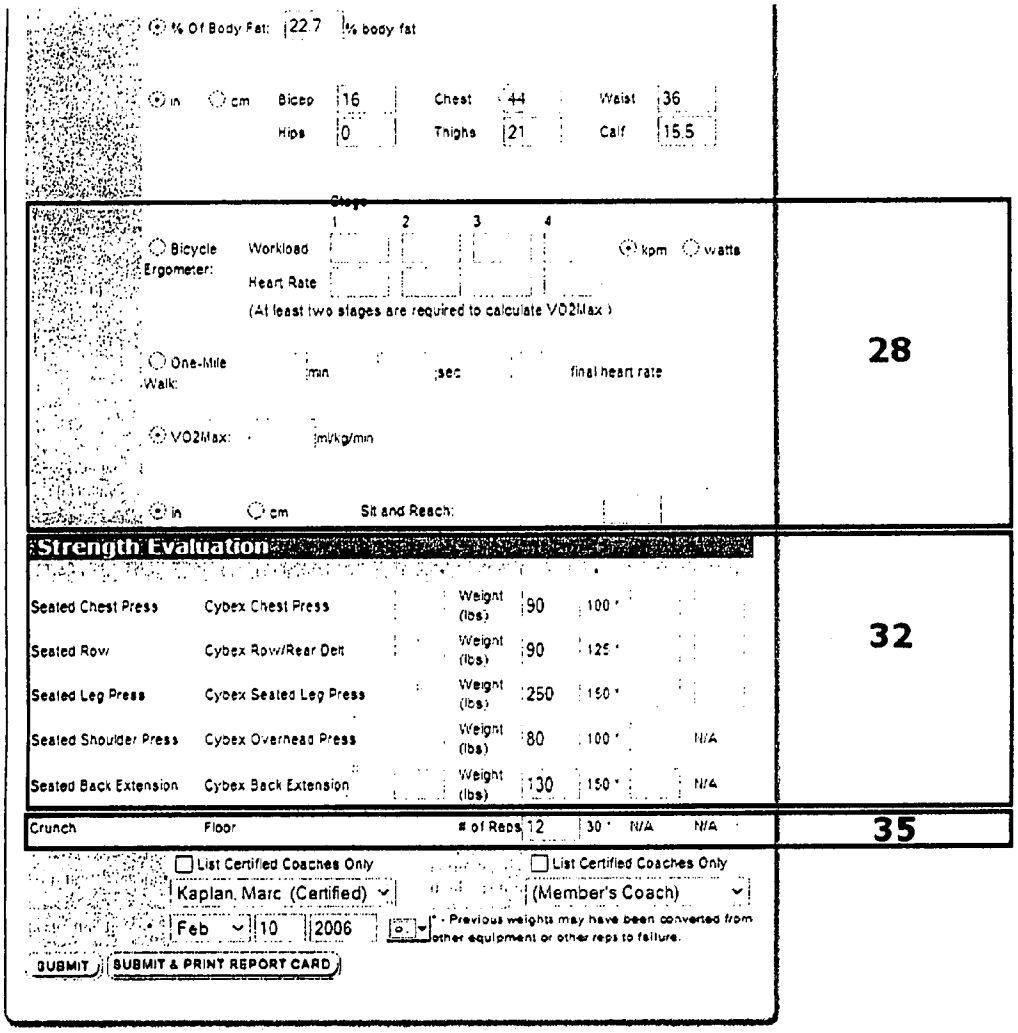

Once this information is entered, the member's goals are discussed at a third step 20 and input into section 22 of evaluation form 11 shown in FIG. 3. These goals may include, but are not limited to: reducing stress, improving strength, improving muscle tone, improving flexibility, improving posture, losing weight, increasing energy levels, improving cardiovascular health, maintaining weight and/or figure, and improving self confidence. While the goals paly no role in formulating the workout routine, they provide the club with an idea of the member's reasons for exercising and help the club employees tailor their encouragement. Of course, rules could easily be provided so that a member's goals are taken into account. For example, a user who indicated a goal of reducing his waistline could be assigned a greater number of abdominal exercises than would otherwise be assigned.

At a fourth step 24, the member's body measurements are taken and entered into section 26 of form 11. These measurements may include height, weight, blood pressure, resting heart rate, body composition and the circumference of biceps, chest, hips, thighs, waist and calves. Further, standard, tests are used to calculate the person's aerobic capacity by measuring performance during one or more of several standard aerobic exercises. $VO_2$Max, a standard measurement of the amount of oxygen a person can use per kilogram of body weight while exercising, may also be measured. This information is entered into section 28 of form 10.

The member is then asked, at a fifth step 30 of the process, to perform a series of eight repetitions of five exercises under the supervision of a trainer, which exercises are identified in section 32 of form 11 and include the seated chest press, the wide grip pulldown (front), the 45 degree leg press, the seated should press and the seated back extension. The maximum weight or resistance with which the member can perform eight repetitions is recorded for each of these exercises. Exercises other than these five exercises can be used for the evaluation as well, as long as those substitute evaluation exercises are correlated with the basic evaluation exercises that they replace. The method of correlating one exercise to another is discussed hereinafter.

At a sixth step 34, the number of abdominal crunches the member can perform is recorded and recorded in section 35 of the form 11.

At a seventh step 36, the above information is sent to a central location where a system administrator, working with various industry guidelines and tables, develops a workout routine for the individual that takes into account the individual's goals and physical abilities, number of days per week that the user wishes to exercise, and the user's experience level. Alternately, the routine could be the same for all individuals or automatically generated by rules built into the system. An example of a form 38 for preparing a routine is shown in FIG. 4, which shows the muscles that need to be exercised, the number of sets of exercises to be performed, and the suggested intensity of the workout. This information on this form shows a member who has selected a two-day per week workout and has a cardiovascular fitness level that is average.

The routine of FIG. 4 is directed to five different muscle groups, the pectorals ("pecs"), the outer pectorals, the deltoids, the outer thighs and the inner thighs. A different set of muscle groups may be the target of the second day of the two day per week workout. An appropriate number of sets of exercises for each muscle group is determined as is the intensity of the workout, either extra heavy (HH), heavy (H), medium (M) or light (L). Lastly, the gender of the member is associated with the listing of each muscle group to ensure that the system only selects exercises and uses various rules appropriate for persons of the designated gender.

Once the workout routine of FIG. 4 has been created, it is used as the basis for automatically generating a range of different daily workouts that will include a variety of different exercises performed in different manners on a variety of different machines (or using free weights or the user's own body) to keep the workouts interesting to the member. This process is described in greater detail below.

Figure 5:
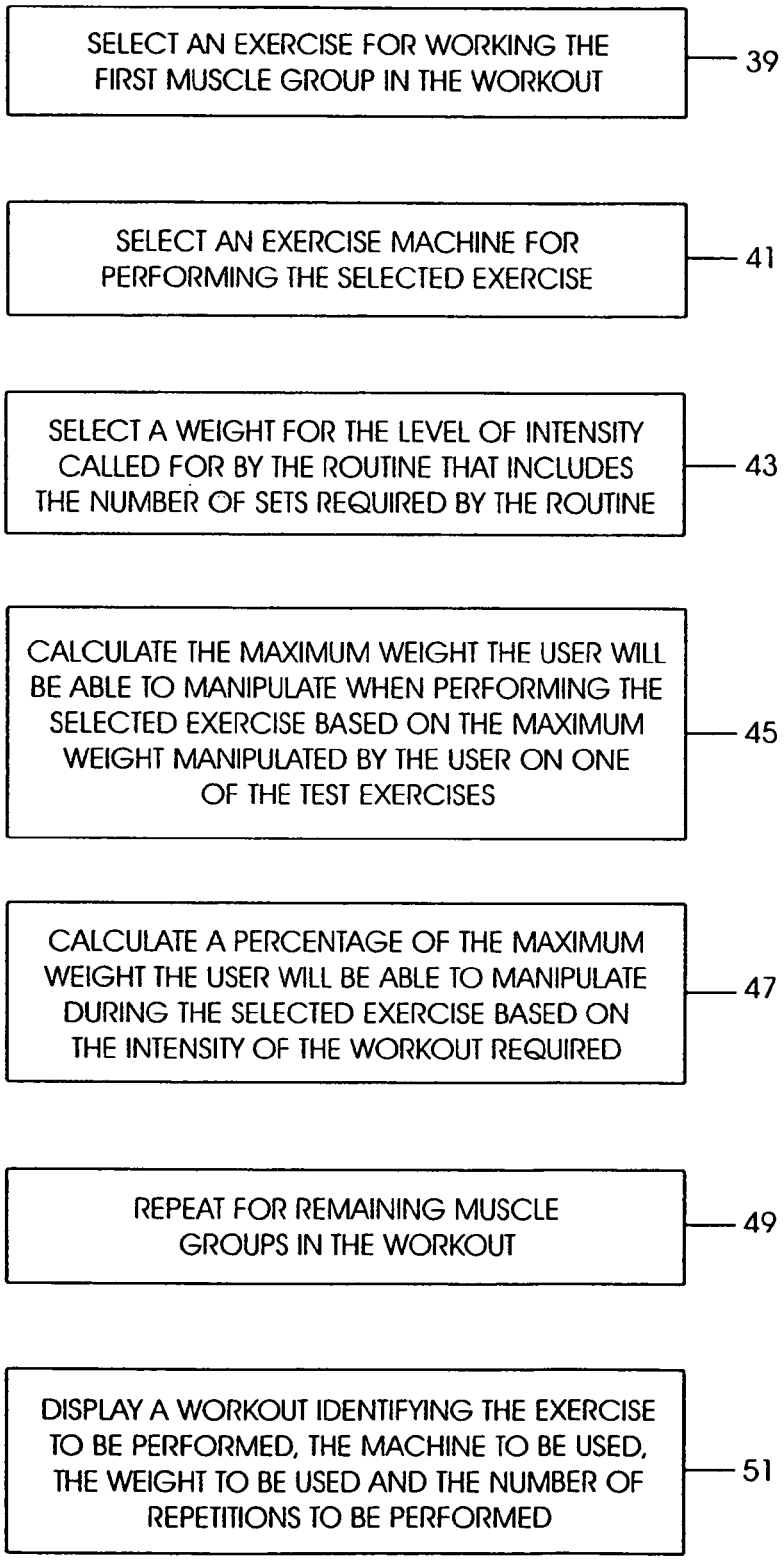
FIG. 5 is a flow chart showing how a workout is developed.

The process for generating a workout is outlined in FIG. 5 and includes as a first step 39, selecting an exercise designed to affect the muscle group called for in the routine, in this case, the pectoral muscles. The selection of an exercise for this muscle is fairly random; however, each exercise has an experience level associated with it, and an attempt is made only to assign exercises that do not exceed the experience level of the user. Thus, a user will do pectoral exercises that are considered relatively easy at first and later more complex exercises will be added to vary the workout to increase variety. In addition, guidelines are built into the system to assist with exercise selection. For example, certain squat exercises will not be assigned unless a member's baseline assessment on the 45 degree leg press is at least 90 lbs. Other guidelines include not assigning certain exercise to members of one gender or the other and limiting certain exercises to members of a given experience level. Limitations particular to a given member are also considered, for example, a user with certain physical conditions, such as a back injury, will not be assigned certain exercises. These limitations can be noted during the initial interview and allow the system to be customized in a number of ways to meet the needs of each user.

Each exercise assigned by the system is related to one of the five baseline exercises that a member performed during the initial evaluation. The baseline exercise for most exercises that affect the pecs is the seated chest press, and this baseline exercise is identified in the first column 40 of the table in FIGS. 7*a–x*. However, working out on a seated chest press on every day this muscle is exercised would quickly become boring. Therefore, a series of additional exercises have been listed in the second column 42 of the table in FIGS. 7*a–d* which exercises are also useful for developing the pecs. Many of these exercises can be performed using different types of resistance, for example, using dumbbells, barbells, or weight machines. Some of these exercises are more difficult than the seated chest press, and their difficulty and effectiveness will also depend on the nature of the resistance used. Therefore, a relationship must be developed between the baseline exercise and the each of the selected exercises, which takes into account the type of resistance used, to determine the weight or resistance that should be used in performing the exercises at a second step. Also, the gender of the member must be taken into account as some exercise are easier for members of one sex to perform than they are for others, even if the members performed identically on their baseline exercises.

Thus, with reference to FIG. 5, after an exercise is selected as a first step 39, an exercise machine for performing the exercise is selected at a second step 41. A weight rule identifying the number of sets and the workout intensity specified by the workout routine is then selected at a third step 43 which determines the number of reps in each set of exercises and the length of the rest period between sets. The maximum weight the user will be able to manipulate while performing this exercise is calculated at a fourth step 45 based on the relationship between the baseline exercise and the exercise selected at the first step 39 using a table such as the table shown in FIGS. 7*a–x*. Then, based on the intensity specified by the workout routine of FIG. 4, this maximum weight for the second exercise is multiplied by another fraction at a fifth step 47 to determine what percentage of the maximum weight for that exercise should be used for the workout. These processes are repeated at sixth step 49 for the remaining muscles specified in the workout shown in FIG. 4. Finally, a workout, such as the workout of FIG. 9, is printed or displayed at a seventh step 51. This process can may be better understood through the following example.

Assume, for example, that the member is a male whose maximum eight rep weight for the seated chest press was determined during the initial evaluation to be 100 pounds. The system selects the bench press as the first pecs exercise and a weight machine as the source of resistance. The proper resistance is determined by finding the appropriate row in the table of FIG. 7*a–x*. In this case, the exercise is the bench press, the gender of the user is male, the baseline exercise was performed with a weight in the range of 0 to 300 pounds and the resistance type is a weight machine. The row designated 42 includes all these conditions.

Column 44, labeled "maximum %," identifies the percentage of the 100 pound base weight that would provide the user with an equivalent eight rep workout on the bench press. In this case, the same weight would be used during the bench press as was used during the seated bench press. (Note, however, in the row designated 46, applicable when dumbbells are used for resistance, bench pressing two 40 pound dumbbells would be equivalent to pressing 100 pounds on the seated chest press.) Row 42 includes four additional columns, a column 48 labeled "HH %," a column 50 labeled "High %," a column 52 labeled "Med %" and a column 54 labeled "Low %." In row 42 these columns 48–54 include the values 75, 75, 65 and 50, respectively. These numbers represent the percentage of the maximum eight rep weight for the particular exercises that should be used for workouts of various intensities. The workout shown in FIG. 4 calls for the use of a three set medium weight rule; therefore the weight to use on the bench press is calculated as follows:(baseline max weight)×(max % of baseline weight)×(Med %). Using the numbers in row 42, this works out to be: 100 lbs.×100%×65%=65 lbs.

To recap, the system has determined that for the first workout, the user will exercise his pecs on a bench press weight machine and perform reps using a weight of 65 lbs. However, different weight machines operate in different manners, and therefore, 65 pounds of resistance on one machine may not provide the same workout as 65 lbs on a machine of a different manufacturer. The type of machine being used must be taken into account. FIG. 8 is a table showing the coefficients that must be multiplied by the selected weight for each of eight different bench press machines. With reference to FIG. 8, for example, if the bench press is to be performed on a Body Masters model CM262, shown in row 56 of the table in FIG. 8, the 65 lb base weight is multiplied by the coefficient 1, and 65 lbs of resistance is used. However, if a Nautilus 2ST, shown in row 58 of the table, is used, the 65 lb weight must be multiplied by the coefficient 1.05. This means that a weight of 65×1.05 or 68.25 lbs. should be used on that machine for a proper workout. Of course, one must round to the nearest weight increment that is available on equipment, so this exercise may ultimately be performed using 68 lbs or 70 lbs, depending on the weights available. All such calculations are performed by the system however, and the end user only sees a workout, similar to the one shown in FIG. 9, on which exercises, resistance sources and amounts, and numbers of reps and sets are shown.

As noted above, sometimes the preferred equipment for performing an initial evaluation is not available at a particular club. In that case, the system designates alternate evaluation equipment in an order of preference and the club uses this equipment to perform an evaluation. The results of these tests are normalized to the preferred evaluation equipment using the table of FIG. 7 in the manner described above. Thus, all members have information for the five preferred baseline exercises stored in the system even if they did were not evaluated on those devices.

Further variety is added to the workout by using weight rules, examples of which are shown in FIG. 6. These weight rules determine at least the number of reps to be included in each set of exercises, and preferably also specify the length of rest periods between sets and an increase threshold and a decrease threshold as discussed below. The weight rules are grouped by intensity of workout (extra heavy, heavy, medium and light) and by the number of sets of exercises provided. The workout specified by FIG. 4 calls for a first exercise comprising three sets of pec exercises of medium intensity, and therefore, a weight rule is randomly selected from the set of weight rules that includes three sets of exercises of medium intensity. These rules are designed by fitness professionals, but, once the appropriate set of weight rules is identified, a rule from within that set is chosen randomly. In this manner, even if a person performs the same exercise two days in a row or twice during a given week, it is likely that a different weight rule will be randomly selected, and therefore the number of repetitions and/or the rest periods between sets will be different than they were when the exercise was previously performed.

The system generating the workout randomly selects a rule from the rules shown in FIG. 6 wherein there rules are shown for illustration purposes. Dozens of rules are generally provided to increase variety. If weight rule 1001 is selected, for example, the first set of exercises would consist of the greatest or "BEST" number of reps, up to 20, that the user could perform using a 65 lb. weight. The user would then rest for 1 minute as specified in the workout, and begin a second set of 15–20 reps using the same weight, rest for one minute thirty seconds, and proceed to the third set which also includes 15–20 reps after which a one minute rest is indicated; The user then proceeds to the remaining resistance exercises for the day which are developed in the same manner as the pecs exercises. Varying the rest periods as well as the number of repetitions has been found to affect the intensity of a workout. Thus two workouts that are identical except for the rest periods between sets of exercises will feel different to a person, and changing this variable increases the number of exercises that can be performed.

An example of a workout generated by the system for a different user is shown in FIG. 9. As can be seen from this figure, in addition to a resistance workout as calculated above, the workout includes a warm-up period 60, an abs workout 62 and a cardiovascular workout 64. The warm up exercise is selected based on the muscle or muscle group that will be used in the first exercise of the workout and generally consists of several sets of exercises using lighter weights than are used during the regular portion of the workout. Thus, in the example of FIG. 9, the first exercise is a seated chest press and the warm up exercise is a bench press using dumbbells.

The abs workout 62 comprises a series of exercises designed to work the abdominal muscles. A table of abdominal levels and exercises is used to determine what abdominal exercise should be assigned for a given member. The table references abdominal exercises against a numeric abdominal level associated with that member (based on the number of crunches performed during the initial evaluation) as well as the number of days that the member has been performing at a given abdominal level. When the member completes a specified number of days without failure, the member's abs level is increased, and subsequent exercises are assigned based on this new abs level.

The cardiovascular workout 64 specifies a period of time for the member to maintain a target heart rate. The target heart rate is calculated from the rest heart rate, determined during an evaluation and stored in the system, using the Karvonen Formula, as adjusted by the configured cardio intensity for a given day as specified in the workout plan that has been chosen for that member. The adjustment is made as follows. Given a resting heart rate, "rhr," obtained a during the initial evaluation and a cardio intensity of (L)ow, (M)edium, or (H)igh specified by the routine for a given routine-day, a minimum heart rate factor (hMin) and maximum heart rate factor (hMax) are obtained as follows: for a low intensity workout, the minimum heart rate factor will be 0.50 and the maximum heart rate factor will be 0.59; for a medium intensity workout, the minimum heart rate factor will be 0.60 and the maximum heart rate factor will be 0.69; and, for a high intensity workout, the minimum heart rate factor will be 0.70 and the maximum heart rate factor will be 0.80. Next, these values are used in the following formulas to specify a minimum and maximum target heart rate for a given cardio workout:

$$\text{Minimum heart rate}=((220-\text{age}-\text{rhr})*h\text{Min})+\text{rhr}$$

$$\text{Maximum heart rate}=((220-\text{age}-\text{rhr})*h\text{Max})+\text{rhr}$$

The member may select from among a variety of cardiovascular exercise equipment available at the club as long as the target heart rate range is obtained. The cardio workout may be generally the same every day, or it may be related to the resistance workout. For example, a longer cardio workout may be provided on days when a lighter resistance workout is assigned.

The present system adapts to the user and increases or decreases the difficulty of workouts as the user's strength and fitness increase. Thus, if a given workout is too easy for the user, the system will take this into account and increase the resistance used for similar exercises in subsequent workouts. These adjustments may occur as a result of follow up evaluations conducted by a trainer at the club, an increase in the number of repetitions regularly performed by a member, or specific input from the user that the exercise is too easy. The automatic increases are explained with reference to FIG. 6, which lists an increase threshold for weight rule 1001 of 21 repetitions. If the user performs more than 21 repetitions, a point will be added to a counter or running score associated with that user. If the user fails to reach the decrease threshold of 15 reps, a point will be deducted from his score. When a certain number of points is accumulated, additional resistance is added to the given exercise and/or a set of exercises related to the given exercise. In this manner, the next time the given exercise or an exercise from the set of exercises related to the given exercise is selected by the system, the resistance assigned by the system will be greater than before the counter reached the certain number of points discussed above. With reference to the example above, the proper resistance for the user to use on a bench press machine was 65 lbs. However, if the user had accumulated 5 points, for example, by consistently performing more than 20 reps, this resistance would be calculated as before and then increased by 2 lbs, for example.

Alternately, resistances associated with a series of related exercises could be increased. Table 15 includes a first column 150 that identifies sources exercises, and in FIG. 15, each of the source exercises is the bench press. Column 152 identifies the sources of resistance used in performing the exercise, i.e., barbell, dumbbell or weight machine. Column 154 lists various weight ranges associated with the exercises of column 150. This accounts for the fact that the weight increase for a person who successfully bench presses 300 pounds a given number of times will be greater that the weight increase for a person who successfully bench presses 30 pounds a give number of times. Column 156 identifies exercises related to the source exercises; these exercises will have their resistance level increased each time an increase threshold is exceeded a given number of times when performing a source exercise (the given exercise is not always included in the set of related exercises). These exercises include the bench press, the cable crossover, the close grip bench press, the decline barbell bench press, the decline bench press, the decline dumbbell bench press, the decline dumbbell fly, the fly, the incline barbell bench press, the incline bench press, the incline chest press, the incline fly, the lying chest press, the lying extension, the pec fly, the reverse grip pushdown, the rope pushdown, the seated chest press, the seated dip, the seated overhead extension, the seated triceps extension, the straight bar pushdown, the V-bar pushdown and the wide chest press. Resistance sources for each of these related exercises are identified in column 158 headed "Result Resistance." The seated chest press is the baseline exercise for many of these exercises, including the bench press. However, not every exercise that has the seated chest press as its baseline exercise will be affected by these resistance increases.

The appropriate resistance increase for the related exercises may be different for men and women. Therefore, as shown in FIG. 15, column 160 includes coefficients for each of the exercises, appropriate resistance changes for males in column 162 and appropriate resistance changes for females in column 164. To determine the appropriate resistance change for a specified exercise, the gender of the person who will perform the exercise must be known. This information is present in the weight rules. Thus, for example, with reference to row 166 of the table of FIG. 15, if a person exceeds an increase threshold enough times while working with 65 pounds of resistance to qualify for a resistance increase on the bench press, and the person is male, the coefficient of column 160 is multiplied by the male resistance increase of column 162 to determine the weight increase. With reference to row 166, the coefficient is 2 and the resistance increase is 2 pounds. Therefore, the resistance increase for the bench press would be 4 pounds. The resistance increase for females is 1.5 pounds, and thus if the above example applied to a female, the weight increase would be 2 times 1.5 or 3 pounds. Resistance decreases are handled in a similar manner when the user fails consistently to reach the decrease threshold specified by a weight rule.

Users are periodically reevaluated, and new baseline weights are established. The above method provides for incremental adjustments between such evaluations to help ensure that the member is being appropriately challenged even as his strength increases. In a similar manner, if a member repeatedly fails to achieve a minimum number of reps, or reports that an exercise is too difficult, subsequent exercises will specify fewer reps and/or lighter amounts of weight.

Primary and secondary exercises are developed by the system as are exercises referred to as "emergency" exercises. Primary exercises include those that have been performed less frequently than the secondary exercises to help maintain variety in the user's workout. If a member does not wish to perform the designated primary exercises, the member may restrict that exercise from selection; if no primary exercises are available, a secondary exercise will be substituted for the primary exercise. Emergency exercises include exercises that can be performed without any equipment, such as pushups, or with equipment that should nearly always be available at a club, such as dumbbells. When, due to high use by other club members or equipment breakage, equipment necessary for performing one of the exercises specified by a workout is not available, the member will always have recourse to an emergency exercise that will satisfy the requirements of his workout. Emergency exercises can also be used when a member's strength is the factor that prevents him from using club equipment. For example, a member who can not bench press a 45 lb barbell bar might be assigned exercises using lighter weight dumbbells.

The use of the system by both a member and by a trainer is described below. A member arrives at a health club and is interviewed by a personal trainer or other individual trained in the use of the subject system. Personal information is collected, the new member's exercise goals are discussed, body measurements are taken, tests are done to determine the user's fitness levels and baseline exercises are performed to provide an indication of the user's strength. As discussed above, the results of the baseline exercises will be used to determine the correct amount of resistance to be used during the resistance portion of an exercise routine.

The next part of the member's training comprises an orientation during which the member is shown how to operate equipment that might be selected during the member's novice period, discussed below. This provides the trainer with an opportunity to demonstrate the exercise and equipment that the member will encounter early in their experience. For each exercise, the seat and other equipment positions (if configured for the equipment in question) can be recorded and will appear on the workouts as a reminder to the member.

Next, the user begins a six day "getting acquainted" routine to familiarize the user with the facilities and the process of using the present system. For this six-day period, workouts generated for the user generally follow certain special rules. For example, only two workouts are generally specified for this period with the first workout being used on days 1, 3 and 5 of the getting acquainted period and the second-workout on days 2, 4, and 6. The system will also attempt to select during this getting acquainted period the same equipment that was used during the member's initial evaluation to minimize confusion and increase the user's confidence.

After the getting acquainted period ends, the member is considered a novice for a period of time, which period may comprise the entire time the member is performing level 1 workouts or a fixed period of time such as ten days, for example. During the novice period, exercise and equipment selection for level one members is subject to being performed at least twice before other exercises and equipment can be selected for the same muscle. Furthermore only exercises designated as suitable for novices will be selected unless no such exercise is available.

Once the novice period ends, the member begins receiving regular workouts such as the workout shown in FIG. 9 upon arrival at the club. Generally, all workouts for a given day are delivered overnight via a network and printed in the morning for use by club members who are scheduled to attend that day. However, a workout can be generated at any time if a member shows up on a day that he is not expected to attend or if the member does not wish to perform the specified exercise and requires the generation of an alternate workout. The user follows the instructions on the workout and fills in the blanks next to the assigned exercises with the number of reps performed, the number of minutes spent on cardiovascular exercise and any other information that may be relevant to the workout, such as problems that were encountered or information concerning exercises that were too easy or too difficult. When done, the user turns the form in to a club employee, and the data thereon is entered into the system by the club and sent to the system administrator for processing. This data is used in calculating future workouts.

Figure 10:
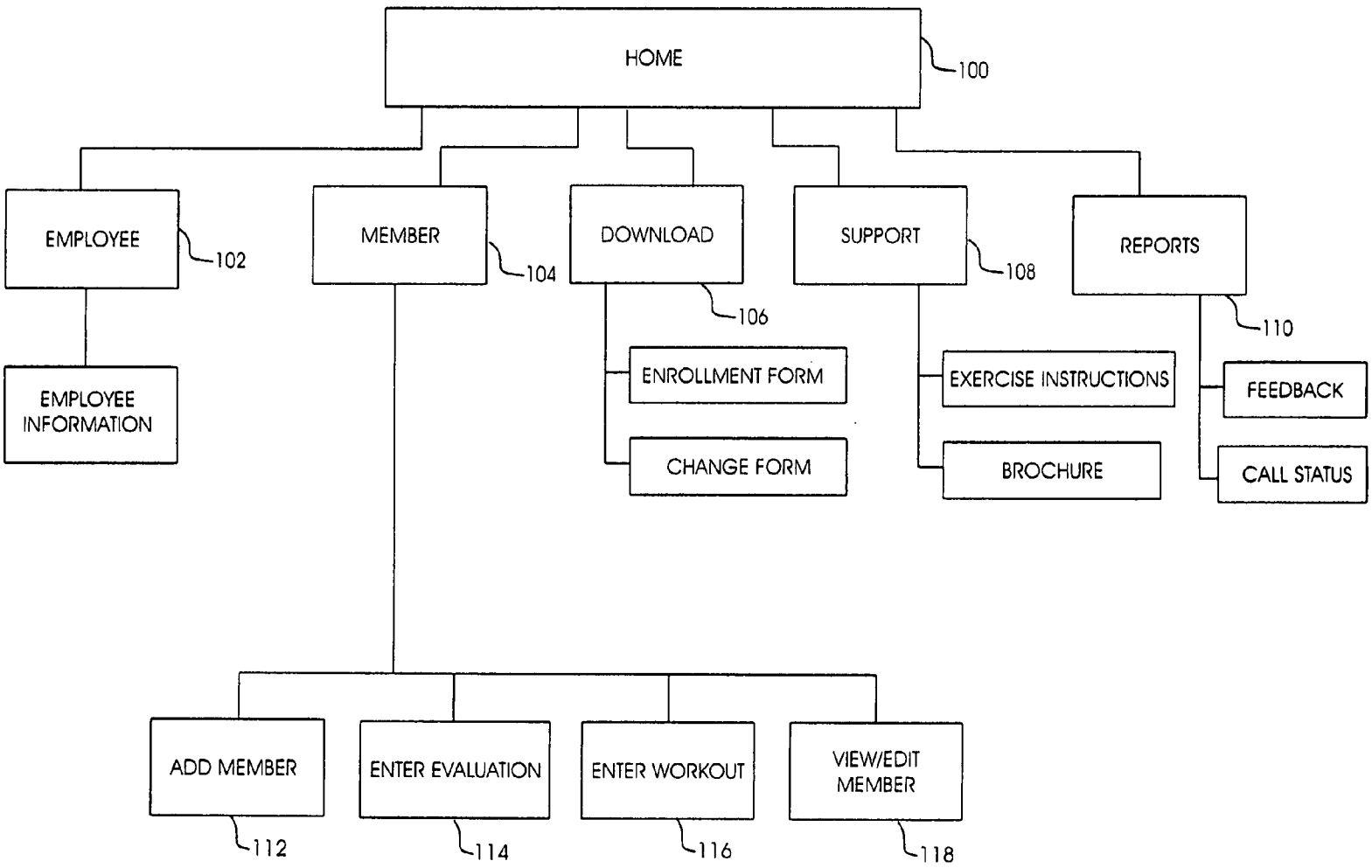
FIG. 10 is a flow chart showing the structure of a computer program that comprises a part of the present invention.

FIG. 10 shows the organization of the system as it is viewed by a personal trainer or other club employee. From an initial home screen 100, the trainer can select a number of options including Employee 102, Member 104, Download 106, Support 108 and Reports 110. Selecting option Employee 102, the user is presented with information concerning a personal trainer or other gym employee as shown in FIG. 11.

Upon selecting Member 104, the user is presented with four additional options, namely, Add Member 112, Enter Evaluation 114, Enter Workout 116 and View/Edit Member 118. The Add Member option 112 allows member information to be entered into the present system. Likewise, the Enter Evaluation option 114 allows the trainer to enter either an initial or follow up evaluation into the system. The evaluation provides up-to-date data for use in configuring future workouts. The Enter Workout option 116 provides the employee for entering the workout number of the workout that has been completed by a member and entering information such as the number of reps completed by the member into the system. Finally, member information can be viewed and edited using View/Edit Member option 118 as shown in FIG. 12.

The Download option 106 allows the employee to download various forms provided by the system administrator, for example printed enrollment forms and member information change forms.

The Support option 108 provides a link to detailed documents, in PDF format, for example, including color brochures with photographs and detailed instructions for performing various exercises that can be assigned by the system.

The Reports Option 110 allows for a user to report computer problems to the system operator, and more importantly, to generate member call/status reports discussed below.

As noted earlier, one benefit of using a personal trainer is that the trainer provides encouragement and motivation to club members and can quickly intervene when a member begins to deviate from a routine. Unmonitored members may slowly stop following their prescribed routines, exercise too frequently or not frequently enough, or otherwise take actions that a personal trainer would quickly recognize as being not in the best interest of the member's health and stated workout goals. These problems are addressed by the present system by providing club employees with weekly "call/status" reports such as the report 120 shown in FIG. 13. These reports includes a list of members assigned to a club employee, and a summary of the status of each member. This summary includes the member's name and contact information, the number of weeks the member has been attending and the number of workouts completed in that time. Details and statistics regarding the days that the member attended and their selected fitness level, average workout time, and graphical information concerning attendance over a period of weeks is also provided.

The report also includes a graphics field with a symbol that quickly identifies to the club employee the status each member. For example, a first symbol 122 indicates that a member is new, a second symbol 124 indicates that a member is on track in following his assigned routine, third and fourth symbols 126, 128 show that the member has been off track for one or two weeks, respectively, a fifth symbol 130 is provided to show a member is back on track after having been off track, a sixth symbol 132 shows a member has been over attending, a seventh symbol 134 shows that a member has been suspended, an eighth symbol 136 identifies a member who has cancelled membership and a ninth symbol 138 indicates that a follow up member evaluation is due.

Using this report, a trainer can quickly determine which members should be contacted and take appropriate action to provide encouragement or instruction to help get the member back on track or take another action such as scheduling an evaluation. The report is generated automatically each week and sent to the club, with one report for each trainer. Furthermore, the report is separated into two sections, a first section of members who require a telephone call and a second section of members who are on track with their workout and do not need instruction at this time. These reports also allow club management to evaluate the effectiveness of trainers. Trainers with a higher than average number of cancelled members, or trainers who have many members who have been off track for multiple weeks can be contacted to determine whether a problem exists.

Additional features and aspects of the system are described below.

The system follows a unique method of determining the proper resistance for the type of exercise known as a "dip" which involves a user supporting himself on his hands between a pair of spaced support so that his body hangs down between the supports. The user then lowers and raises himself to work muscles in the arms and chest. The particular muscles involved depend on hand position and other variables well known in the art. Two variations on the dip are the weighted dip and the assisted dip. In performing the weighed dip, the user either carries weights on his body to increase the difficulty of the exercises, or attaches his legs or other body part to a source of resistance, such as a cable connected to a weight stack via pulleys. In this manner, the user receives a more intense workout than could be provided by his body weight alone. In the assisted dip, a person stands on a platform that is biased in an upward direction while performing the dip, effectively decreasing the amount of weigh being lifted.

Many users are too weak when they begin an exercise program to complete many dips. In order to include this exercise in a routine, the system determines from the baseline exercises the amount of force a user can or should attempt to exert during a dip exercise and compares this amount to the user's recorded weight. If the user's weight is approximately equal to the determined amount of force, the user is assigned normal dips. If the user's weight is too great for him to effectively perform dips, assisted dips are assigned. Lastly, if the user's weight is too little for dips to be effective, weighted dips are assigned. The amount of assist or weight is based on the difference between the user's weight and the amount of force the user can exert.

The system is adapted to generate a member report card, such as the one shown in FIG. 14, after the member completes the initial evaluation. At that time, an email is sent to the member welcoming him to the program. In addition to general welcome and instructional information, the email will contain a link to a dynamically generated member report card document which will be generated and delivered to the member's web browser when the link is followed. The report card is similar to the member profile of FIG. 13, but does not include a call log. Instead of the call log, the report card display a set of scores for each of the following metrics: $VO_2$max, upper body strength, lower body strength, flexibility, and percent body fat. To obtain the scores, the appropriate subset of the member's measurements and strength assessment are calculated against fitness industry normative population data to obtain a percentile rank for the member in each area. Finally, the scores are averaged to produce a total score for that member, so that the member and the coach may track that member's overall and specific progress in each area.

The system can be configured to allow club employees to obtain workouts from the present system without being assigned to a coach or counted in the membership numbers. The number of employees having this privilege can be configured on a club by club basis.

The system also includes a training feature generally similar to the program that is used by the club, but populated with fictional members and data. This allows new club employees to be trained without the danger that member information will inadvertently be altered during the employee training process.

The system maintains a master list of exercise equipment in which basic information about every known piece of equipment is maintained. This information includes manufacturer, make or product family, a name that is usually descriptive of the product function, a model and the exercise capabilities of the product, i.e. the various exercises that can be performed using that product. The status of the product is also maintained, in other words, whether the product has been approved for use in the system of the present invention. A separate "evaluation acceptability" determination is also made and tracked in the database. Certain equipment may be capable of being used in an initial evaluation, but this category allows certain pieces of equipment to be excluded from use in the initial evaluation while leaving them available for other use. A listing of the various seat positions and other adjustments that can be made to each piece of equipment is also maintained.

Equipment is also tracked on a club-by-club basis, so that workouts generated for a given club only use equipment that is available at that club. Details specific to the item of equipment at a club is tracked, including how the device is labeled at the particular club and what modifications may have been made to the machine, such as the provision of additional weights beyond those that come standard with the machine.

The status of machines at a club is also tracked. Those that are out of order or in need of service can be placed on suspended status so that they will not be selected when exercise routines are generated. The status is returned to active when the machine is fixed.

The present invention has been described herein in terms of a preferred embodiment, it being understood that numerous modifications and additions to the described embodiment will become apparent to those skilled in the relevant arts after a reading and understanding of the foregoing description. It is intended that all such obvious modifications and changes form a part of this invention to the extent they are defined by the several claims appended hereto.

What is claimed is:

1. A method of determining an appropriate resistance for an individual to use in exercising in a given manner, comprising the steps of:

determining a maximum resistance a user can manipulate during a first exercise;

determining a function that relates said first exercise to at least another given exercise;

from said function, predicting a maximum resistance with which the user will be able to exercise during said at least another given exercise; and displaying an indication of said maximum resistance or a function of said maximum resistance.

2. The method of claim 1 wherein the step of displaying an indication of said maximum resistance or a function of said maximum resistance comprises the step of displaying a predetermined fraction of said maximum resistance.

3. A method of establishing an appropriate resistance for an individual to use in performing an exercise comprising the steps of:

determining the maximum resistance a user can manipulate during a first exercise performed with a first exercise device;

determining a function that relates said first exercise to a second exercise;

from said function, predicting a maximum resistance the user will be able to manipulate during said second exercise performed on a second exercise device;

setting a resistance level on a second exercise device to a level related to said second exercise maximum resistance.

4. A method of establishing an appropriate resistance for an individual to use in performing an exercise comprising the steps of:

determining the maximum resistance a user can manipulate during a first exercise performed with a first exercise device;

determining a plurality of functions that relate said first exercise to a plurality of second exercises;

from a selected one of said plurality of functions, predicting a maximum resistance the user will be able to manipulate during a selected one of said plurality of second exercises;

selecting a second exercise device from the group consisting of exercise devices for performing said second exercise;

determining a relationship among the exercise devices in said group consisting of exercise devices for performing said second exercise; and setting a resistance level on the selected second exercise device to a level related to said second exercise maximum resistance and to said relationship among the exercise devices in said group consisting of exercise devices for performing said exercises.

* * * * *